US009918512B2

(12) United States Patent
Lazarchik et al.

(10) Patent No.: US 9,918,512 B2
(45) **Date of Patent: *Mar. 20, 2018**

(54) FOOTWEAR WITH SUPPORT AND TRACTION

(71) Applicant: Sequence LLC, Chestnut Hill, MA (US)

(72) Inventors: Daniel B. Lazarchik, South Boston, MA (US); Nicholas Huber, Woburn, MA (US); Stephanie F. Connaughton, Chestnut Hill, MA (US)

(73) Assignee: Sequence LLC, Chestnut Hill, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/844,838

(22) Filed: Sep. 3, 2015

(65) Prior Publication Data

US 2016/0066648 A1 Mar. 10, 2016

Related U.S. Application Data

(60) Provisional application No. 62/047,404, filed on Sep. 8, 2014, provisional application No. 62/072,733, filed on Oct. 30, 2014.

(51) Int. Cl.
*A43B 7/14* (2006.01)
*A43B 3/10* (2006.01)
(Continued)

(52) U.S. Cl.
CPC ..... *A43B 3/108* (2013.01); *A43B 3/128* (2013.01); *A43B 7/146* (2013.01); *A43B 7/148* (2013.01);
(Continued)

(58) Field of Classification Search
CPC ..... A43B 3/0036; A43B 7/00; A43B 7/146; A43B 13/12; A43B 13/14; A43B 13/38; A43B 13/386; A43B 17/00; A43B 17/006
(Continued)

(56) References Cited

U.S. PATENT DOCUMENTS 429,429 A * 6/1890 Eckhardt ..... A43B 7/06 152/210
997,657 A * 7/1911 Drake ..... A43B 5/06 36/129

(Continued)

FOREIGN PATENT DOCUMENTS

KR 200319548 Y1 7/2003
KR 101380100 B1 4/2014

(Continued)

OTHER PUBLICATIONS 11813231.5, "European Application Serial No. 11813231.5, European Extended Search Report dated Oct. 28, 2014", Sequence LLP, 7 Pages.

(Continued)

*Primary Examiner* — Marie Bays
(74) *Attorney, Agent, or Firm* — GTC Law Group PC & Affiliates

(57) ABSTRACT

A layered engagement structure includes a first layer with a multiple of openings, the first layer at least partially corresponds to a shape of a foot sole and a multiple of columns, each of the multiple of columns correspond with one of the multiple of openings in the first layer to extend at least partially therein.

18 Claims, 44 Drawing Sheets

(51) Int. Cl.

| | |
|---|---|
| ***A43B 13/38*** | (2006.01) |
| ***A43B 13/12*** | (2006.01) |
| ***A43B 17/00*** | (2006.01) |
| ***A43B 3/12*** | (2006.01) |
| ***A43B 13/18*** | (2006.01) |
| ***A43B 13/22*** | (2006.01) |
| ***A43B 13/26*** | (2006.01) |
| ***A43B 23/28*** | (2006.01) |

(52) U.S. Cl.
CPC ..... *A43B 7/149* (2013.01); *A43B 7/1485* (2013.01); *A43B 13/12* (2013.01); *A43B 13/181* (2013.01); *A43B 13/226* (2013.01); *A43B 13/26* (2013.01); *A43B 13/386* (2013.01); *A43B 17/003* (2013.01); *A43B 17/006* (2013.01); *A43B 23/28* (2013.01)

(58) Field of Classification Search
USPC ..... 36/43, 44, 141, 30 R, 59 R, 61
See application file for complete search history.

(56) References Cited

U.S. PATENT DOCUMENTS 2,192,601 A * 3/1940 Mattison ..... A47C 27/144 5/729
2,931,110 A * 4/1960 Pietrocola ..... A43B 13/37 264/250
3,717,238 A * 2/1973 Fox ..... A43B 5/0415 36/61
3,747,238 A * 7/1973 Jankauskas ..... A43C 15/14 36/61
3,757,774 A * 9/1973 Hatuno ..... A43B 3/128 36/141
4,047,310 A * 9/1977 Sunoo ..... A43B 3/128 36/11.5
4,345,387 A * 8/1982 Daswick ..... A43B 7/146 36/29
4,715,133 A * 12/1987 Hartjes ..... A43B 5/001 36/127
4,747,220 A * 5/1988 Autry ..... A43B 13/26 36/114
4,823,799 A * 4/1989 Robbins ..... A43B 7/146 36/129
5,077,916 A * 1/1992 Beneteau ..... A43B 5/001 36/128
5,171,619 A 12/1992 Reuben et al.
5,367,791 A * 11/1994 Gross ..... A43B 13/26 36/25 R
5,551,173 A * 9/1996 Chambers ..... A43B 7/146 36/141
5,664,342 A * 9/1997 Buchsenschuss ..... A43B 7/144 36/141
5,815,951 A * 10/1998 Jordan ..... A43C 15/14 36/134
5,820,573 A 10/1998 Ramos et al.
5,860,229 A * 1/1999 Morgenstern ..... A43B 7/1415 36/141
6,023,859 A * 2/2000 Burke ..... A43B 3/0047 36/100
6,076,282 A * 6/2000 Brue' ..... A43B 7/081 36/141
6,205,684 B1 * 3/2001 Snyder ..... A43B 7/144 36/141
6,389,714 B1 * 5/2002 Mack ..... A43C 15/14 36/100
6,564,397 B1 5/2003 Hawley et al.
6,691,432 B2 * 2/2004 Masseron ..... A43B 13/12 36/141
6,698,110 B1 * 3/2004 Robbins ..... A43B 5/185 36/134
6,743,325 B1 6/2004 Taylor
6,904,705 B2 * 6/2005 Polegato Moretti ..... A43B 7/06 36/11
6,935,382 B2 8/2005 Buckley
7,013,588 B2 * 3/2006 Chang ..... A43B 1/0054 36/141
7,444,763 B2 * 11/2008 Grove ..... A43B 13/223 36/100
7,966,748 B2 * 6/2011 Votolato ..... A43C 15/02 36/100
8,082,682 B2 * 12/2011 Karl ..... A43B 5/12 36/43
8,298,648 B2 10/2012 Turner et al.
8,813,387 B2 * 8/2014 Grove ..... A43B 13/223 36/100
8,822,012 B2 9/2014 Franks et al.
9,463,348 B2 10/2016 Connaughton et al.
9,561,396 B2 2/2017 Lazarchik et al.
9,586,083 B2 3/2017 Lazarchik et al.
2004/0148725 A1 8/2004 Blum et al.
2004/0250346 A1 12/2004 Vasishth
2005/0003173 A1 1/2005 Nichols
2005/0129910 A1 6/2005 Chang
2005/0188562 A1 * 9/2005 Clarke ..... A43B 5/18 36/15
2005/0268487 A1 * 12/2005 Ellis, III ..... A43B 3/0005 36/25 R
2006/0213091 A1 * 9/2006 Ometto ..... A43B 7/081 36/141
2007/0079532 A1 * 4/2007 Ramirez ..... A43B 7/1415 36/140
2007/0207286 A1 9/2007 Craig et al.
2007/0277401 A1 12/2007 Young-Chul et al.
2008/0081153 A1 4/2008 Yeh
2008/0250666 A1 * 10/2008 Votolato ..... A43B 3/16 36/7.1 R
2008/0305304 A1 12/2008 Yeh
2010/0129573 A1 5/2010 Kim
2010/0299833 A1 12/2010 Kessler
2011/0004998 A1 1/2011 Losio
2011/0126422 A1 * 6/2011 Vattes ..... A43B 7/144 36/10
2011/0192056 A1 * 8/2011 Geser ..... A43C 15/14 36/114
2012/0076981 A1 3/2012 Franks et al.
2014/0342118 A1 11/2014 Connaughton
2015/0165261 A1 6/2015 Lazarchik et al.
2015/0165262 A1 6/2015 Lazarchik et al.

FOREIGN PATENT DOCUMENTS

KR 1020140104210 A 8/2014
WO 9804170 A1 2/1998
WO 2012016116 A2 2/2012
WO 2012016116 A3 5/2012
WO 2016/040129 A1 3/2016

OTHER PUBLICATIONS

PCT/US2011/045846, "International Application Serial No. PCT/US2011/045846, International Preliminary Report on Patentability dated Feb. 14, 2013", Bendigear LLC et al., 6 pages.
PCT/US2011/045846, "International Application Serial No. PCT/US2011/045846, International Search Report dated Mar. 28, 2012", Bendigear LLC et al, 12 pages.
PCTUS2015048390, "International Application Serial No. PCT/US2015/048390, International Search Report and Written Opinion dated Dec. 10, 2015", Sequence LLC, 12 Pages.
PCT/US2015/048390, "International Application Serial No. PCT/US2015/048390, International Preliminary Report on Patentability and Written Opinion dated Mar. 23, 2017", Sequence LLC, 9 Pages.

* cited by examiner

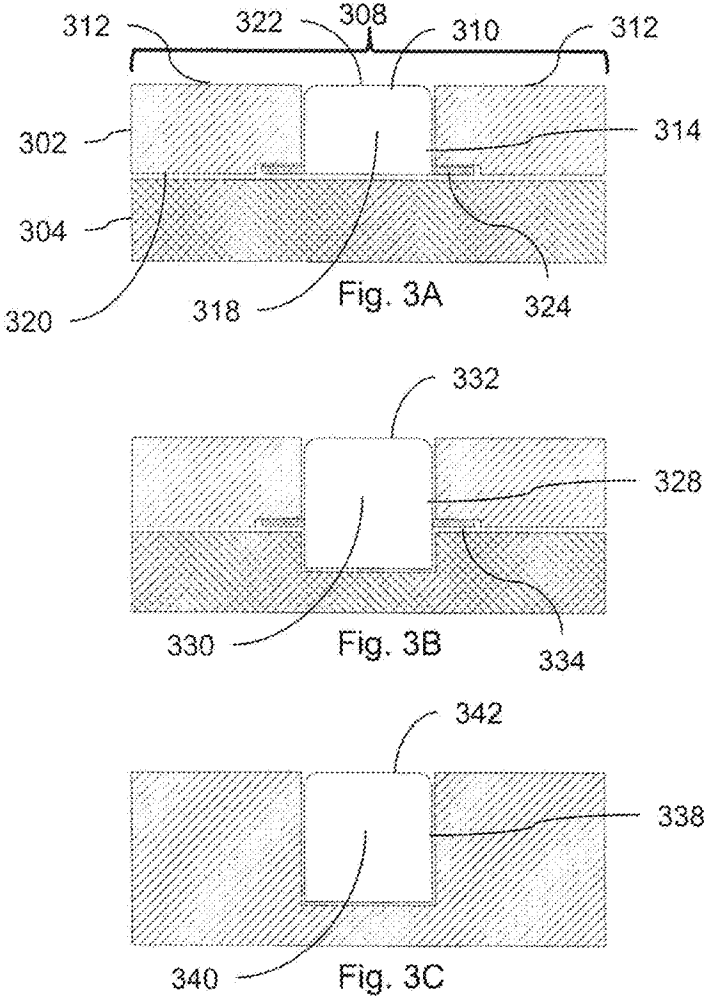
300

1500

FOOTWEAR WITH SUPPORT AND TRACTION

CROSS-REFERENCE TO RELATED APPLICATIONS

This application claims the benefit of the following provisional applications: U.S. Patent Application No. 62/047,404, filed Sep. 8, 2014 (BNDG-0003-P01); and U.S. Patent Application No. 62/072,733, filed Oct. 30, 2014 (BNDG-0004-P01).

Each of the above applications is hereby incorporated by reference in its entirety.

BACKGROUND

The present disclosure generally relates to footwear, and more specifically with footwear having a layered engagement structure.

Although many different types of footwear have been available to consumers, footwear construction has remained relatively constant. Generally speaking, a different combination of characteristics is provided for indoor and outdoor footwear categories.

Indoor footwear include various types of socks, slippers, moccasins, slipper boots, and such types of softer and less durable footwear. Typically, characteristics of indoor footwear include some combination of comfort, warmth and appearance. In addition, it generally is desirable for indoor footwear to have a soft bottom, so as not to scuff, scratch, or otherwise damage, hardwood or similar indoor floor surfaces. As a result, most indoor footwear is manufactured entirely of soft fabrics and other soft materials.

Outdoor footwear, on the other hand, generally needs to be capable of accommodating harsher surfaces and environments. Outdoor footwear include, for example, a variety of dress footwear, casual footwear, tennis footwear, running footwear, work footwear, boots, sandals, thongs and sneakers. Typically, characteristics of outdoor footwear include relatively stronger and more durable materials, such as natural and/or synthetic leather, rubber and/or durable fabrics. The sole of outdoor footwear generally must be very strong and durable in order to protect the wearer's foot from rough or jagged ground surfaces.

The differences in the desired properties of indoor footwear versus outdoor footwear, as well as the differences among the various subcategories, conventionally result in specific footwear satisfactory for only a single purpose.

SUMMARY

A layered engagement structure, according to one disclosed non-limiting embodiment of the present disclosure can includes a first layer with a multiple of openings, the first layer at least partially corresponds to a shape of a foot sole; and a multiple of columns, each of the multiple of columns correspond with one of the multiple of openings in the first layer to extend at least partially therein.

A further embodiment of any of the embodiments of the present disclosure may include a second layer to at least partially entrap the multiple of columns with respect to the first layer.

A further embodiment of any of the embodiments of the present disclosure may include a web that joins each of the multiple of columns, the web located between the first layer and the second layer.

A further embodiment of any of the embodiments of the present disclosure may include, wherein the layered engagement structure is an insole, a top surface of the first layer forms a top surface of the layered engagement structure.

A further embodiment of any of the embodiments of the present disclosure may include, wherein the layered engagement structure is an outsole, a bottom surface of the first layer forms the bottom surface of the layered engagement structure.

A further embodiment of any of the embodiments of the present disclosure may include, wherein each of the columns range in size from 0.01 to 100 square centimeters in area.

A further embodiment of any of the embodiments of the present disclosure may include, wherein at least one of the multiple of columns forms a graphic in cross-sectional shape.

A further embodiment of any of the embodiments of the present disclosure may include, wherein the multiple of columns form a graphic.

A further embodiment of any of the embodiments of the present disclosure may include, wherein the layered engagement structure forms a portion of a footwear item.

A further embodiment of any of the embodiments of the present disclosure may include, wherein the multiple of columns form an organic pattern, the organic pattern correspond to a region of the user's foot.

A further embodiment of any of the embodiments of the present disclosure may include a web that joins each of the multiple of columns, the web located between the first layer and a second layer.

A further embodiment of any of the embodiments of the present disclosure may include, wherein the multiple of columns extend from a second layer, the second layer at least partially corresponds to a shape of a foot sole.

A further embodiment of any of the embodiments of the present disclosure may include, wherein a bottom surface of the second layer forms a bottom surface of a footwear item.

A further embodiment of any of the embodiments of the present disclosure may include a third layer with a multiple of openings that corresponds to the multiple of openings in the first layer, the third layer attached to the first layer such that at least a portion of a top surface of the third layer forms a surface closest a user's foot.

A further embodiment of any of the embodiments of the present disclosure may include, wherein the third layer is manufactured of a wear-resistant material.

A further embodiment of any of the embodiments of the present disclosure may include, wherein the first layer is formed of a first material and the second layer is formed of a second material different than the first material.

A further embodiment of any of the embodiments of the present disclosure may include, wherein the first material is relatively softer than the second material.

A further embodiment of any of the embodiments of the present disclosure may include, wherein the multiple of columns are arranged to provide propriocentric cues.

A further embodiment of any of the embodiments of the present disclosure may include, wherein at least one of the multiple of columns includes a hollow region.

A further embodiment of any of the embodiments of the present disclosure may include, wherein a top surface of at least one of the multiple of columns are generally flush with a top surface of the first layer while the first layer is in an uncompressed state.

A further embodiment of any of the embodiments of the present disclosure may include, wherein at least one of the multiple of openings extends completely through the first layer.

A further embodiment of any of the embodiments of the present disclosure may include, wherein a top surface of at least one of the multiple of columns is covered by the first layer.

A further embodiment of any of the embodiments of the present disclosure may include, wherein a top surface of the multiple of columns are generally flush with a top surface of the first layer while the first layer is in an uncompressed state.

A further embodiment of any of the embodiments of the present disclosure may include a second layer that at least partially corresponds to the shape of first layer, the multiple of columns extend from the second layer; and a third layer that at least partially corresponds to the shape of first layer, the third layer including a second multiple of openings therethrough, the second layer between the first layer and the third layer.

A further embodiment of any of the embodiments of the present disclosure may include, wherein the second layer includes a second multiple of columns, each of the second multiple of columns correspond with one of the second multiple of openings in the third layer to extend at least partially therein.

In an aspect, a footwear insole may include a first layer formed of a compressible first material with a top surface, a bottom surface, and one or more groups of one or more openings through at least one of the top surface and the bottom surface, and a second layer with a top surface and one or more groups of one or more columns formed from a second material protruding from the top surface in a position that corresponds to the openings in the first layer, wherein the one or more columns extend at least partially through the at least one or more openings. Each of the columns range in size from 0.01 to 100 square centimeters in area and may be at least one of square, circular, trapezoidal, triangular in shape, or have organic shapes arrayed in organic patterns. The patterns may correspond to various regions of the top surface of the first layer, various regions of the user's foot that engage the top insole, or may include the columns being shaped or arrayed to form a brand logo, graphic or image. The columns may not be integral to the second layer, but may be joined by a web and the column and web assembly may be mounted between the first layer and the second layer. The first layer and the second layer may be formed together in a two-material molding process, three-material molding process, insert molding, or casting process. The first layer may be molded directly onto or otherwise securely joined to the top surface of the second layer. The first layer, the second layer and the columns may be formed together in a three-material molding or casting process. The columns may be formed directly onto the second layer. The bottom surface of the second layer of the footwear insole may form the bottom surface of the footwear. The insole may be attached to the midsole, the outsole, or the upper of the footwear.

In an aspect, a footwear insole may include a top layer with a multiple of first openings, a bottom layer with a multiple of second openings, a top component comprising a multiple of first columns, and a bottom component comprising a multiple of second columns, wherein the first columns extend at least partially through at least one of the multiple of first openings and the second columns extend at least partially through at least one of the multiple of second openings. The bottom surface of the bottom layer of the footwear insole may form the bottom surface of the footwear.

In an aspect, a footwear insole may include a top layer with a multiple of first openings, a bottom layer with a multiple of second openings, and a component including a multiple of first columns and a multiple of second columns, wherein the first columns extend at least partially through at least one of the multiple of first openings and the second columns extend at least partially through at least one of the multiple of second openings. The bottom surface of the bottom layer of the footwear insole may form the bottom surface of the footwear.

In an aspect, a footwear outsole may include a first layer formed of a compressible first material with a top surface, a bottom surface, and one or more groups of one or more openings through at least one of the top surface and the bottom surface, and a second layer with a top surface, a bottom surface and one or more groups of one or more columns formed from a second material protruding from the bottom surface in a position that corresponds to the openings in the first layer, wherein the one or more columns extend at least partially through the at least one or more openings. The bottom surface of the second layer may have between 0.003 to 25 columns per square centimeter. Each of the columns may range in size from 0.01 to 100 square centimeters in area. The columns may be square or circular or trapezoidal or triangular in shape, and/or are arrayed in geometric patterns and may have organic shapes or be arrayed in organic patterns. The patterns may correspond to various regions of the top surface of the first layer, various regions of the user's foot that engage the top insole, or may include the columns being shaped or arrayed to form a brand logo, graphic or image. The outsole may be attached to a midsole, which may be attached to an upper. The footwear may lack a midsole, and the second layer may be attached to the upper. The columns may not be integral to the second layer, but may be joined by a web and the column and web assembly is mounted between the first layer and the second layer.

In an aspect, a footwear outsole may include a first layer with a multiple of first openings, a second layer with a multiple of second openings, a first component comprising a multiple of first columns, and a second component comprising a multiple of second columns, wherein the first columns extend at least partially through at least one of the multiple of first openings and the second columns extend at least partially through at least one of the multiple of second openings. The bottom surface of the first layer of the footwear outsole may form the bottom surface of the footwear.

In an aspect, a footwear outsole may include a first layer with a multiple of first openings, a second layer with a multiple of second openings, and a component comprising a multiple of first columns and a multiple of second columns, wherein the first columns extend at least partially through at least one of the multiple of first openings and the second columns extend at least partially through at least one of the multiple of second openings. The bottom surface of the first layer of the footwear outsole may form the bottom surface of the footwear.

In an aspect, a sock may include a woven body of fibers, and at least one layered engagement structure on one or more of the inside and the outside of the woven body, wherein the layered engagement structure comprises: a first layer formed of a compressible first material with a top surface, a bottom surface, and one or more groups of one or more openings through at least one of the top surface and the bottom surface, and a second layer with a top surface and one or more groups of one or more columns formed from a second material protruding from the top surface in a position that corresponds to the openings in the first layer, wherein the one or more columns extend at least partially through the at least one or more openings. The columns may not be integral to the second layer, but are joined by a web, and the column and web assembly is mounted between the first layer and the second layer.

In an aspect, a sock may include a woven body of fibers, and at least one layered engagement structure on the inside of the woven body, wherein the layered engagement structure includes a first layer formed of a compressible first material with a top surface, a bottom surface, and one or more groups of one or more openings through at least one of the top surface and the bottom surface, and one or more columns formed from a second material protruding from the inside surface of the woven body in a position that corresponds to the openings in the first layer, wherein the one or more columns extend at least partially through the at least one or more openings.

In an aspect, a sock may include a woven body of fibers, and at least one engagement structure on at least one of the inside and the outside of the woven body, wherein the engagement structure includes one or more columns formed from a first material protruding from at least one of the inside and the outside surface of the woven body, and one or more flexible fibers formed from a second material disposed adjacent to the one or more columns.

In an aspect, a footwear item may include an insole including a first layer with a multiple of openings, the first layer forms a top surface of the footwear insole, and a second layer with a multiple of columns, each of the multiple of columns correspond with one of the multiple of openings in the first layer to extend at least partially therein. In an aspect, a footwear item may include an outsole including a first layer with a multiple of openings, the first layer forms a bottom of the footwear outsole, and a second layer with a multiple of columns, each of the multiple of columns correspond with one of the multiple of openings in the first layer to extend at least partially therein. In an aspect, a footwear item may include an insole including a first layer with a multiple of openings, the first layer forms a top surface of the footwear insole, and a second layer with a multiple of columns, each of the multiple of columns correspond with one of the multiple of openings in the first layer to extend at least partially therein; and an outsole including a first layer with a multiple of openings, the first layer forms a bottom of the footwear outsole, and a second layer with a multiple of columns, each of the multiple of columns correspond with one of the multiple of openings in the first layer to extend at least partially therein.

The foregoing features and elements may be combined in various combinations without exclusivity, unless expressly indicated otherwise. These features and elements as well as the operation thereof will become more apparent in light of the following description and the accompanying drawings. It should be appreciated, however, the following description and drawings are intended to be exemplary in nature and non-limiting.

BRIEF DESCRIPTION OF THE FIGURES

Various features will become apparent to those skilled in the art from the following detailed description of the disclosed non-limiting embodiments. The drawings that accompany the detailed description can be briefly described as follows:

FIGS. 3A, 3B, and 3C depict a structural construction of a mat in an uncompressed configuration, in accordance with various embodiments of the present disclosure;

DETAILED DESCRIPTION

Figure 1:
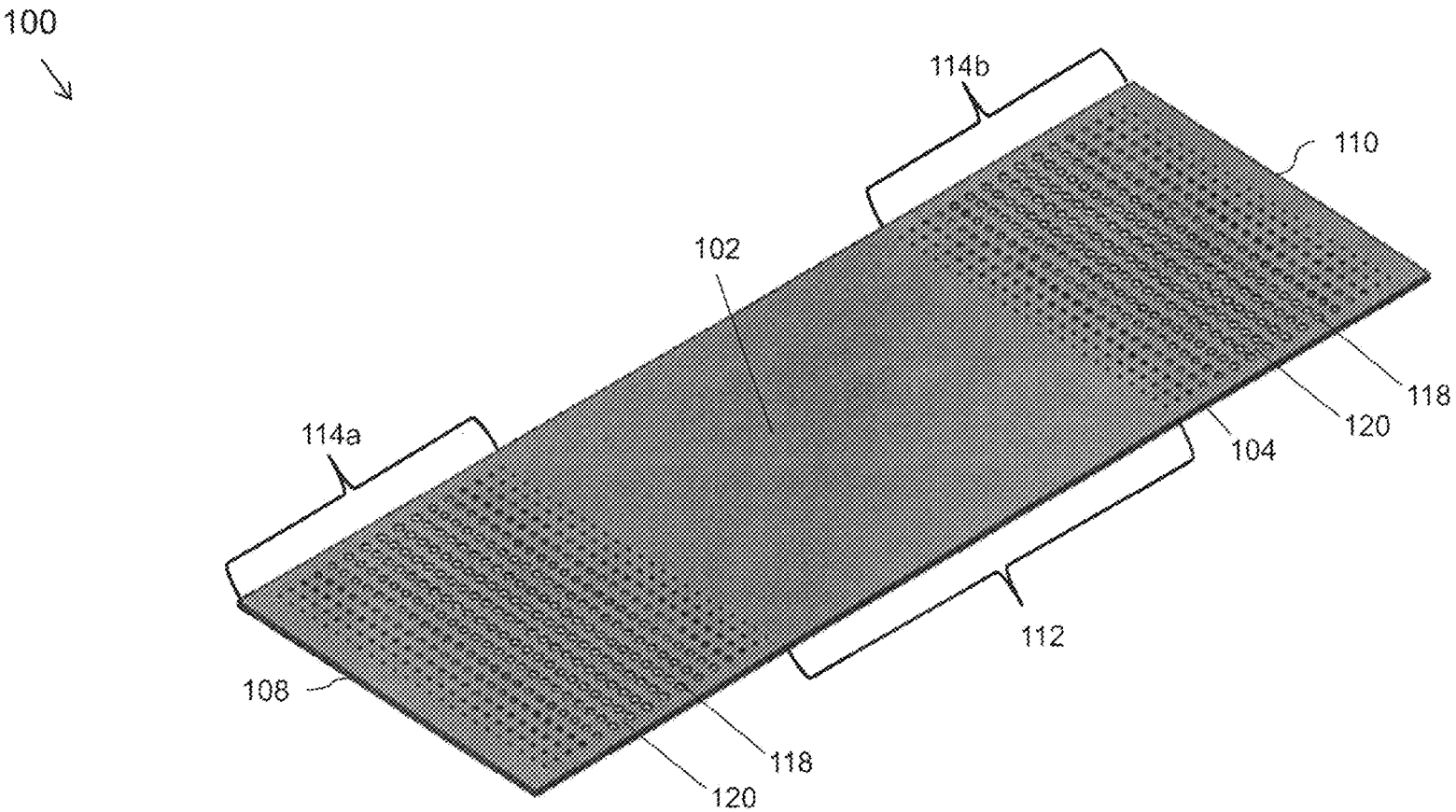
FIG. 1 depicts a perspective view of a mat, in accordance with an embodiment of the present disclosure.

FIG. 1 depicts a perspective view of a mat 100, in accordance with an embodiment of the present disclosure. The mat 100 may be a yoga mat or any other general purpose mat such as a floor mat. As shown in FIG. 1, the mat 100 includes a top surface 102. The mat 100 further includes a first layer 104, which may be manufactured of a material such as compressible foam or any other material that is compressible, durable and light. The material may include polystyrene, polymethacrylimide, polyvinylchloride, polyurethane, polypropylene, polyethylene, NES, and the like. The foam-based first layer 104 may be capable of achieving the desired lightness and portability. A desired compressibility and cushioning effect may be achieved with the help of the foam-based first layer 104 within a limited weight, thereby adding portability to the mat 100. The foam material of the first layer 104 may be mixed with rubber or any other similar material to offer enhanced gripping properties. The first layer 104 may also be configured to achieve zero or limited sweat absorption to maintain sanitary conditions all the time even during heated yoga environments. The thickness of the first layer 104 may vary based on the requirements. Further, the hardness of the material constituting the first layer 104 may also vary in durometer and foam density based on the requirements.

As shown in FIG. 1, the mat 100 only includes a single layer, i.e., the first layer 104. Therefore, in this case, the top surface 102 of the mat 100 will be the same as the top surface of the first layer 104. It will be apparent to a person skilled in the art that the mat 100 may include any number of layers based on the requirement and utility of the mat 100. In one embodiment, the mat 100 may include a second layer that may be disposed below the first layer 104. In this case, the second layer may act as the base or the bottom layer of the mat 100. In another embodiment, a thin and/or uncompressible layer such as a waterproof coating or a thin fabric may be formed over the first layer 104. In this case, the first layer 104 may act as a base layer or intermediate layer and the thin and/or uncompressible layer may act as the topmost layer of the mat 100.

In various embodiments, the traction may be provided on the top surface 102 of the first layer 104 at certain areas of the mat 100. The areas may include the locations on the mat 100 that may frequently come in contact with feet, hands or other body parts of a user while performing the yoga exercises. In an embodiment, the hands and feet of the user may come in contact with an area of the mat 100 proximate to opposite ends 108 and 110 of the top surface 102 of the mat 100 during gliding sequences and poses. The top surface 102 of the mat 100 includes a low-traction surface 112 defined in the area proximate to the middle of the top surface 102 of the mat 100. The top surface 102 further includes one or more traction surface regions 114*a* and 114*b* defined in the areas proximate to the opposite ends 108 and 110, respectively, of the mat. The traction surface regions 114*a* and 114*b* may be configured to provide traction to the user's body parts such as the feet and hands that come in contact with these surfaces. The traction surface regions 114*a* and 114*b* may allow the user to glide during various yoga steps, while providing sufficient traction to the user's hands and feet in standing poses and while balancing. The added traction through the traction surface regions 114*a* and 114*b* may provide a neutral tactile feel to the user during movements and postures, thereby avoiding users from any feeling of unsteadiness, distraction, and frustration. Additionally, the traction surface regions 114*a* and 114*b* may be designed in such a way that they may provide stability (or support) to the user during standing and stationary postures, especially in a typical single-footed standing posture typical of yoga. In another disclosed non-limiting embodiment, the traction surface regions 114*a* and 114*b* may be limited to an area proximate to one of the ends 108 or 110 of the mat 100 such that the weight of the mat 100 is kept to a minimum, thereby increasing its portability.

An area covered by the length and width of the traction surface regions 114*a* and 114*b* may be hereinafter referred to as a 'grip zone' for simplicity in the description. The length of the grip zone referring to a measure along the direction of the length of the mat 100 and the width of the grip zone referring to a measure along the direction of the width of the mat 100 may vary based on the requirement such as the height of the user, the type of yoga exercise, and the like.

In accordance with various embodiments, the traction surface regions 114*a* and 114*b* may be composed of a material or have a surface roughness that may offer frictional resistance to one or more body parts, which comes in contact with the top surface 102 of the mat 100, in a direction tangential to the top surface 102 of the mat 100 or the first layer 104. In an embodiment, rubber or any other elastomeric or grip-enabling material may be utilized in the traction surface regions 114*a* and 114*b* to introduce desired traction in the grip zone of the mat 100.

The top surface 102 of the first layer 104 in the grip zone may include one or more first portions 118 (i.e., portions in the grip zone that are circular in shape in FIG. 1). The top surface 102 of the first layer 104 in the grip zone other than the one or more first portions 118 forms one or more second portions 120. As shown in FIG. 1, the one or more second portions 120 are the portions on the top surface 102 of the first layer 104 in the grip zone that are disposed between the one or more first portions 118.

In certain embodiments, the first layer 104 and a layer including the low-traction surface 112 may be separate layers. In certain other embodiments, the first layer 104 and the traction surface regions 114*a* and 114*b* may be separate layers. In yet other embodiments, there may be an intermediate layer of material disposed between the first layer 104 and a bottom/base layer of the mat 100 to maintain stiffness and avoid stretching of the first layer 104 upon movement of the user over the mat 100.

In various embodiments, openings may be formed through the one or more first portions 118. In one embodiment, one or more columns formed of a thermoplastic elastomer (i.e., second material) such as a rubber or any other synthetic material may be disposed in the openings. For example, the columns may be disposed in the openings such that the top surfaces of the columns may be disposed substantially parallel to the top surface 102 of the first layer 104. In another example, the columns may be disposed in the openings such that the top surfaces of the columns may be disposed below the top surface 102 of first layer 104.

Alternatively, in another disclosed non-limiting embodiment, the columns may be disposed proximate to the openings. For example, some portion of a column may be disposed in the opening, while the remaining portion of the column may be disposed below the opening. In another example, some portion of the column may be disposed in the opening, while the rest portion may protrude outward, i.e., above the top surface 102 of first layer 104.

Alternatively, in yet another disclosed non-limiting embodiment, the columns may be disposed below the openings. In various embodiments, the top surfaces of the columns may be formed of a traction material that may offer traction higher or lower than that offered by the traction material used to form the one or more second portions 120. The selection of higher or lower traction may be based on the fraction requirement.

In yet still another disclosed non-limiting embodiment, the openings may be single-sided holes such that the first layer 104 is uncut at one surface of the mat 100. For example, the one or more first portions 118 of the top surface 102 of the mat 100 may be cut to provide openings such that the bottom surface of the first layer 104 is left uncut. In another disclosed non-limiting embodiment, the openings may be pass-through holes such that the one or more first portions 118 are cut from the top surface 102 to the bottom surface of the first layer 104. The openings may be configured to receive the columns fixedly, in accordance with an embodiment. The top surfaces of the columns may be disposed substantially parallel to the top surface 102 of the first layer 104 or may protrude outward or inward. The shape of the columns may be cylindrical, square, rectangular, or the like, with defined lengths and widths of the columns such that a traction pattern is created. The traction pattern may provide fraction to the user's body parts contacting the grip zone of the mat 100. The traction pattern may be zigzag, puzzle, or the like. Alternatively, the traction pattern may be one or more continuous lines. In accordance with various embodiments, the configuration of the fraction pattern may vary based on the requirements. The traction pattern may be uniform or non-uniform.

The openings may be created through the first layer 104 by various manufacturing and cutting processes such as die cutting, laser or water-jet cutting, gang-punching, and the like. The columns in or proximate to the openings may be compressed when the user applies pressure during standing poses or any other activity that involves contact of the user's body parts with the traction surface regions 114*a* and 114*b*. The configuration in which the pressure applied on any portion of the traction surface regions 114*a* and 114*b* (e.g., anywhere on the one or more second portions 120, the top surface of at least one column, or both) facilitates the one or more second portions 120, the top surface of at least one column, or both to be compressed is hereinafter referred to as a compressed configuration. In an embodiment, the columns and/or the second portions 120 may compress only when pressure applied on the traction surface regions 114*a* and 114*b* is the same as or above a threshold pressure, i.e., the pressure at which the columns and/or the second portions 120 begin to compress. In various embodiments, the material of the columns and/or the second portions 120 may be chosen to be of sufficient stiffness such that they will not compress until the threshold pressure is achieved. The stiffness (or compressibility) of the columns may also be affected by the structure of the underside of the columns, which could be hollow on their undersides with ribs in order to reduce weight, and/or by the stiffness (or compressibility) of the bottom layer of the mat 100. The amount of threshold pressure may vary based on the relative compressibility of the columns, the first layer 104, the bottom layer of the mat 100, relative heights of the columns, and the like.

The compressed configuration may provide either support (or stability) to the body parts that contact in a direction perpendicular to the top surface 102 of the first layer 104, or traction to the body parts that contact in a direction tangential to the top surface 102, or both. In other words, the support refers to the resistance to movement of the body parts in the direction perpendicular to the top surface 102 of the first layer 104, whereas the traction refers to the resistance to movement in a direction tangential to the first layer's top surface. In an embodiment where the one or more second portions 120 depresses more than the top surfaces of at least one column in the compressed configuration, these columns may engage with the hands/feet of the user to offer both support and traction. In various embodiments, the material used to form the columns may be harder and hence, less compressible, than the material used to form the first layer 104. The columns, being more rigid than the first layer 104, provide more stability/support than the cushioning first layer 104 when the columns engage with the hands/feet, thus improving the user's balance. This may allow the columns to provide the required support in the direction perpendicular to the top surface 102 of the first layer 104 since the columns will not depress significantly in the compressed configuration. The traction and support, thus developed under pressure, may still maintain a comfortable level for hands and feet while gliding over the grip zone of the mat 100. In other words, the mat 100 is able to offer the required traction and support to the user without compromising smooth movements between the yoga poses. Alternatively, in another disclosed non-limiting embodiment where the one or more second portions 120 depresses less than the top surfaces of at least one column in the compressed configuration, the one or more second portions 120 may engage with the hands/feet of the user to offer only traction to the hands/feet.

The traction may be provided based on any or all of the known factors, such as, but not limited to, the coefficient of friction (such as static friction and dynamic/sliding friction), surface texture/roughness, the edge contact and contact with the sides of the columns (in the compressed configuration). In other words, the traction may be affected by a combination of material properties and geometry.

Further, the configuration in which the columns and/or the second portions 120 are in uncompressed state (i.e., the pressure applied on the traction surface regions 114*a* and 114*b* is below the threshold pressure) is interchangeably referred to as an uncompressed configuration. In the uncompressed configuration, the top surfaces of some or all columns are configured to be disposed either below or coplanar to the top surface 102 of the first layer 104.

In accordance with an embodiment of the present disclosure, grip zones may be provided proximate to the opposite ends 108 and 110 of the top surface 102 of the mat 100 as depicted in FIG. 1. In another disclosed non-limiting embodiment, grip zones may be provided on the entire top surface 102 of the mat 100 to provide additional traction.

The mat 100 may further include various patterns or textures based on varying requirements at different locations of the mat 100. In some embodiments, the top surface 102 of the mat 100 may be covered with a waterproofing layer that may block the sweat or perspiration from absorbing into the mat 100. In an embodiment, the waterproofing layer may be coated with an elastomer such as a rubber to provide traction. The waterproofing layer may include a texture for additional traction.

In accordance with an embodiment, a bottom surface of the mat 100 may be provided with a traction element or coating that may deliver traction to the entire bottom surface of the mat 100 for creating a binding impact between the mat 100 and the floor. In another disclosed non-limiting embodiment, the bottom surface of the mat 100 may be provided with a texture to create such a binding impact between the mat 100 and the floor. This may protect the mat 100 from dislocating and may also keep it clean. Further, a layer or coating may be provided on the bottom surface to protect and maintain the cleanliness of the mat 100. In accordance with various embodiments of the present disclosure, antimicrobial treatment may be performed on the mat 100 to ensure the desired hygienic conditions. Antimicrobial agents that may kill or limit the growth of the microorganisms may be utilized in the antimicrobial treatment. In addition, an antimicrobial coating may be applied on the surface of the mat 100 that may kill or inhibit the growth of microorganisms.

The mat 100 may be customized based on the user's requirements and preferences. The hardness of foam or rubber may vary in durometer and/or density based on the user's preference. Similarly, the shape and size of the columns, openings, and the like may also vary. In accordance with an embodiment, the mat 100 may include two or more layers of foam to form the first layer 104. The top layer may be utilized to generate the traction pattern of the traction surface regions 114*a* and 114*b*, while the lower layers may act as a base. In another disclosed non-limiting embodiment, a single layer may be utilized that may be die cut or embossed with columns of rubber and the like on the top surface of the layer or in openings formed through this top surface. The color of foam and rubber used to form the columns may be customized based on user preferences. The size of the traction surface regions 114*a* and 114*b*, pattern of rubber shapes, and their placement (e.g., depth) in or proximate to the openings may vary based on the requirements.

Figure 2:
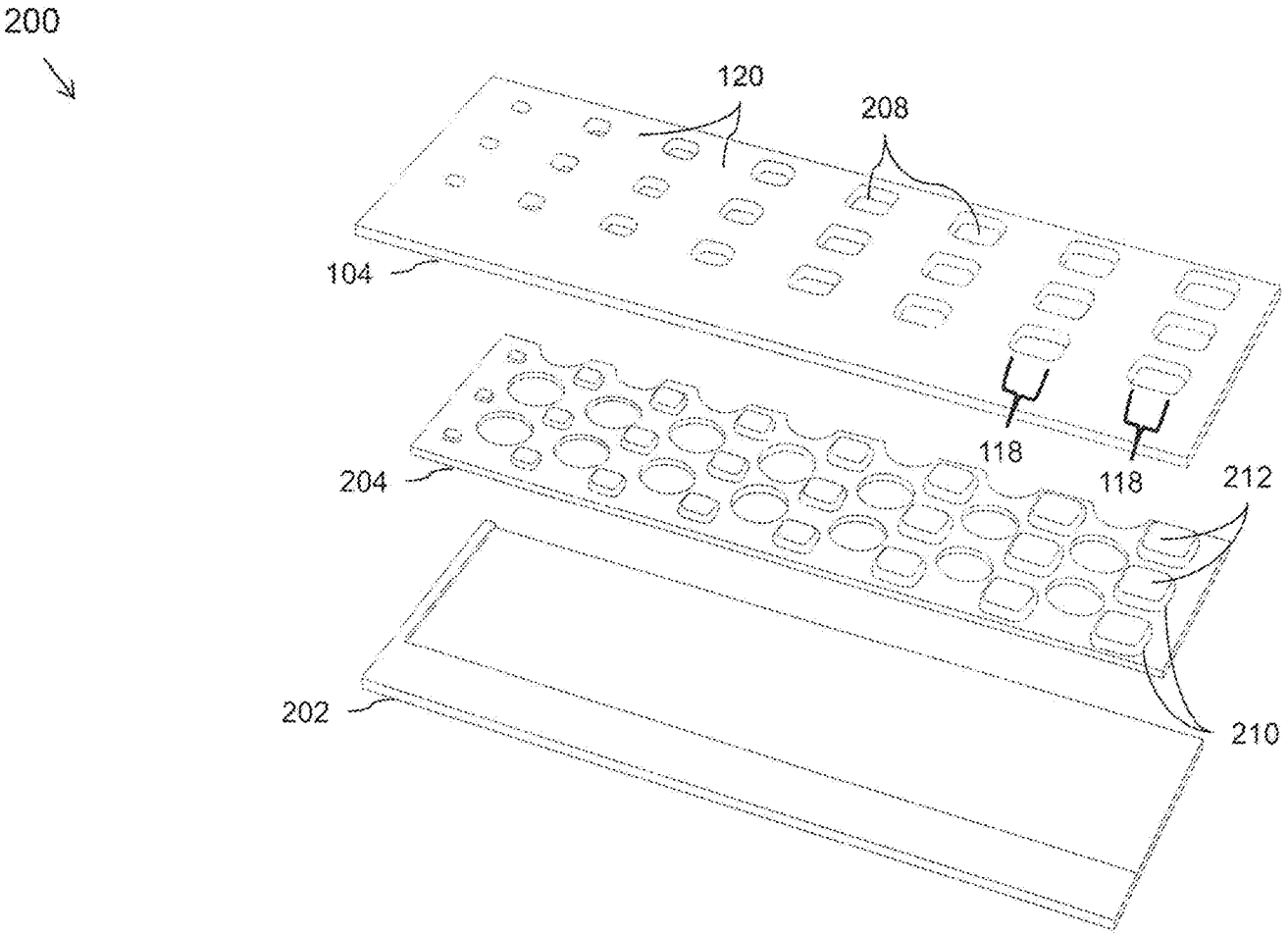
FIG. 2 depicts a perspective view of a layered engagement structure of a grip zone of the mat of FIG. 1, in accordance with an embodiment of the present disclosure.

In accordance with various embodiments, the mat 100 may be manufactured in a layered manner with a plurality of layers disposed on top of one another in a stacked form. FIG. 2 depicts a perspective view of a layered engagement structure 200 of the grip zone of the mat 100, in accordance with an embodiment of the present disclosure. As shown in FIG. 2, the first layer 104's grip zone and a second layer such as a bottom layer 202 are separated by an elastomeric grip component 204. In this embodiment, the first layer 104 acts as the topmost layer of the mat 100, while the bottom layer 202 acts as the base layer of the mat 100. In various embodiments, the first layer 104 has an array of openings 208 (hereinafter referred to as 'openings 208') formed through the one or more first portions 118 of the top surface 102 of the first layer 104. The elastomeric grip component 204 may include grip elements such as columns 210. The elastomeric grip component 204 is a thin layer of elastomer, which connects all the columns 210. Further, as shown in FIG. 2, the elastomeric grip component 204 is a rectangular-shaped component configured with the shape and size that match with that of the grip zone of the first layer 104. The similarity in the shapes and sizes facilitates in coupling the elastomeric grip component 204 through the bottom surface of the grip zone of the first layer 104 such that the columns 210 fix into (and outward on the top surface 102 of the first layer 104 when compressed) the openings 208 of the first layer 104. The columns 210 may be molded into any shape and size that may fit in or proximate to the openings 208.

The columns 210 may be formed of a high-traction material such that the top surfaces 212 of some or all of the columns 210 include a higher traction than the one or more second portions 120 of the top surface 102 of the first layer 104. In an uncompressed configuration, the top surfaces 212 of some or all of the columns 210 are configured to be disposed either below or coplanar to the top surface 102 of the first layer 104. The columns 210 may protrude through the openings 208 in the first layer 104 when sufficient pressure (i.e., on or above threshold pressure) is applied on the grip zone of the mat 100. In one embodiment, the one or more second portions 120 of the top surface 102 of the first layer 104, which is formed of the compressible material, may compress in response to the sufficient pressure applied by the hands and feet of the user, thereby exposing some or all the columns 210 above the top surface 102. This compressed configuration of the mat 100 facilitates the top surface 102 of the mat 100 to provide increased grip and traction to the user's hands and feet contacting the grip zone. Additionally, the columns 210, being more rigid than the first layer 104, provide more stability than the cushioning first layer 104 would by itself, thereby improving the user's balance on the mat 100. The traction and support, developed under pressure, may still maintain a comfortable level for hands and feet while gliding over the grip zone of the mat 100. Further, in an embodiment when the pressure is removed from the grip zone or the pressure applied is below the threshold pressure, the one or more second portions 120 may return to its original position and conceal the high-traction columns 210.

Alternatively, in another disclosed non-limiting embodiment where the one or more second portions 120 depresses less than the top surfaces 212 of some or all of the columns 210 in the compressed configuration, the one or more second portions 120 may engage with the hands/feet of the user to offer only traction to the hands/feet. This will be described later in conjunction with FIGS. 6A and 6B.

In accordance with an embodiment of the present disclosure, the columns 210 and the top surface 102 of the first layer 104 may be fabricated from the same material such that the materials of the columns 210 and the first layer 104 only differ in hardness (durometer) or density. The variance in hardness or weight of the columns 210 and the first layer 104 may provide the required traction even with the use of similar materials. In an exemplary scenario, both the first layer 104 and the columns 210 may be fabricated from rubber. However, the hardness of the first layer 104 and the columns 210 may be varied to induce a traction pattern in the grip zone.

The multi-layer mat 100 may utilize various types of materials based on the requirements. In an exemplary scenario, the first layer 104 of the mat 100 may be fabricated from foam and the bottom layer 202 may be fabricated from rubber. Similarly, various other materials may be used to manufacture various layers of the mat 100. In an embodiment of the present disclosure, the bottom layer 202 may be less compressible than the first layer 104. In this case, the material used to form the bottom layer 202 may be harder and hence, less compressible, than the material used to form the first layer 104. This may allow the columns 210 to provide the required support since the columns 210 will not depress significantly in the compressed configuration.

It will be apparent to a person skilled in the art that the number of openings and columns represented in FIG. 2 is exemplary and any number of openings and columns may be applicable in accordance with various embodiments of the present disclosure. Also, the shapes and sizes of openings and columns are exemplary and any other shape and size can be deployed in a similar manner in accordance with the mat of the present disclosure.

In the embodiment described in conjunction with FIG. 2, the openings 208 are formed by cutting the top surface 102 of the first layer 104 such that the one or more first portions 118 are hollow and hence, some or all the columns 210 in the elastomeric grip component 204 may be fixed into the openings 208 through the bottom surface of the first layer 104. Alternatively, the columns may be provided individually in each opening formed through the top surface of the mat. FIGS. 3A, 3B, and 3C depict a structural construction of a mat 300 in an uncompressed configuration, in accordance with various embodiments of the present disclosure. In this embodiment, only a portion of a grip zone (similar to the grip zone of FIG. 1) of the mat 300 is disclosed. As shown in FIGS. 3A-3C, the mat 300 includes a first layer 302 and a bottom layer 304 disposed below the first layer 302 having a top surface 308. The top surface 308 of the first layer 302 in the grip zone may include a first portion 310. The top surface 308 of the first layer 302 in the grip zone other than the first portion 310 forms one or more second portions 312. As shown in FIGS. 3A-3C, the one or more second portions 312 are the portions on the top surface 308 of the first layer 302 in the grip zone that are disposed on the two sides of the first portion 310.

As depicted in FIG. 3A, a column 314 formed of an elastomer may be introduced into an opening 318 formed through the first portion 310 such that a lower surface of the column 314 extends to a bottom surface 320 of the first layer 302. As shown in FIG. 3A, a top surface 322 of the column 314 is curve shaped and a major portion of this top surface 322 is coplanar with the top surface 308 of the first layer 302. The minor portion of the top surface 322 of the column 314 is disposed below the top surface 308 of the first layer 302. Further, the column 314 has flanges 324 disposed under the first layer 302. The flanges 324 are thin sections of material that are disposed on either side of the column 314 to hold the column 314 in place or facilitate coupling of the column 314 to the sidewalls of the first layer 302. It will be apparent to a person skilled in the art that a plurality of columns (similar to the column 314) may be disposed individually in respective openings (similar to the opening 318) formed through respective first portions (similar to the first portion 310) of top surfaces of the first layer 302.

As depicted in FIG. 3B, a column 328 formed of an elastomer may be introduced into an opening 330 formed through the first portion 310 such that a lower surface of the column 328 extends through an opening in the bottom layer 304, thereby making the column 328 longer. As shown in FIG. 3B, a top surface 332 of the column 328 is curve shaped and a major portion of this top surface 332 is coplanar with the top surface 308 of the first layer 302. The minor portion of the top surface 332 of the column 328 is disposed below the top surface 308 of the first layer 302. Further, the column 328 has flanges 334 (similar to the flanges 324 of FIG. 3A) disposed under the first layer 302. FIGS. 3A-3C describe the placement of a single column in the opening. It will be apparent to a person skilled in the art that a plurality of columns (similar to the column 328) may be similarly disposed individually in openings (similar to the opening 330 and the opening in the bottom layer 304) formed through the respective first portions (similar to the first portion 310) of the top surfaces of the first layer 302.

As depicted in FIG. 3C, a column 338 may be introduced into an opening 340 formed through the first portion 310 such that a lower surface of the column 338 may substantially interface with the first layer 302 at certain depth, which is uncut at the bottom end. As shown in FIG. 3C, a top surface 342 of the column 338 is curve shaped and a major portion of this top surface 342 is coplanar with the top surface 308 of the first layer 302. The minor portion of the top surface 342 of the column 338 is disposed below the top surface 308 of the first layer 302. It will be apparent to a person skilled in the art that a plurality of columns (similar to the column 338) may be disposed individually in openings (similar to the opening 340) formed through the respective first portions (similar to the first portion 310) of the top surfaces of the first layer 302.

However, still various other embodiments, as described above, may also be possible without limitations. In an embodiment, the individual columns may be formed by pouring liquid elastomer into the openings of the first layer (such as 104 or 302) and curing the elastomer. This embodiment will be described in detail later in conjunction with FIGS. 5A and 5B.

In yet another disclosed non-limiting embodiment, rubber in the form of a plurality of rubber dots may be embossed on the first layer 302 to form a traction surface (such as the one or more traction surface regions 114*a* and 114*b*) on the top surface 308 of the first layer 302. The embossed rubber dots may provide a raised design or relief on the first layer 302 of the mat 300. Embossing of the rubber dots may be done with the help of embossing dies or rollers or any other technique. In embodiments, embossing or providing traction pattern may channel moisture or sweat away from hands and feet of the user. Various patterns of the embossing dies and rollers may be utilized to accomplish a required design of the rubber dots on the mat 300. In another disclosed non-limiting embodiment, rubber textured coating may be applied on the first layer 302 to form the traction surface. Similarly, in accordance with various other embodiments of the present disclosure, several other kinds of manufacturing techniques and processes may be utilized without limitations to form the traction pattern on the first layer 302. This embodiment of using the rubber embossing may be similarly applied to columns formed in or proximate to the openings (such as 318, 330, or 340) formed through the one or more first portions (such as 310) of the top surface 308 of the first layer 302.

In embodiments, the traction pattern may vary based on the requirements. In an embodiment, the traction pattern may be continuous. In another disclosed non-limiting embodiment, the traction pattern may be discontinuous. For example, rubber shapes such as rubber dots or rubber columns may be disposed or embossed in the openings formed through the first portions of the top surface 308 of the first layer 302 in a continuous or discontinuous manner. Further, the size and/or shape of rubber such as dots or columns may vary. Still, in another disclosed non-limiting embodiment, the size and/or shape of the rubber may be kept uniform.

Various embodiments described below in conjunction with FIGS. 4A and 4B to FIGS. 8A, 8B and 8C only disclose various detailed views of a grip zone of a mat (such as the grip zone of the mat 100).

Figures 4A, 4B:
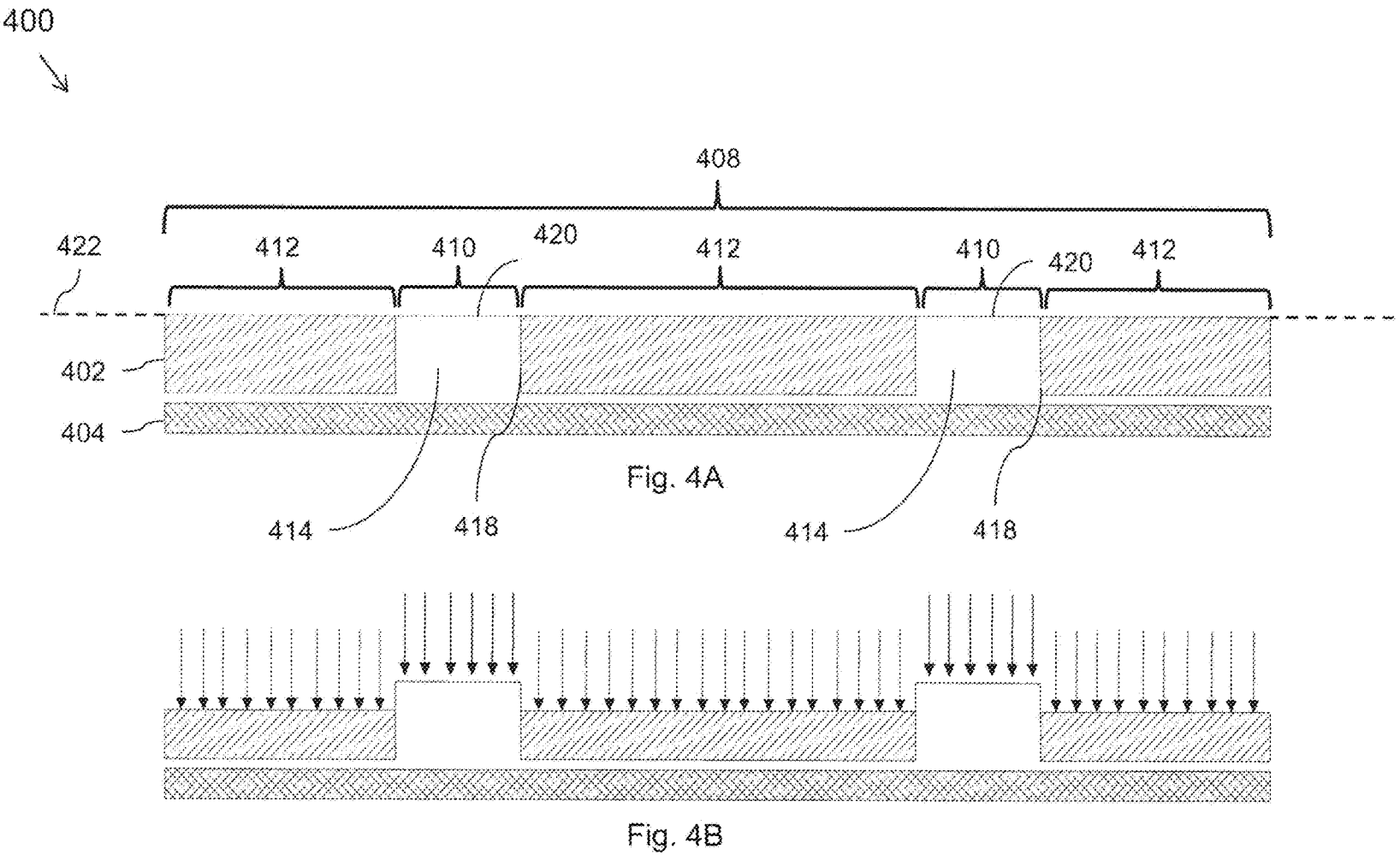
FIGS. 4A and 4B depict compressed and uncompressed configurations of a mat, in accordance with a first embodiment of the present disclosure.

FIGS. 4A and 4B depict compressed and uncompressed configurations of a mat 400, in accordance with a first embodiment of the present disclosure. As shown in FIGS. 4A and 4B, the mat 400 includes a first layer 402 having a top surface 408 and a bottom layer 404 disposed below the first layer 402. The top surface 408 of the first layer 402 in the grip zone may include one or more first portions 410. The top surface 408 of the first layer 402 in the grip zone other than the first portions 410 forms one or more second portions 412. As shown in FIGS. 4A and 4B, the second portions 420 are the portions on the top surface 408 of the first layer 402 in the grip zone that are disposed between the first portions 410.

As depicted in FIGS. 4A and 4B, a plurality of columns 414 formed of an elastomer may be introduced into openings 418 formed through the first portions 410. The columns 414 may include the top surfaces 420 that are coplanar to the top surface 408 of the first layer 402. Further, as shown in FIGS. 4A and 4B, a surface 422 defined by connecting the top surfaces 420 of the columns 414 is planar.

FIG. 4A depicts the uncompressed configuration in which either no pressure is applied on the grip zone or the pressure applied on the grip zone is below a threshold pressure. In an embodiment, the top surfaces 420 of the columns 414 and/or the second portions 412 may compress only when the pressure applied on the grip zone is the same as or above the threshold pressure, i.e., the pressure at which the columns and/or the second portions 412 begin to compress.

In an embodiment of the compressed configuration shown in FIG. 4B, the feet and/or hands of a user may apply the threshold pressure that triggers the compression of only the second portions 412, whereas the top surfaces 420 of the columns 414 remain in the uncompressed configuration. In various embodiments, the material of the second portions 412 may be chosen to be of sufficient stiffness such that they will not compress until the threshold pressure is achieved. The arrows shown in FIG. 4B represent the pressure applied on the grip zone. In the embodiment disclosed in FIG. 4B, the compression of the second portions 412 may facilitate the engagement of the columns 414 with the hands/feet of the user to offer both support and traction to the hands/feet. The support to the hands/feet may be provided in a direction perpendicular to the top surface 408 of the first layer 402. Also, the traction to the hands/feet may be provided in a direction tangential to the top surface 408. The traction and support, thus developed under pressure, may still maintain a comfortable level for hands and feet while gliding over the grip zone of the mat 400. In other words, the mat 400 is able to offer the required fraction and support (i.e., in the compressed configuration) to the user without compromising smooth movements between the yoga poses (i.e., in the uncompressed configuration).

Further, when the pressure is removed from the grip zone or the pressure applied is below the threshold pressure, the second portions 412 may return to their original positions and conceal the columns 414 as illustrated in FIG. 4A.

Figure 5A:
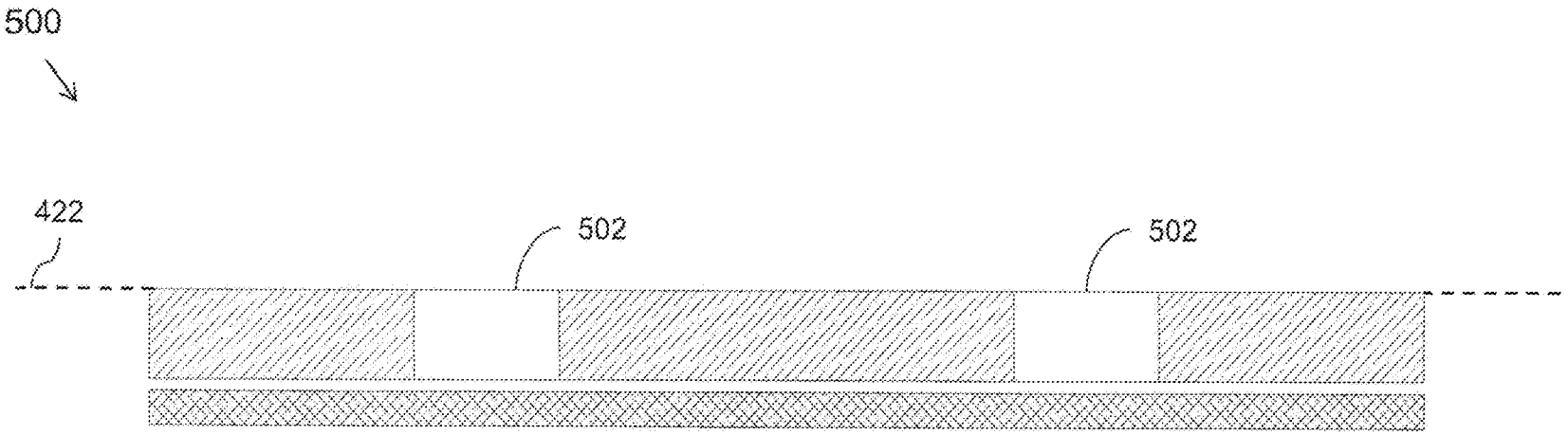
FIGS. 5A and 5B depict compressed and uncompressed configurations of a mat, in accordance with a second embodiment of the present disclosure.
Figure 5B:
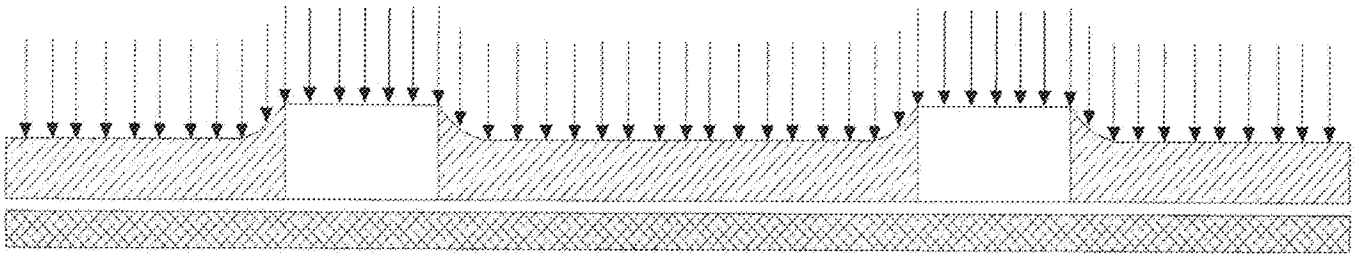

FIGS. 5A and 5B depict compressed and uncompressed configurations of a mat 500, in accordance with a second embodiment of the present disclosure. Various elements or configurations in this embodiment are the same as that disclosed in conjunction with FIGS. 4A and 4B, except that columns 502 are constructed differently. The individual columns 502 are formed by pouring the liquid elastomer into the openings 418 and curing the elastomer. As a result, the sides of the columns 502 are bonded to the sides of the openings 418. Further, as illustrated in FIG. 5B, the sides of the openings 418 are only partially compressed and thus, only a small portion of the columns 502 is exposed to the top surface 408 of the first layer 402 when subjected to pressure equal to or greater than the threshold pressure. However, portions of the individual second portions 412 of the top surface 408 of the first layer 402 surrounding the columns 502 compress such that the columns 502 protrude further than the surrounding portions of the individual second portions 412, thereby providing increased grip and fraction. Further, when the pressure is removed from the grip zone or the pressure applied is below the threshold pressure, the second portions 412 may return to their original positions and conceal the columns 502 as illustrated in FIG. 5A. As shown in FIGS. 5A and 5B, the surface 422 defined by connecting the top surfaces 420 of the columns 414 is planar.

Figure 6A:
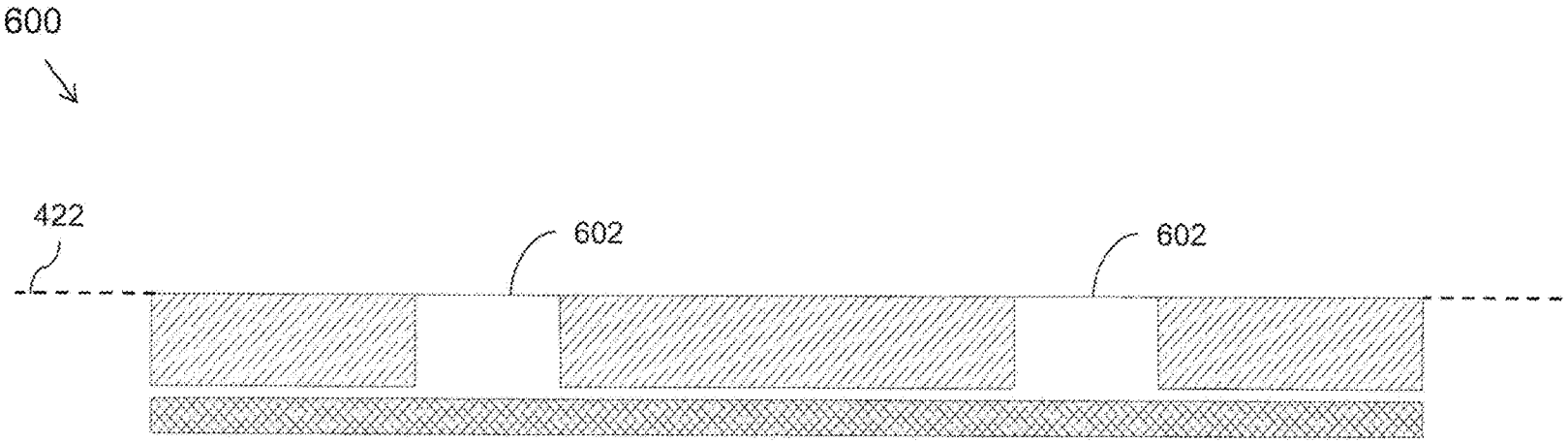
FIGS. 6A and 6B depict compressed and uncompressed configurations of a mat, in accordance with a third embodiment of the present disclosure.
Figure 6B:
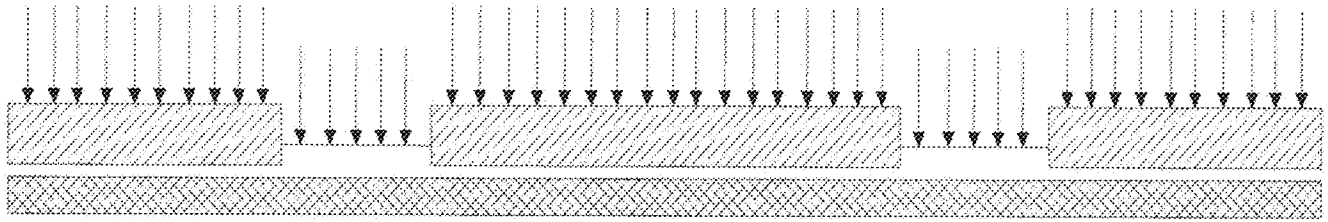

FIGS. 6A and 6B depict compressed and uncompressed configurations of a mat 600, in accordance with a third embodiment of the present disclosure. Various elements or configurations in this embodiment are the same as that disclosed in conjunction with FIGS. 4A and 4B, except that columns 602 are formed of a material that is more compressible than the material used to form the second portions 412 of the top surface 408 of the first layer 402. As a result, as illustrated in FIG. 6B, top surfaces of the columns 502 depress or compress more than the second portions 412 in response to the pressure applied on the grip zone. In one embodiment, the threshold pressure at which the columns 502 may begin to compress may be different from the threshold pressure at which the second portions 412 may begin to compress. Alternatively, in another disclosed non-limiting embodiment, the threshold pressures for both the columns 502 and the second portions 412 may be the same; however, the columns 502 may compress more than the second portions 412 at the same threshold pressure due to the difference in their materials. As shown in FIG. 6B, the top surfaces of the columns 602 are below the second portions 412, thereby exposing the edges of the openings 418. Therefore, when the user's hands or feet contact these edges, improved traction is provided in a direction tangential to the top surface 408 of the first layer 402.

Further, when the downward pressure is removed or it is below the threshold pressure, the top surfaces of the columns 602 may return to their original positions, concealing the edges of the openings 418 as illustrated in FIG. 6A. This enables the user to perform smooth and unobstructed movement between the yoga poses over the mat 600. In the embodiment described in conjunction with FIGS. 6A and 6B, the top surfaces of some or all of the columns 602 may include a lower traction than that of the second portions 412. As shown in FIGS. 6A and 6B, the surface 422 defined by connecting the top surfaces 420 of the columns 414 is planar.

Figure 7A:
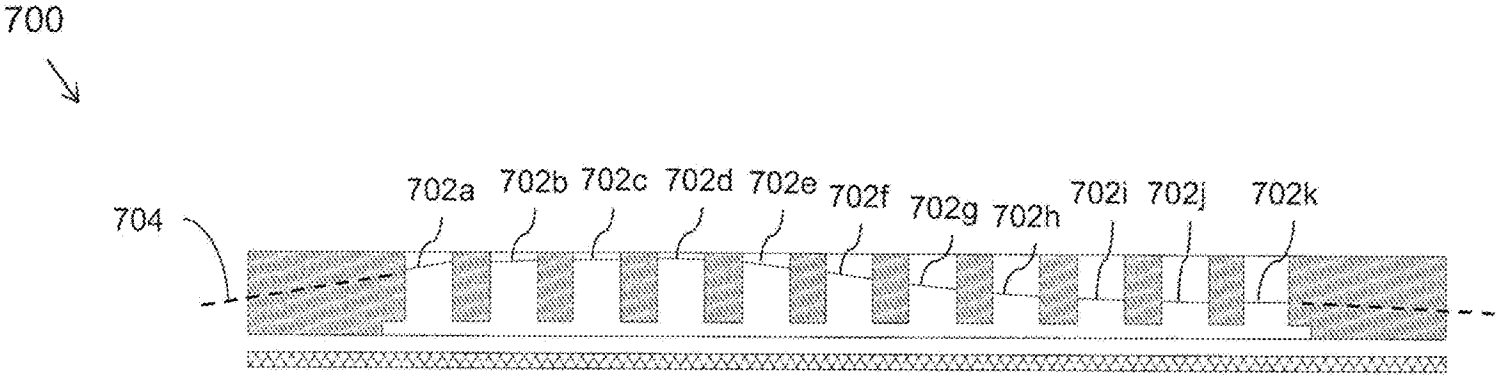
FIGS. 7A and 7B depict compressed and uncompressed configurations of a mat, in accordance with a fourth embodiment of the present disclosure.
Figure 7B:
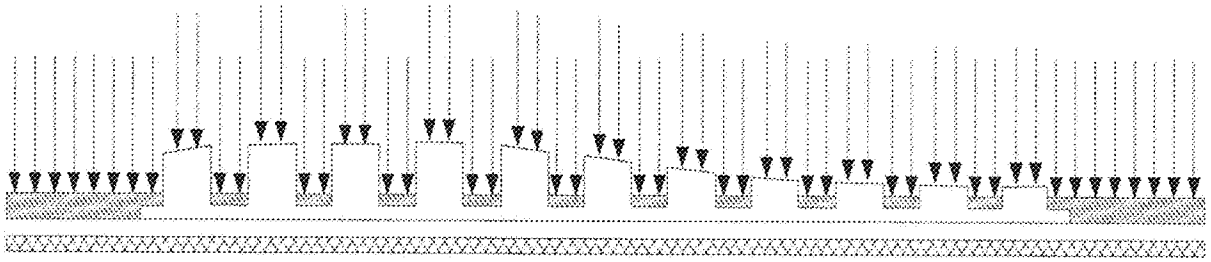

FIGS. 7A and 7B depict the compressed and uncompressed configurations of a mat 700, in accordance with a fourth embodiment of the present disclosure. Various elements or configurations in this embodiment are the same as that disclosed in conjunction with FIGS. 4A and 4B, except that the top surfaces of columns 702*a-k* include different shapes. As shown in FIGS. 7A and 7B, a surface 704 defined by connecting the top surfaces of the columns 702*a-k* is represented by a contoured line (non-planar). In this embodiment, top surfaces of the columns 702*a-k* depress or compress less than the second portions 412 in response to the pressure applied on the grip zone. In one embodiment, the threshold pressure at which the columns 702*a-k* may begin to compress may be different from the threshold pressure at which the second portions 412 may begin to compress. Alternatively, in another disclosed non-limiting embodiment, the threshold pressures for both the columns 702*a-k* and the second portions 412 may be the same; however, the columns 702*a-k* may compress less than the second portions 412 at the same threshold pressure due to the difference in their materials. As shown in FIG. 7B, which represents the compressed configuration, the top surfaces of the columns 702*a-k* are above the second portions 412. Even in the compressed configuration, the columns 702*a-k* define the contoured surface 704, in which the heights of the top surfaces of the columns 702*a-k* are different. In various embodiments, the contoured surface 704 may provide a more comfortable and stable surface for yoga positions.

Figures 8A, 8B, 8C:
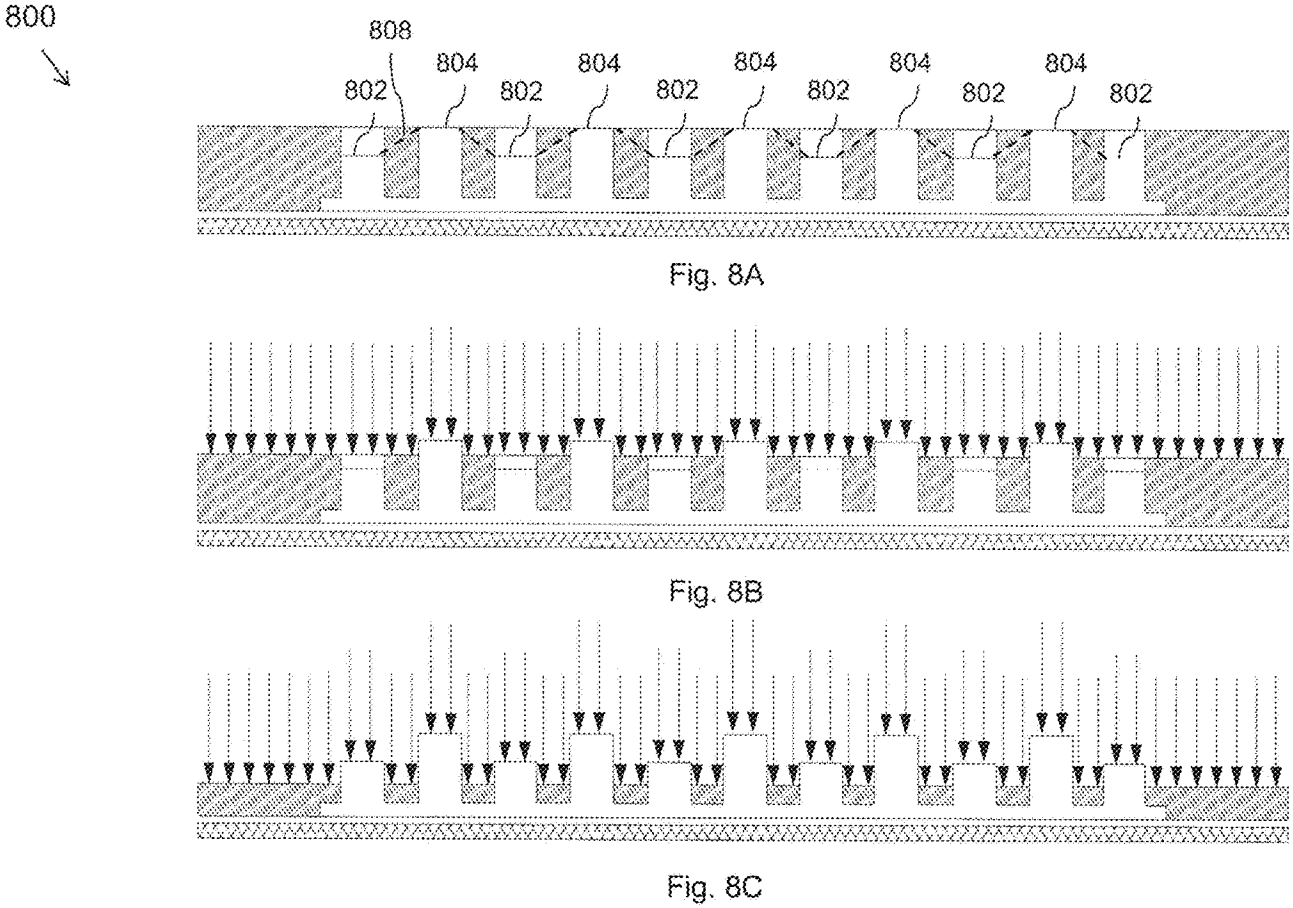
FIGS. 8A, 8B, and 8C depict the compressed and uncompressed configurations of a mat 800, in accordance with a fifth embodiment of the present disclosure.

FIGS. 8A, 8B, and 8C depict the compressed and uncompressed configurations of a mat 800, in accordance with a fifth embodiment of the present disclosure. Various elements or configurations in this embodiment are the same as that disclosed in conjunction with FIGS. 4A and 4B, except that a first set of columns 802 and a second set of columns 804 include different heights. As shown in FIG. 8A, which represents the uncompressed configuration of the mat 800, the first set of the columns 802 are at a height lower than the height of the second set of columns 804. As shown in FIGS. 8A-8C, a surface 808 defined by connecting the top surfaces of the columns 802 and 804 is represented by a staggered line (non-planar). In this embodiment, only the second portions 412 compress in response to the pressure applied on the grip zone. FIG. 8B represents the case in which a pressure P1 applied on the grip zone is the same as or above the threshold pressure at which the second portions 412 begin to compress. The pressure P1 results in the second set of columns 804 to be triggered and hence, only the second set of columns 804 protrude above the top surface 408 of the first layer 302. Further, FIG. 8C represents the case in which a pressure P2 is applied on the grip zone. In an embodiment, the pressure P2 may be greater than the pressure P1 and may trigger the first set of columns 802 (in addition to the second set of columns 804). As shown in FIG. 8C, both the first and second sets of columns 802 and 804 protrude above the top surface 408 of the first layer 302. Even in the compressed configuration, the columns 802 and 804 define the staggered surface 808 in which the heights of the columns 802 and 804 are different. Therefore, the staggered surface 808 facilitates in effectively varying the column density based on the applied pressure so that only some columns (i.e., the second set of columns 804) are activated under light pressure, and all the columns (i.e., the columns 802 and 804) are activated under greater pressure.

Figures 9A, 9B, 9C, 9D:
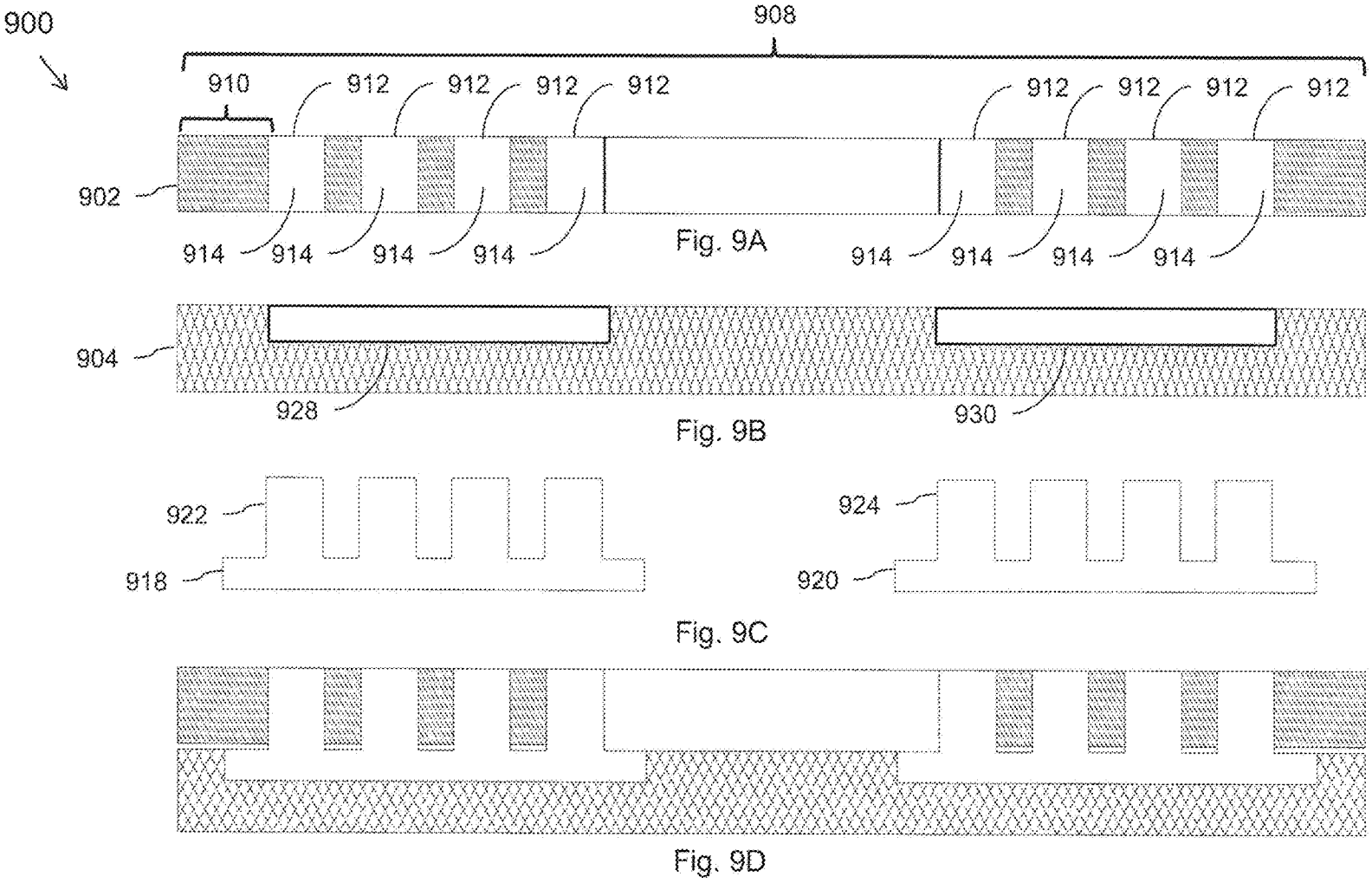
FIGS. 9A, 9B, 9C, and 9D depict components of a mat, in accordance with a first embodiment of the present disclosure.

FIGS. 9A, 9B, 9C, and 9D depict components of a mat 900, in accordance with a first embodiment of the present disclosure. The mat 900 includes a first layer 902 (FIG. 9A) and a bottom layer 904 (FIG. 9B). The first layer 902 includes a top surface 908. The first layer 902 may be manufactured of a material such as compressible foam or any other material that is durable and light. Further, the hardness of the material constituting the first layer 902 may also vary in durometer and foam density based on the requirements. Further, the bottom layer 904 may be manufactured of the same material (i.e., compressible foam or any other material that offers durability and lightness) as that is used to form the first layer 902. The thickness of the first layer 902 and the bottom layer 904 may vary based on the requirements. In an embodiment, the thickness of the first layer 902 and the bottom layer 904 may each be 2 to 4 millimeters (mm).

The top surface 908 of the first layer 902 may include one or more first portions 910 (shown by dashed lines in FIGS. 9A and 9D). The top surface 908 of the first layer 902 in the grip zones (other than the one or more first portions 910) forms one or more second portions 912. As shown in FIG. 9A, the second portions 912 are the portions on the top surface 908 of the first layer 902 in the grip zone that are disposed between the first portions 910. In various embodiments, openings 914 may be formed through the one or more first portions 910. As shown in FIG. 9C, the mat 900 further includes a first elastomeric grip component 918 and a second elastomeric grip component 920. The first elastomeric grip component 918 is a thin layer of elastomer, which connects grip elements such as columns 922. Similarly, the second elastomeric grip component 920 connects columns 924. It will be apparent to a person skilled in the art that although FIG. 9C illustrates only four columns in each elastomeric grip component, any number of columns may be connected in each such component. Also, it will be apparent to a person skilled in the art that any number of elastomeric grip components may be used in various embodiments of the present disclosure. Further, as shown in FIG. 9D, the first and second elastomeric grip components 918 and 920 (of a specific shape and size) are configured in such a manner that their major portions may fit into the openings 914 formed in the first layer 902 and the remaining portions may fix into first and second embossed regions 928 and 930 in the bottom layer 904. The columns 922 and 924 may be molded into any shape and size that may fit into the openings 914 and the first and second embossed regions 928 and 930.

It will be apparent to a person skilled in the art that the mat 900 may include any number of layers based on the requirement and utility of the mat 900.

Figures 10A, 10B, 10C:
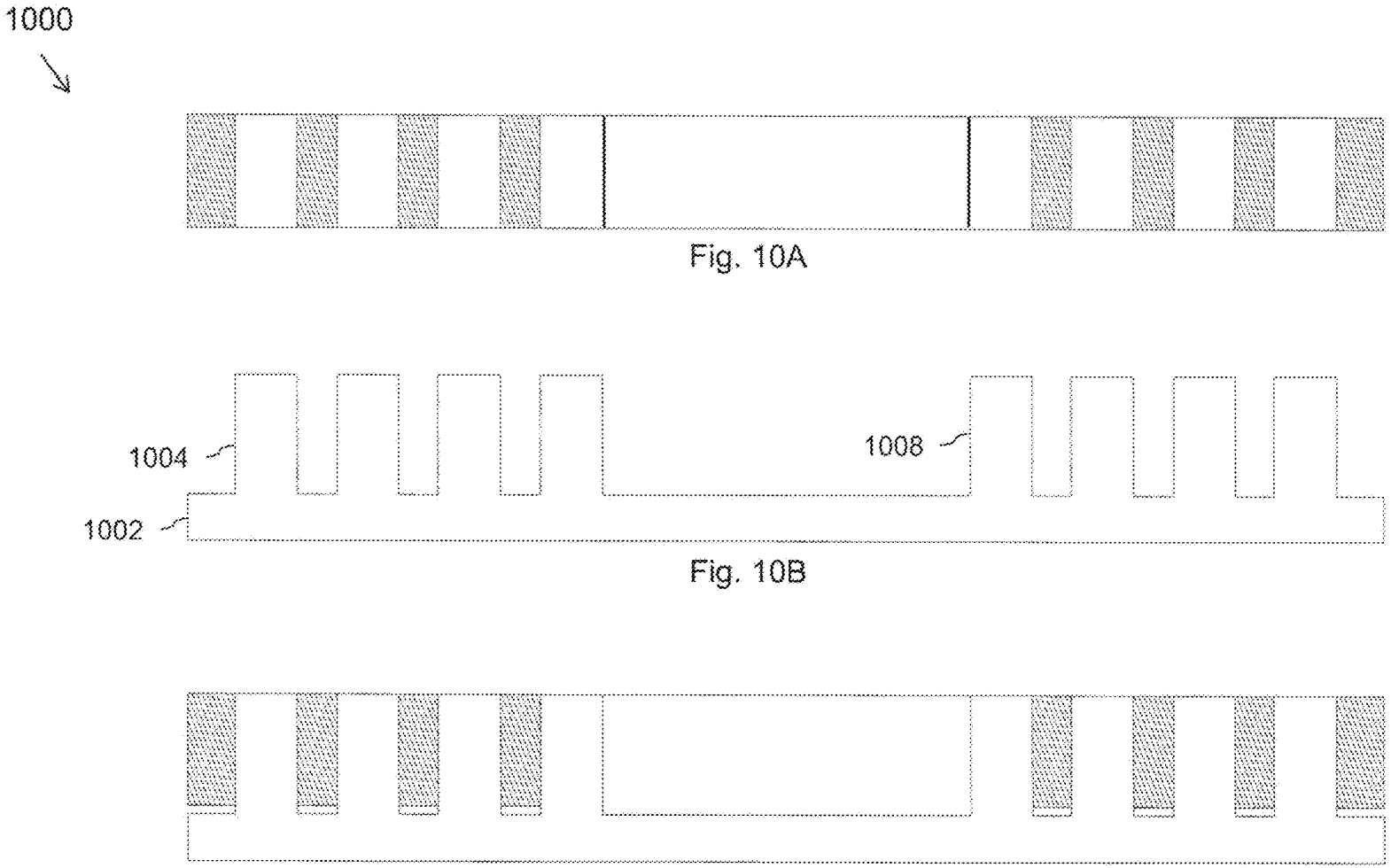
FIGS. 10A, 10B, and 10C depict components of a bottomless mat, in accordance with a second embodiment of the present disclosure.

FIGS. 10A, 10B, and 10C depict components of a bottomless mat 1000 (hereinafter the mat 1000), in accordance with a second embodiment of the present disclosure. The mat 1000 is referred to as bottomless since it is formed of a single layer (i.e., the first layer 902) without the need of a bottom layer. Various elements (in terms of their functionalities and configurations) disclosed in FIG. 10A are the same as that in FIG. 9A, except that the thickness of the first layer 902 of the mat 1000 may be greater than that of the first layer 902 of the mat 900. In an embodiment, the thickness of the first layer 902 may be 3 to 6 mm.

As shown in FIG. 10B, the mat 1000 further includes an elastomeric grip component 1002, which is a thin layer of elastomer connecting grip elements such as a first set of columns 1004 and a second set of columns 1008. It will be apparent to a person skilled in the art that although FIG. 10B illustrates only four columns in each set of columns, any number of columns may be used. Further, as shown in FIG. 10C, the elastomeric grip component 1002 (of a specific shape and size) is configured in such a manner that it may fit into the openings 914 formed in the first layer 902 and the bottom of the elastomeric grip component 1002, thereby covering the entire bottom of the mat 1000. In various embodiments, the first and second sets of columns 1004 and 1008 may be molded into any shape and size that may fit into the openings 914.

Figures 11A, 11B, 11C:
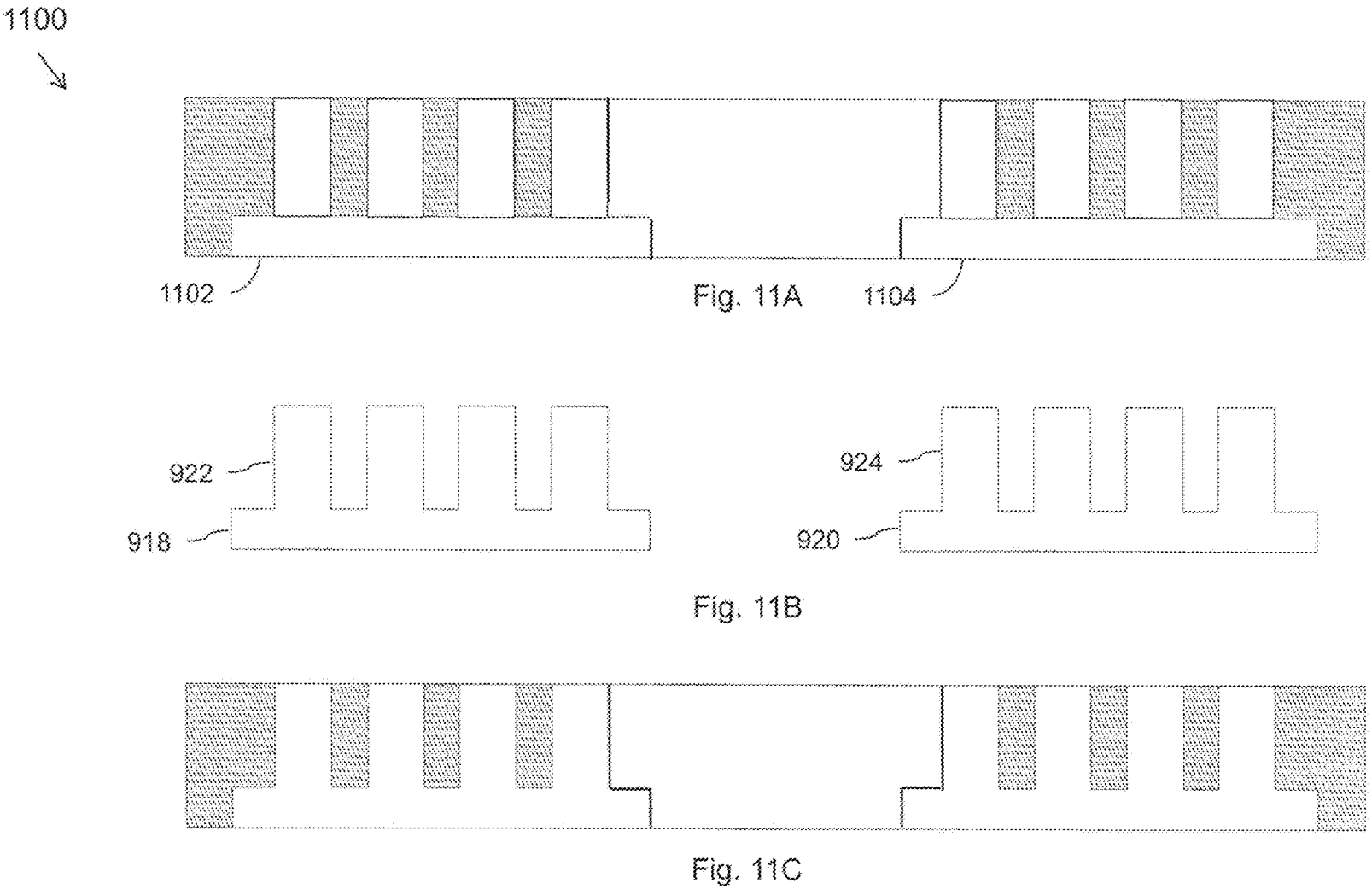
FIGS. 11A, 11B, and 11C depict components of a bottomless mat, in accordance with a third embodiment of the present disclosure.

FIGS. 11A, 11B, and 11C depict components of a bottomless mat 1100 (hereinafter the mat 1100), in accordance with a third embodiment of the present disclosure. The mat 1100 is referred to as bottomless since it is formed of a single layer (i.e., the first layer 902) without the need of a bottom layer. Various elements (in terms of their functionalities and configurations) disclosed in FIG. 11A are the same as that in FIG. 9A, except that the first layer of the mat 1100 also includes first and second embossed regions 1102 and 1104, and the thickness of the first layer 902 of the mat 1100 may be greater than that of the first layer 902 of the mat 900 or 1000. The greater thickness of the first layer 902 of the mat 1100 may be attributed to the first and second embossed regions 1102 and 1104 that cover the additional space in the first layer 902. In an embodiment, the thickness of the first layer 902 may be 4 to 8 mm.

FIG. 11B illustrates the first elastomeric grip component 918 and the second elastomeric grip component 920 as described and illustrated in FIG. 9C. Further, as shown in FIG. 11C, the first and second elastomeric grip components 918 and 920 (of a specific shape and size) are configured in such a manner that their major portions may fit into the openings 914 formed in the first layer 902 and the remaining portion (bottom portion of these components) may fix into first and second embossed regions 1102 and 1104 in the first layer 902. The columns 922 and 924 may be molded into any shape and size that may fit into the openings 914 and the first and second embossed regions 1102 and 1104.

It should be appreciated that any other design (shape and/or size) of the mat and its components is possible without deviating from the scope of the present disclosure.

Figure 12A:
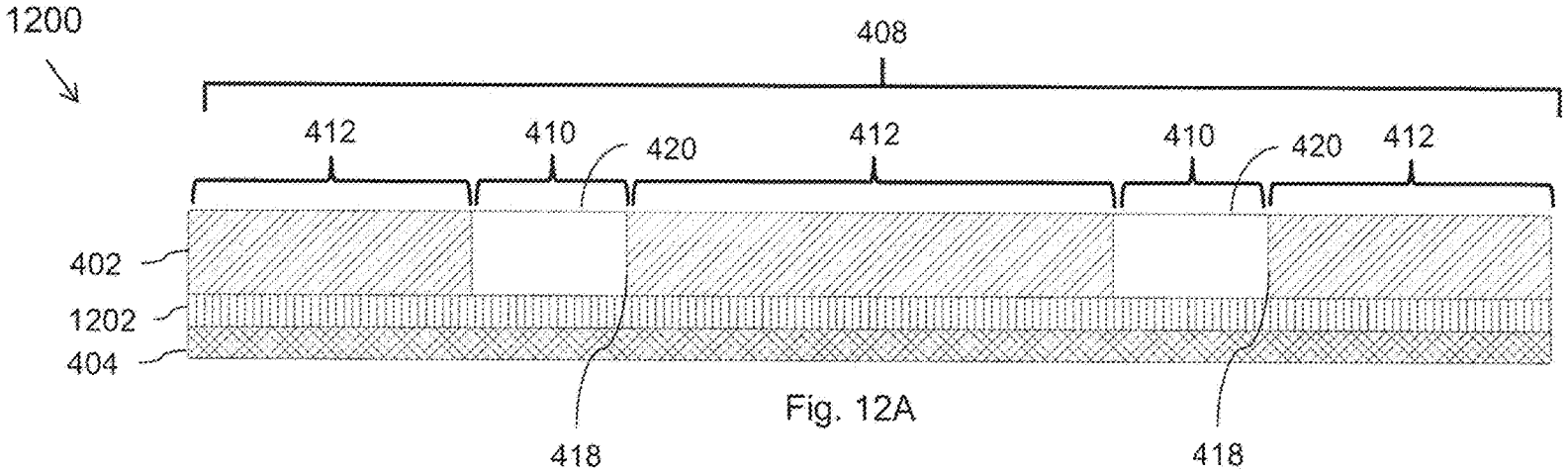
FIGS. 12A and 12B depict the compressed and uncompressed configurations of a mat, in accordance with an embodiment of the present disclosure.
Figure 12B:
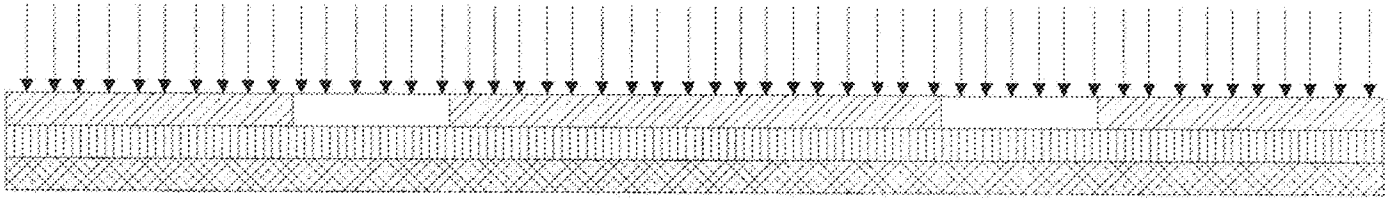

FIGS. 12A and 12B depict the compressed and uncompressed configurations of a mat 1200, in accordance with an embodiment of the present disclosure. FIG. 12A depicts the uncompressed configuration of the mat 1200. Various elements (in terms of in their functionalities and configurations) disclosed in FIG. 12A are the same as that in FIG. 4A, except that a fraction layer 1202 (shown by straight vertical lines in FIGS. 12A and 12B) is disposed between the first layer 402 and the bottom layer 404. Since the traction layer 1202 may function as, and may in fact be, a single column disposed proximate to the openings 418 of the first layer 402, in FIG. 12A there are no columns 414 disposed in the openings 418 as shown in FIG. 4A. The traction layer 1202 is formed of an elastomer (similar to the columns 414 in FIG. 4A) and may be introduced below the openings 418 formed through the first portions 410.

The traction layer 1202 may be formed of a high-traction material such that the top surface of the traction layer 1202 has a higher traction than the one or more second portions 120 of the top surface 102 of the first layer 104. In various embodiments, the traction layer 1202 may be formed of a material that is less or equally compressible than the material used to form the second portions 412 of the top surface 408 of the first layer 402. In an embodiment as illustrated in FIG. 12B, the top surface of the traction layer 1202 depresses or compresses to the same level as does the second portions 412 in response to the pressure applied on the grip zone. The arrows shown in FIG. 12B represent the pressure applied on the grip zone. In the compressed configuration, the user's hands or feet may contact some portion of the traction layer 1202 that is exposed to the user's hands or feet through the openings 418. This may result in the mat 1200 offering both support and traction to the hands/feet of the user. The traction and support, thus developed under pressure, may still maintain a comfortable level for hands and feet while gliding over the grip zone of the mat 1200.

Further, one or more of the embodiments disclosed herein provide a towel that may offer the required traction and stability to a user without compromising smooth movements between yoga poses. In various embodiments, the towel may be disposed above any of the mats described above. In one embodiment, the towel may be any ordinary towel. In another disclosed non-limiting embodiment, the towel used may be the towel as described below in conjunction with FIGS. 13A-13C and FIGS. 15A-15B. In yet another disclosed non-limiting embodiment, the towel disposed above the mat may be wet. In any case, the mat may provide the required traction and support to the user's hands/feet using the columns that may provide traction/support even through the towel.

Figure 13A:
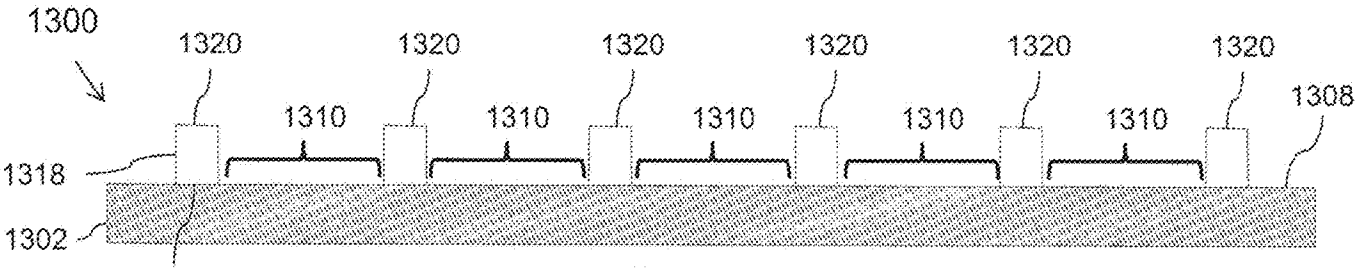
FIGS. 13A, 13B, and 13C depict compressed and uncompressed configurations of a towel, in accordance with an embodiment of the present disclosure.
Figure 13B:
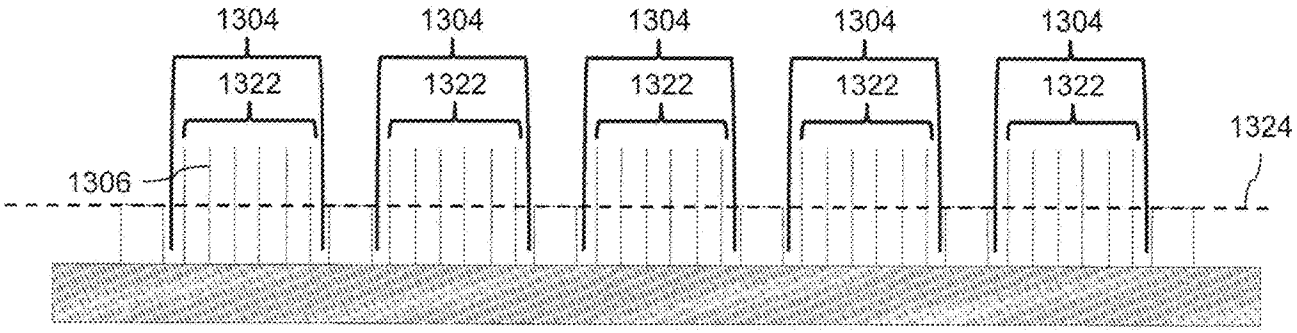
Figure 13C:
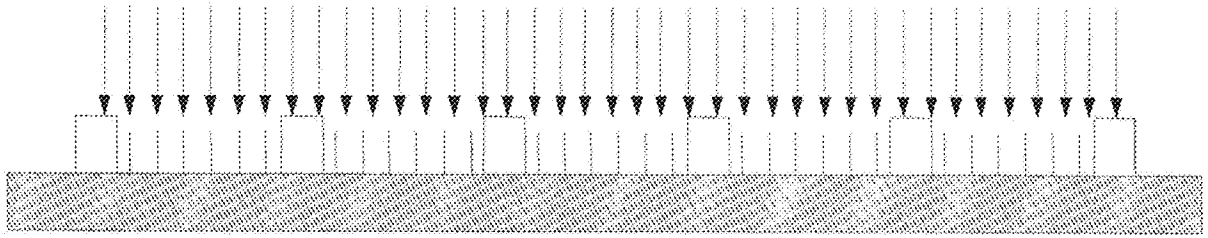

FIGS. 13A, 13B, and 13C depict compressed and uncompressed configurations of a towel 1300, in accordance with an embodiment of the present disclosure. FIGS. 13A and 13B depict the uncompressed configuration of the towel 1300, whereas the FIG. 13C depicts the compressed configuration. In one embodiment, the towel 1300 may be placed on top of a mat (such as the mat 100) at various points to absorb sweat and prevent slipping of body parts during yoga practice. Alternatively, in another disclosed non-limiting embodiment, the towel 1300 may be used as a stand-alone product such as, but not limited to, a bath towel. Various embodiments described below in conjunction with FIGS. 13A, 13B, and 13C to FIGS. 14A and 14B only disclose various detailed views of a grip zone of a towel (such as the grip zone of the mat 100). The towel 1300 includes an absorption layer 1302 adapted to absorb moisture and compressible regions 1304 of flexible fiber 1306 formed of a flexible first material. In an embodiment, the flexible first material may be any of a number of natural and synthetic materials commonly used in woven or non-woven fabrics.

The absorption layer 1302 has a top surface 1308. As shown in FIGS. 13A-13C (the compressible regions 1304 of flexible fiber 1306 is not shown in FIG. 13A for clarity purposes), the top surface 1308 of the absorption layer 1302 is same as the top surface of the towel 1300 since the absorption layer 1302 is the topmost layer in this embodiment. The top surface 1308 of the absorption layer 1302 in the grip zone may include one or more first portions 1310. The top surface 1308 of the absorption layer 1308 in the grip zone other than the one or more first portions 1310 forms one or more second portions 1312. As shown in FIGS. 13A-13C, the second portions 1312 are the portions on the top surface 1308 of the absorption layer 1308 in the grip zone that are disposed between the first portions 1310. As shown in FIG. 13B, the compressible regions 1304 of flexible fiber 1306 are disposed on the one or more first portions 1310. In accordance with various embodiments, the compressible regions 1304 of flexible fiber 1306 may be of loop weaves, fiber pile, flocking, or the like. The flexible fiber 1306 may facilitate the absorption of moisture/sweat owing to a large surface area exposed to the moisture/sweat. The flexible fiber 1306 may also provide a soft touch to the user. It must be appreciated by a person skilled in the art that though the flexible fibers 1306 are shown as straight lines, various other shapes of the flexible fibers 1306 such as circular, semi-circular, and the like may also be possible without limiting the spirit and scope of the present disclosure.

Further, the towel 1300 includes one or more columns 1318 disposed on the one or more second portions 1312. Between the compressible regions 1304 of flexible fiber 1306 are portions where the fiber is abbreviated or cut to create the relief pattern that in turn provides a surface (such as the one or more second portions 1312) upon which the traction material such as the one or more columns 1318 may be applied. The one or more columns 1318 may be manufactured of a second material such as a woven fabric, a non-woven fabric, an elastomer, or the like. The shape of the one or more columns 1318 may be cylindrical, square, rectangle, or the like, with defined lengths and widths of the columns such that a traction pattern is created. The traction pattern may provide traction to the user's body parts contacting the grip zone of the towel 1300. In accordance with various embodiments, the configuration of the traction pattern may vary based on the requirements. The traction pattern may be uniform or non-uniform. FIGS. 13A-13C illustrate one of the embodiments, in which the shape of the one or more columns 1318 is rectangular.

The one or more columns 1318 include top surfaces 1320 that may be configured to be disposed below one or more portions of top surfaces 1322 of the compressible regions 1304 of flexible fiber 1306 in the uncompressed configuration. The configuration in which the compressible regions 1304 of flexible fiber 1306 are in an uncompressed state (i.e., the pressure applied on the grip zone is below the threshold pressure) is interchangeably referred to as an uncompressed configuration. FIG. 13B illustrates one of the embodiments, in which the top surfaces 1320 of the one or more columns 1318 are disposed below the top surfaces 1322 of the compressible regions 1304 of flexible fiber 1306. As shown in FIG. 13B, a surface 1324 defined by connecting the top surfaces 1320 of the one or more columns 1318 is planar. However, a towel having a non-planar surface may be similarly deployed without limiting the scope of the present disclosure. The non-planar surface of the towel in that case will be similar to that described above in various embodiments of the mat (such as the mat 700 or 800).

Further, FIG. 13C illustrates the compressed configuration in which the compressible regions 1304 of flexible fiber 1306 are configured to be depressed or compressed when a user applies pressure during standing poses or any other activity that involves contact of the user's body parts with the grip zone. The configuration in which the pressure applied on any portion of the grip zone facilitates the compressible regions 1304 of flexible fiber 1306 to be compressed is hereinafter referred to as a compressed configuration. As shown in FIG. 13C, the top surfaces 1320 of the one or more columns 1318 are configured to be disposed above the top surfaces 1322 of the compressible regions 1304 of flexible fiber 1306 due to the applied pressure. The arrows shown in FIG. 13C represent the pressure applied on the grip zone. In an embodiment, the compressible regions 1304 of flexible fiber 1306 may compress only when pressure applied on the grip zone is the same as or above a threshold pressure, i.e., the pressure at which the compressible regions 1304 of flexible fiber 1306 begins to compress. In various embodiments, the material, shape, thickness and density of the flexible fibers 1306 may be chosen such that the compressible regions 1304 of flexible fiber 1306 will not compress until the threshold pressure is achieved.

The compressed configuration may provide support (or stability) to the body parts that contact in a direction perpendicular to the top surface 1308 of the absorption layer 1308, and traction to the body parts that contact in a direction tangential to the top surface 1308. The support and traction are provided using the fraction pattern created by the one or more columns 1318, which may engage with the hands/feet of the user in the compressed configuration. The traction and support, thus developed under pressure, may still maintain a comfortable level for hands and feet while gliding over the grip zone of the towel 1300. In other words, the towel 1300 is able to offer the required traction and support to the user without compromising smooth movements between the yoga poses.

The perspective view of the towel 1300 may be similar to the mat 100, except that the towel 1300 includes the absorption layer 1302 adapted to absorb moisture (instead of the first layer 104), and the one or more columns 1318 disposed on the one or more second portions 1312 of the top surface of the absorption layer (instead of being disposed in or proximate to the openings formed through the one or more first portions 118). Additionally, the towel 1300 also includes the compressible regions 1304 of flexible fiber 1306. The towel 1300 may include the grip zones provided proximate to the opposite ends of the top surface 1308 of the absorption layer 1302 (similar to the opposite ends 108 and 110 of the top surface 102 of the mat 100). In another disclosed non-limiting embodiment, the grip zones may be provided on the entire top surface 108 to provide additional traction.

The one or more columns 1318 may include non-repeating patterns including silicone rubber, various elastomers or other high-traction materials. In an embodiment of the present disclosure, the high-traction material may be directly embedded below the top surface 1322 of the compressible regions 1304 of flexible fibers 1306. The height difference between the top surfaces 1320 of the one or more columns 1318 and the compressible regions 1304 of flexible fiber 1306 may be defined based on the traction requirements and the application of external pressure. The embedded non-repeating patterns of high-traction material may ensure better grip during yoga positions and postures.

The traction pattern in the one or more columns 1318 may be generated with the use of one or more continuous threads of a high-traction material. The material used for these threads be a rubber, silicone, or any other elastomer that may offer sufficient traction. In accordance with various embodiments, several other types of traction materials may be utilized to provide stitched patterns. In various embodiments, these threads may be stitched on the top surface 1308 of the absorption layer 1302 to form the one or more columns 1318. There can also be a bottom layer that is waterproof or moisture resistant and/or has traction properties for adhering to a mat or the floor.

Another embodiment of the present disclosure provides a towel that may absorb sweat and prevent slipping once hands and feet are moist, and also protect the mat (such as the mat 100) from absorbing perspiration. In embodiments, the towel 1300 may include a moisture barrier or waterproofing layer or connection grip layer that may be disposed below the absorption layer 1302. This moisture barrier may be formed of a waterproof material. In embodiments, the waterproofing layer may be coated in a material that provides fraction, such as silicone or many other plastic, rubber or other resins. The second layer 304 may be adapted to reduce sweat and moisture of the user from penetrating beneath the towel 1300 when the towel 1300 is disposed above the mat 100. This may facilitate in maintaining the mat 100 in sanitary condition. The silicone or other impermeable coating may provide gripping and sticking capability to the moisture barrier, thereby creating a connection between the mat 100 and the towel 1300. This may provide stability to the towel 1300 during various flow sequences of the user, especially during a gliding motion. In addition, the moisture barrier may connect the towel 1300 and the mat 100 with an additional surface area. Further, the weight of the waterproof material and/or the silicone coating may provide additional traction to avoid bunching and scrunching of the towel 1300. Further, the stiffness of the waterproof material and/or silicone coating may encourage the towel 1300 to lie flat and stable against the mat 100 thereby minimizing the sliding and bunching that plagues the towels on the market today. The two-layer construction of the towel 1300 may increase its weight, thereby stabilizing the towel 1300 on the mat 100 during yoga practice.

In accordance with various embodiments of the present disclosure, the moisture barrier may be formed of rip-stop nylon with bottom high-grip polyurethane coating. However, it must be appreciated by a person ordinarily skilled in the art that various other materials may be utilized in the formation and construction of the moisture barrier. The permeability of the moisture barrier may vary based on the requirements.

Figure 14:
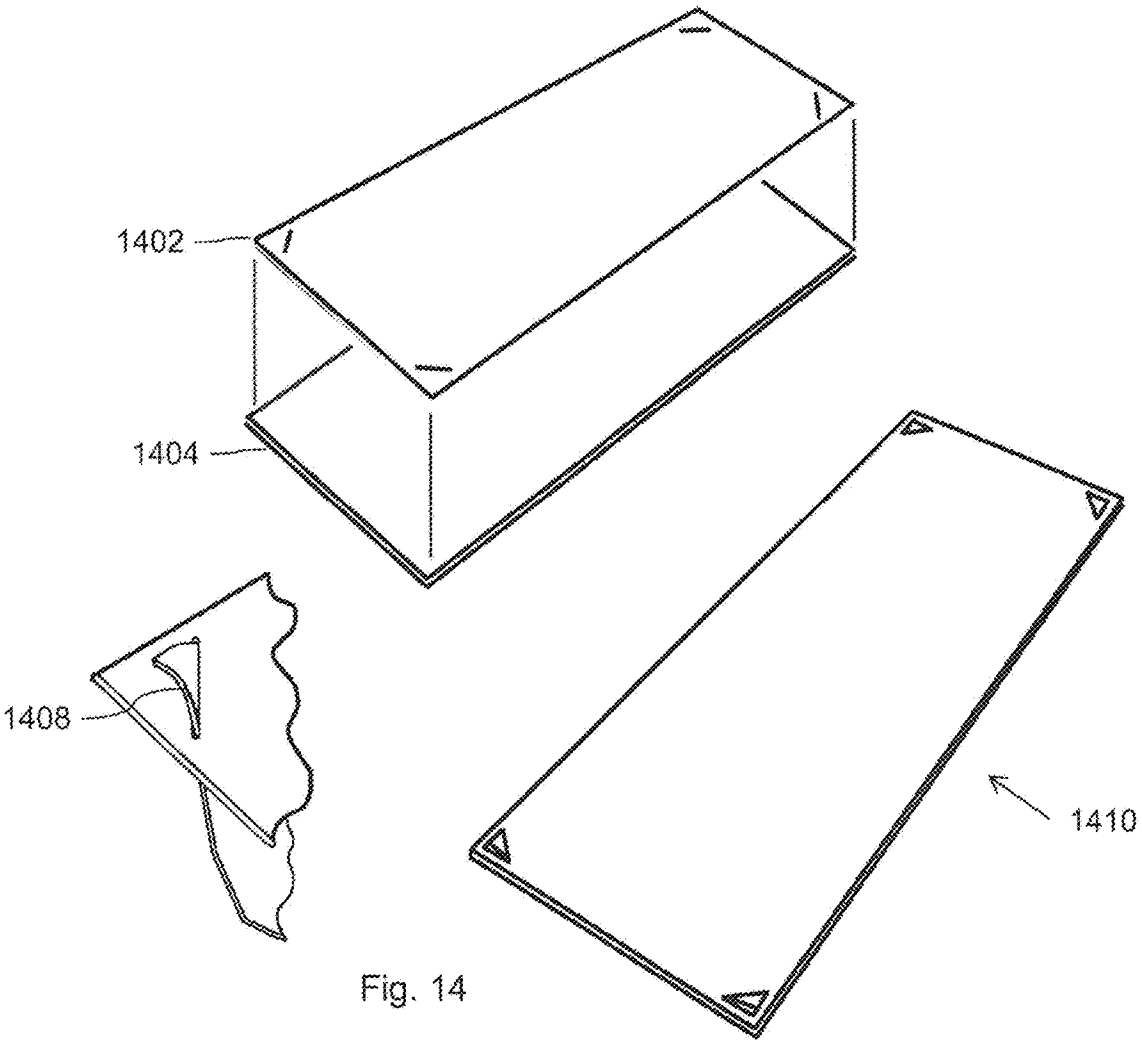
FIG. 14 depicts coupling between a towel and a mat, in accordance with an embodiment of the present disclosure.

FIG. 14 depicts coupling between a towel 1402 and a mat 1404, in accordance with an embodiment of the present disclosure. Referring to FIG. 14, the towel 1402 may include slits 1408 to enable attachment to the mat 1404. In an embodiment, the corners of the mat 1404 may be pulled through some or all the slits 1408 of the towel 1402 to enable securing the towel 1402 to the mat 1404 and forming a mat/towel assembly 1410. In an embodiment, the mat 1404 may alternatively or additionally include slits to enable pulling the corners of the towel 1402 through the mat 1404 slits. In embodiments, the corners of the towel 1402 may additionally be secured to the mat 1404 through any number of attachment or fastener mechanisms, such as a hook and loop fastener, a removable adhesive, a button, a snap, a zipper, and the like.

Similarly, in accordance with various other embodiments of the present disclosure, several other kinds of coupling mechanisms may be utilized without limitations for coupling the towel 1402 and the mat 1404 to form an integrated mat/towel assembly. The mat towel 1402 and the mat 1404 may be any towel and mat, respectively, as described above in various embodiments of the present disclosure. Alternatively, in another disclosed non-limiting embodiment, the towel 1402 may be any ordinary towel, whereas the mat 1404 may be the mat of the present disclosure. Alternatively, in yet another disclosed non-limiting embodiment, the towel 1402 may be the towel of the present disclosure, whereas the mat 1404 may be any ordinary mat.

Figure 15A:
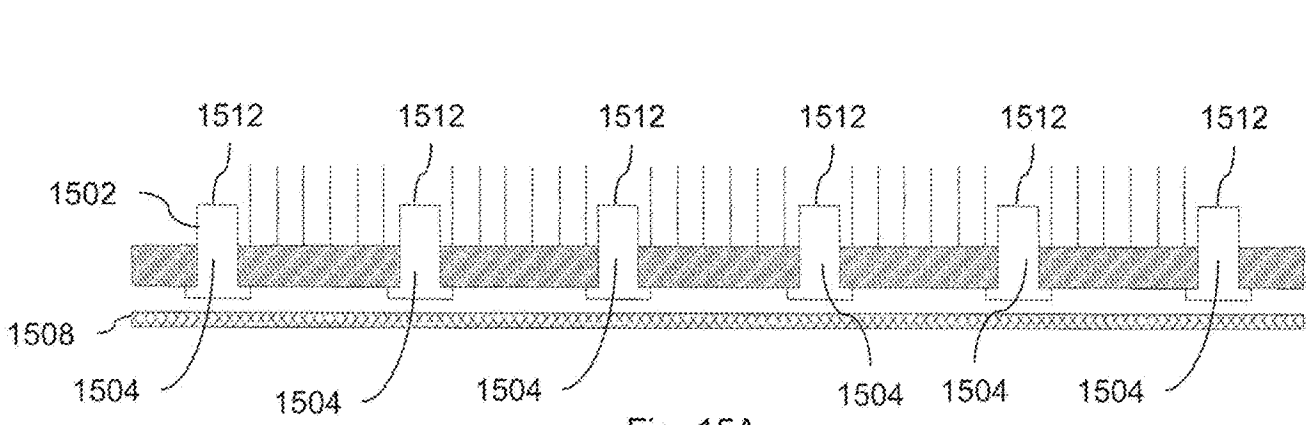
FIGS. 15A and 15B depict compressed and uncompressed configurations of a towel, in accordance with an embodiment of the present disclosure.
Figure 15B:
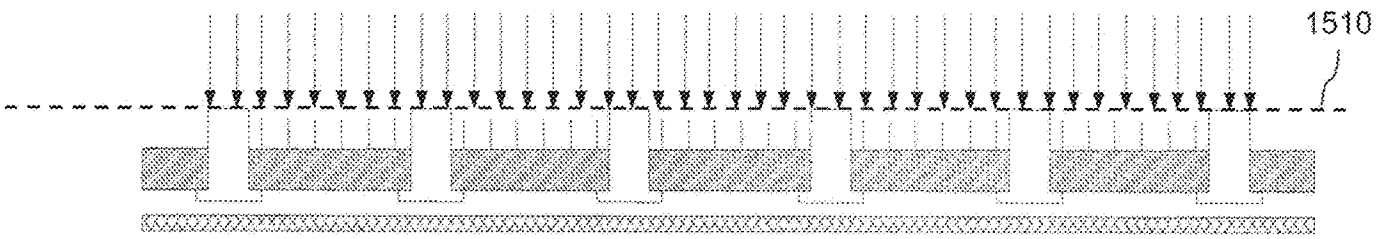

FIGS. 15A and 15B depict compressed and uncompressed configurations of a towel 1500, in accordance with an embodiment of the present disclosure. FIG. 15A depicts the uncompressed configuration of the towel 1500, whereas the FIG. 15B depicts the compressed configuration. Various elements (in terms of in their functionalities and configurations) disclosed in FIGS. 15A and 15B are the same as that in FIGS. 13B and 13C, respectively, except that the towel 1500 includes one or more columns 1502 disposed in openings 1504 (instead of the one or more columns 1318 disposed on the one or more second portions 1312) formed through the one or more second portions 1312 of the top surface 1308 of the absorption layer 1302. Alternatively, in another disclosed non-limiting embodiment, the one or more columns 1502 may be disposed proximate to the openings 1504 (similar to that done in the mat embodiments described earlier). Further, the towel 1500 includes a bottom layer 1508 formed of a high-traction material. As illustrated in FIGS. 15A and 15B, the bottom layer 1508 is disposed below the absorption layer 1302. In some embodiments, the bottom layer 1508 may include a higher density than that of the absorption layer 1302. In an embodiment, the bottom layer attached to the absorption layer 1302 may facilitate in trapping the one or more columns 1502 into the towel 1500.

As shown in FIG. 15B, a surface 1510 defined by connecting top surfaces 1512 of the one or more columns 1502 is planar. However, a towel that has such a surface as non-planar may be similarly deployed without limiting the scope of the present disclosure. The non-planar surface of the towel in that case will be similar to that described above in various embodiments of the mat (such as the mat 700 or 800).

In accordance with various embodiments of the present disclosure, the towel 1300 or 1402 or 1500 may be customized based on specific requirements. The traction pattern created by a high traction material may be designed accordingly. For example, the high traction material may form a continuous pattern throughout the grip zone in accordance with an embodiment of the present disclosure. In another disclosed non-limiting embodiment, the high traction material may form a discontinuous pattern and may be embedded in discrete units. In yet another disclosed non-limiting embodiment, a high-traction coating may be applied to offer the required traction and grip.

In accordance with various embodiments of the present disclosure, the colors of the towel 1300 or 1402 or 1500 and various layers such as the absorption layer 1302, the moisture barrier 304, and the one or more columns 1318 may vary based on user preferences. The hardness of the one or more columns 1318 may vary in durometer based on requirements. For example, the hardness of the columns may be 20 Shore A, in accordance with an embodiment of the present disclosure.

Figure 16:
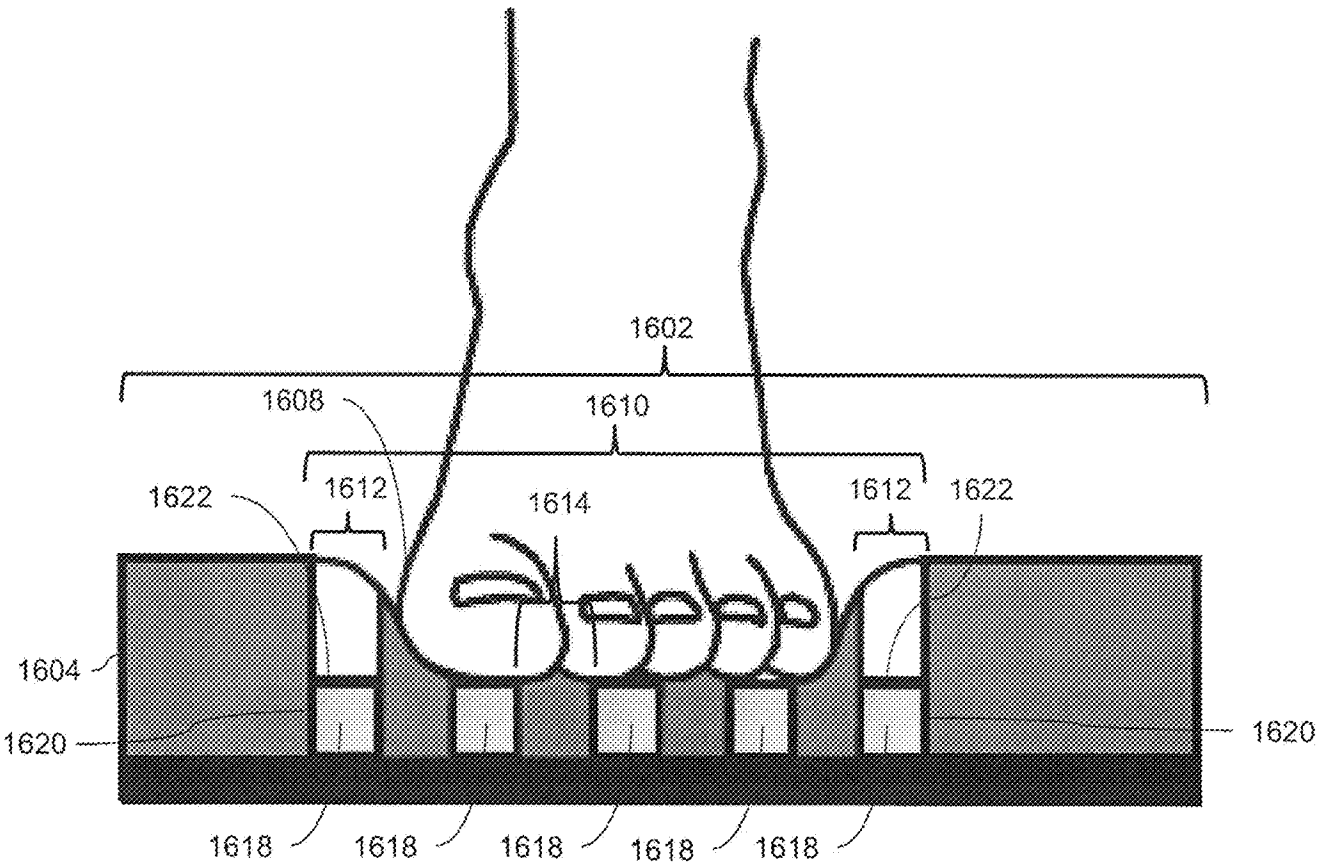
FIG. 16 depicts the compressed configuration of a grip apparatus during standing and stationary posture, in accordance with an embodiment of the present disclosure.

FIG. 16 depicts the compressed configuration of a grip apparatus 1600 during standing and stationary posture, in accordance with an embodiment of the present disclosure. The grip apparatus 1600 may be a towel, a mat, or the like. As an exemplary scenario, FIG. 16 is described considering the grip apparatus 1600 to be a mat. As shown in FIG. 16, the standing posture is a single-footed standing posture typical of yoga. The grip apparatus 1600 includes a top surface 1602. The grip apparatus 1600 further includes a first layer 1604, which may be manufactured of a material such as compressible foam or any other material that is compressible, durable and light. As shown in FIG. 16, the grip apparatus 1600 only includes a single layer, i.e., the first layer 1604. Therefore, in this case, the top surface 1602 of the grip apparatus 1600 will be the same as the top surface of the first layer 1604.

The top surface 1602 may include one or more traction surface regions defined in the area where user's hands and/or feet come in contact with the grip apparatus 1600. FIG. 16 shows one such case where a user's foot 1608 comes in contact with a traction surface region 1610. The traction surface region 1610 may be designed in such a way that they may provide stability (or support) to the user's foot 1608 during the standing and stationary posture. In accordance with various embodiments, the traction surface region 1610 may be composed of a material or include a surface roughness that may offer frictional resistance to the foot 1608 in a direction perpendicular to the top surface 1602 of the grip apparatus 1600 or the first layer 1604. Additionally, the traction surface region 1610 may be configured to provide traction to the user's foot 1608 during movements and postures, thereby avoiding users from any feeling of unsteadiness, distraction, and frustration.

The top surface 1602 of the first layer 1604 in the traction surface region 1610 may include one or more first portions 1612. The top surface 1602 in the traction surface region 1610 other than the first portions 1612 forms one or more second portions 1614. As shown in FIG. 16, the second portions 1614 are disposed between the first portions 1612.

In various embodiments, openings 1618 may be formed through the one or more first portions 1612. As shown in FIG. 16, one or more columns 1620 formed of a thermoplastic elastomer such as a rubber or any other synthetic material may be disposed in the openings 1618. In various embodiments, top surfaces 1622 of the columns 1620 may be formed of a traction material that may offer traction higher or lower than that offered by the fraction material used to form the second portions 1614 (i.e., the first layer 1604). As described in accordance with various embodiments described earlier (e.g., as shown and described in conjunction with FIGS. 7A and 8A), the top surfaces 1622 of some or all the columns 1620 may be below the top surface 1602 of the first layer 1604 (or the second portions 1614) in the uncompressed configuration. Further, as shown in FIG. 16, the second portions 1614 may compress when the user applies pressure during the standing pose or any other activity that involves contact of the user's foot 1608 with the fraction surface region 1610. In the embodiment disclosed in FIG. 16, the second portions 1614 depress substantially more than the top surfaces 1622 of the columns 1620 in the compressed configuration. Therefore, the compression of the second portions 1614 may facilitate the engagement of some or all the columns 1620 with the foot 1608 to offer support to the user. The columns 1620 are able to provide support to the foot 1608 by causing the resistance to movement of the foot 1608 in a direction perpendicular to the top surface 1602 of the first layer 1604. The columns 1620, being more rigid than the first layer 1604, provide more stability/support than the cushioning first layer 1604 when the columns 1620 engage with the foot 1608, thus improving the user's balance.

It must be appreciated by a person of ordinarily skilled in the art that though the disclosure has been described in terms of yoga, the present disclosure may be utilized equally for other activities, forms of exercising, sporting and the like without limiting the spirit and scope of the present disclosure. A grip apparatus similar to the mat (such as the mat 100) or the towel (such as the towel 1300) disclosed in the present disclosure may be used in various applications. In an embodiment, the grip apparatus may be adapted to form an outside surface of at least a portion of a glove, a sock, a bat, a hockey stick, a racquet, or the like. In another embodiment, the grip apparatus may be a strip or a tape.

The present disclosure described above has several applications and advantages, some of which are stated below without limitations.

An advantage of the present disclosure is that the mat and the towel may increase the performance of a user or a yogi.

Another advantage of the present disclosure is that the mat and the towel may be used in heated and cooled environments without compromising the performance.

Yet another advantage of the present disclosure is that the mat may include different areas with differentiated construction patterns based on varying requirements on different locations of the mat.

Still another advantage of the present disclosure is that the mat may provide the required traction to a user without compromising glide. The required traction may be provided in the prevalent areas of the mat based on requirements. Therefore, a user may get a neutral tactile feel during movements and postures, thereby avoiding any distraction during yoga practice. Further, the mat may provide comfort and stability, especially during standing and stationary postures such as the challenging single-footed standing posture and the like. The traction may be provided to the mat while still achieving lightness and portability. Furthermore, the mat may create an additional traction to the floor surface, and also protect and keep the mat clean.

Still another advantage of the present disclosure is that the mat may provide the desired stiffness and cushioning effect without compromising portability.

Still another advantage of the present disclosure is that the mat may achieve a limited sweat condition to keep the mat clean over time and also offer a waterproofing impact to the mat.

Still another advantage of the present disclosure is that the towel may absorb sweat and prevent slipping once hands and feet are moist, and protect the mat from absorbing perspiration. The towel may also include a moisture barrier that may keep the moisture from penetrating into and onto the mat from the towel. The moisture barrier may further connect the towel and the mat with more surface area, thereby avoiding bunching and scrunching.

Still another advantage of the present disclosure is that the towel may provide sufficient topside traction, especially in the hands and feet area without compromising glide. The traction may be delivered only on application of an external pressure that may further allow the user to glide comfortably. Further, the towel may provide sufficient grip on the bottom side to make it stable on the mat.

Still another advantage of the present disclosure is that the towel may include multiple layers that may increase the towel weight and stiffness and further stabilize it on the mat surface.

Still another advantage of the present disclosure is that the grip apparatus may increase the performance of a user.

Another advantage of the present disclosure is that the grip apparatus may be used in heated and cooled environments without compromising the performance.

Yet another advantage of the present disclosure is that the grip apparatus may include different areas with differentiated construction patterns based on varying requirements on different locations of the grip apparatus.

Still another advantage of the present disclosure is that the grip apparatus may provide traction without compromising glide. The required fraction may be provided in the prevalent areas of the mat based on requirements. Therefore, a user may get a neutral tactile feel during use, thereby avoiding any distraction. Further, the grip apparatus may provide comfort and stability during use.

Still another advantage of the present disclosure is that the grip apparatus may absorb sweat and prevent slipping once hands are moist, and protect the grip from absorbing perspiration. The grip apparatus may also include a moisture barrier that may keep the moisture from penetrating into and onto the object being gripped.

Still another advantage of the present disclosure is that the grip apparatus may provide sufficient traction without compromising smooth, unobstructed movement. The traction may be delivered only on application of an external pressure that may further allow the user to change grip positions comfortably and without distraction.

Figure 17:
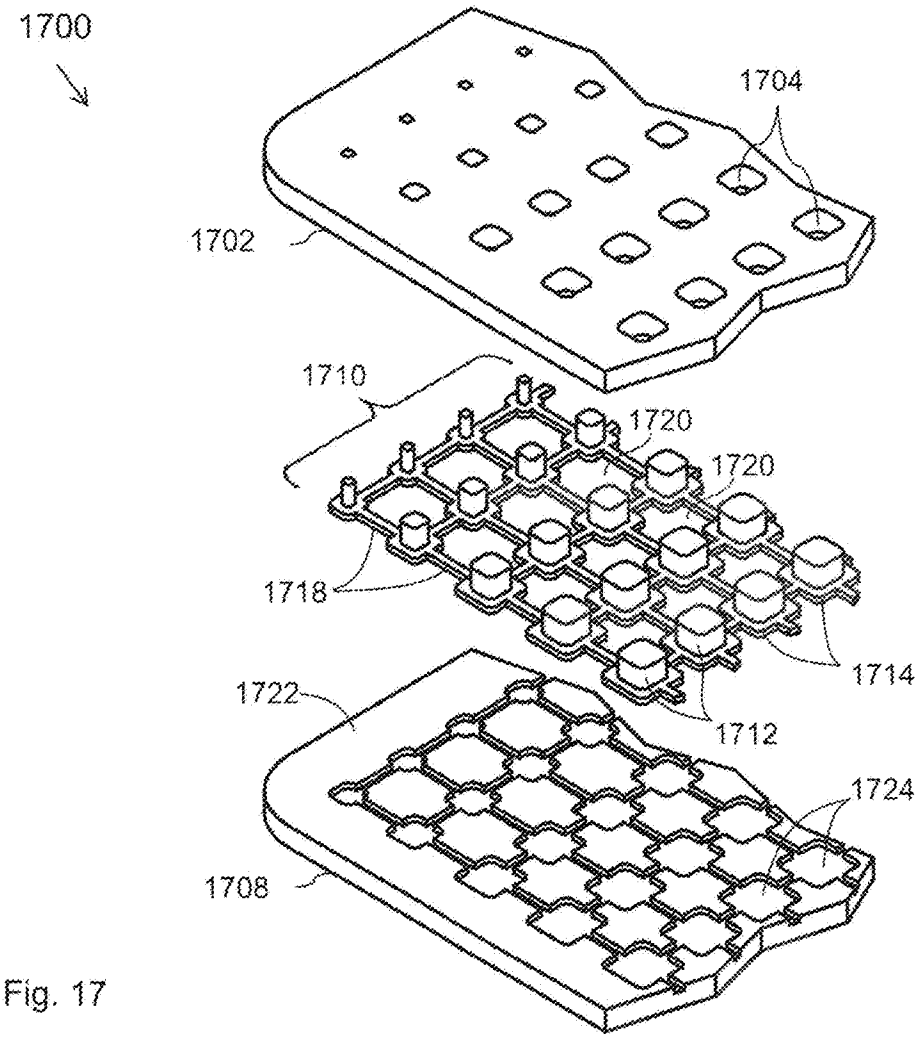
FIG. 17 depicts a perspective view of an alternative layered engagement structure of the grip zone of a mat, in accordance with an embodiment of the present disclosure.

In an embodiment described in conjunction with FIG. 2, the first layer 104's grip zone and the second layer are separated by the elastomeric grip component 204. FIG. 17 depicts a perspective view of an alternative layered engagement structure of the grip zone of a mat 1700 or for use in a reversible grip apparatus, in accordance with an embodiment of the present disclosure. As shown in FIG. 17, the grip zone of the mat 1700 includes a top layer 1702 with an array of openings 1704 (hereinafter referred to as 'openings 1704'), a second layer such as a bottom layer 1708, and a grip component 1710 molded or formed of an elastomer or a flexible polymeric material. The grip component 1710 may include an array of columns 1712 (hereinafter referred to as 'columns 1712'), flanges 1714 that extend horizontally outwards from the bottom ends of each of the columns 1712, and connecting segments 1718 that connect the flanges 1714 of the columns 1712. The undersides of the columns 1712 may be hollow to enhance their compressibility. The flanges 1714 may prevent the columns 1712 from being removed from the mat 1700 during use. In the embodiment, the thickness of the connecting segments 1718 are equal to the thickness of the flanges 1714, although the thickness of the connecting segments 1718 may be different from the thickness of the flanges 1714.

Alternatively, the grip component 1710 may not include flanges 1714 and the connecting segments 1718 may directly connect the columns 1712. The connecting segments 1718 may be flush the columns 1712 in a configuration that facilitates coupling the grip component 1710 through the bottom surface of the grip zone of the top layer 1702 such that the columns 1712 fix into the openings 1704 of the top layer 1702. The flanges 1714 and the connecting segments 1718 may form openings 1720 through the grip component 1710. The top surface 1722 of the bottom layer 1708 and the bottom surface of the top layer 1702 may include embossed regions 1724 that correspond to the shape and at least a portion of the thickness of the flanges 1714 and of the connecting segments 1718 such that the top surface 1722 of the bottom layer 1708 and the bottom surface of the top layer 1702 directly contact one another when assembled with the grip component 1710. Alternatively, only the top surface 1722 of the bottom layer 1708 or only the bottom surface of the top layer 1702 may include the embossed regions 1724.

Alternatively, neither the bottom surface of the top layer 1702 nor the top surface 1722 of the bottom layer 1708 may include embossed regions, in which case the direct contact between the top layer 1702 and the bottom layer 1708 occurs when the top layer 1702 and the bottom layer 1708 compress in the regions corresponding to the flanges 1714 and the connecting segments 1718 of the grip component 1710. The top layer 1702 and the bottom layer 1708 may be bonded together in the areas where they make direct contact with an adhesive, by a bonding process involving heat or solvents, or with any other feature or by any other process that may securely join the top layer 1702 and the bottom layer 1708. The direct contact between the top layer 1702 and the bottom layer 1708 may enhance the feel and increase the apparent compressibility of the top layer 1702 during use, and may also enhance the adhesion between the top layer 1702 and the bottom layer 1708, thereby improving the overall durability of the mat 1700.

Figure 18:
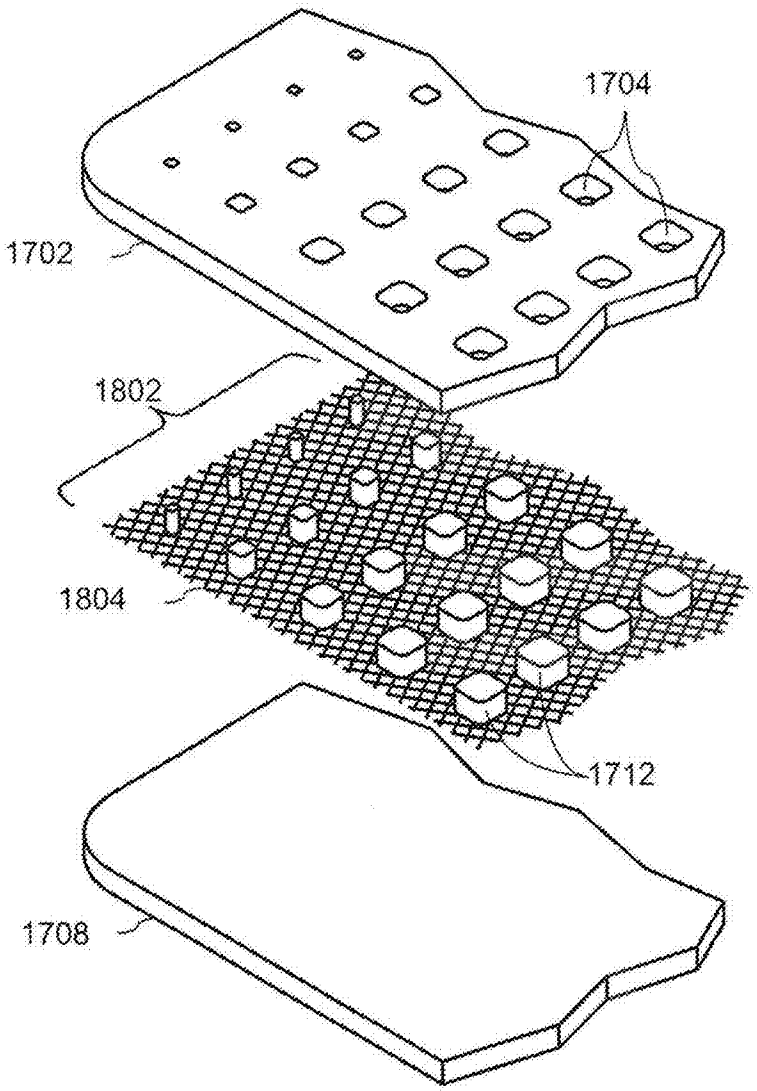
FIG. 18 depicts a perspective view of a layered engagement structure of the grip zone of a mat, in accordance with an embodiment of the present disclosure.

In the embodiment described in conjunction with FIG. 17, the grip component 1710 includes columns 1712, flanges 1714 and connecting segments 1718 that may be molded or formed together of the same material. Alternatively, the connecting segments may be of a different material or materials and may be manufactured by different processes than the columns. FIG. 18 depicts a perspective view of a layered engagement structure of the grip zone of a mat 1800 or for use in a reversible grip apparatus, in accordance with an embodiment of the present disclosure. As shown in FIG. 18, the grip zone of the mat 1800 includes the top layer 1702 with the openings 1704, the bottom layer 1708, and a grip component 1802. The grip component 1802 may include the columns 1712 and a connecting web 1804 that connects all the columns 1712. The connecting web 1804 may be manufactured of loosely-woven fibers such that there are spaces between the fibers, or be manufactured of a woven fabric, a nonwoven fabric, or a thin sheet of material, with an array of openings stamped, cut or burned through. The columns 1712 may be molded or formed directly to the connecting web 1804, or may be bonded to the connecting web 1804 with adhesive or by a bonding process.

Alternatively, the columns 1712 may be directly woven into the connecting web 1804 during the weaving process. The spaces between the fibers of the connecting web 1804 may allow the top layer 1702 and the bottom layer 1708 to directly contact one another. The top layer 1702 and the bottom layer 1708 may be bonded together in the areas where they make direct contact, either with an adhesive, by a bonding process involving heat or solvents, or with any other feature or by any other process that may securely join the top layer 1702 and the bottom layer 1708. The direct contact between the top layer 1702 and the bottom layer 1708 in the areas corresponding to the spaces between the fibers of the connecting web 1804 may enhance the feel and increase the apparent compressibility of the top layer 1702 during use, may increase the overall flexibility of the mat 1800, thereby improve its rolling and unrolling characteristics, and may enhance the adhesion between the top layer 1702 and the bottom layer 1708, thereby improving the overall durability of the mat 1800.

In the embodiment described in conjunction with FIG. 1, the mat 100 may be customized based on the user's requirements and preferences. It may be advantageous for the two grip zones proximate to each end of a mat to include characteristics that differ from one another. For example, the hands and feet may include different characteristics, including structure, shape, the ability to apply and tolerate load, pressure and friction, and need for stability. Accordingly, the grip zone characteristics advantageous for supporting, cushioning, stabilizing and providing traction for the hands may differ significantly from the grip zone characteristics advantageous for supporting, cushioning, stabilizing and providing traction for the feet.

Figure 19:
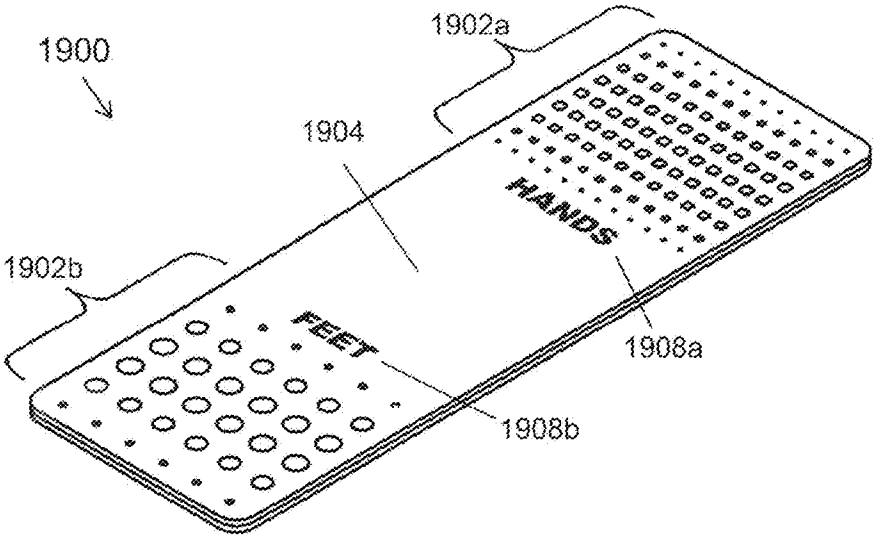
FIG. 19 depicts a perspective view of a mat, in accordance with various embodiments of the present disclosure.

FIG. 19 depicts a perspective view of a mat 1900, in accordance with various embodiments of the present disclosure. As shown in FIG. 19, the mat 1900 includes two grip zones 1902*a* and 1902*b* on its top surface 1904, each grip zone 1902*a* and 1902*b* having characteristics that differ from one another, in accordance with various embodiments of the present disclosure. Grip zone 1902*a* may be configured to provide enhanced support, cushioning, stabilization or traction, or any combination thereof, for the user's hands. A grip zone adapted for the hands may include a relatively more compressible top layer or bottom layer or grip columns to provide relatively more cushioning for the hands and fingertips. In an embodiment, grip zone 1902*a* may include grip columns with a Shore A durometer in the range of 10 to 45. Alternatively, the top surfaces of the grip columns may include larger edge radii for the relatively more sensitive hands and fingertips. In an embodiment, the top surfaces of the grip columns in grip zone 1902*a* may include edge radii in the range of 0.5 mm to 1.5 mm. Alternatively, a grip zone adapted for the hands may include more grip columns per unit area of grip zone so as to better engage with the user's fingers. In an embodiment, grip zone 1902*a* may include from 0.1 to 0.5 grip columns per square centimeter. Alternatively, a grip zone adapted for the hands may include grip columns with smaller top surfaces so as to better engage with the user's fingers.

In an embodiment, grip zone 1902*a* may include grip columns with top surfaces from 1 to 400 square millimeters in size. Alternatively, a grip zone adapted for the hands may include any combination of a relatively more compressible top layer or bottom layer or grip columns, or larger edge radii on the top surfaces of the grip columns, or more grip columns per unit area of grip zone, or grip columns with smaller top surfaces, or any combination of features and characteristics, such as grip zone size, shape or location, grip column size or shape, grip column number, grip zone pattern, grip column top surface profile, top layer or bottom layer material or characteristics, or grip column material, construction or compressibility, that enable the grip zone to provide a better combination of traction, cushion, support and stability for the hands. The grip column top surface profile may include ribs, indentations, raised areas, raised letters, indented letters, raised or indented numerals, raised or indented icons, raised or indented shapes, slopes, and the like. Grip zone 1902*b* may be configured to provide enhanced support, cushioning, stabilization or traction, or any combination thereof, for the user's feet. A grip zone adapted for the feet may include a relatively less compressible top layer or bottom layer or grip columns to provide relatively more stability for standing poses. In an embodiment, grip zone 1902*b* may include grip columns with a Shore A durometer in the range of 35 to 100.

Alternatively, the top surfaces of the grip columns may include smaller edge radii for relatively greater engagement and traction. In an embodiment, the top surfaces of the grip columns in grip zone 1902*b* may include top surface edge radii in the range of 0.1 mm to 0.75 mm. Alternatively, a grip zone adapted for the feet may include less grip columns per unit area of grip zone. In an embodiment, grip zone 1902*b* may include from 0.04 to 0.2 grip columns per square centimeter. Alternatively, a grip zone adapted for the feet may include grip columns with larger top surfaces. In an embodiment, grip zone 1902*b* may include grip columns with top surfaces from 10 to 2500 square millimeters in size. Alternatively, a grip zone adapted for the hands may include any combination of a relatively less compressible top layer or bottom layer or grip columns, or smaller edge radii on the top surfaces of the grip columns, or less grip columns per unit area of grip zone, or grip columns with larger top surfaces, or any combination of features and characteristics, such as grip zone size, shape or location, grip column size or shape, grip column number, grip zone pattern, grip column top surface profile, top layer or bottom layer material or characteristics, or grip column material, construction or compressibility, that enable the grip zone to provide a better combination of traction, cushion, support and stability for the feet. The top surface 1904 of the mat 1900 may include textual cues 1908*a* and 1908*b* proximate to the grip zones 1902*a* and 1902*b*, respectively, to indicate the proper orientation for using the mat 1900. Users may orient the mat such that the textual cues 1908*a* and 1908*b* are in the proper orientation for reading.

Alternatively, the top surface 1904 of the mat 1900 may include graphic symbols or diagrams, or may be color coded, or the grip zones 1902*a* and 1902*b* may include shapes or patterns, or any combination thereof, to indicate the proper orientation for using the mat 1900. The mat 1900 may provide enhanced overall performance because grip zone 1902*a* is uniquely configured for the user's hands and grip zone 1902*b* is uniquely configured for the user's feet.

A yoga mat with two different grip zone configurations may also allow a single mat to address the differing grip needs of advanced users as well as those of basic users. Advanced users may tend to support their upper body weight with particular portions of their hands, such as with their index fingers and thumbs, which may result in relatively higher localized pressures and relatively greater localized deformation of the mat. In contrast, basic users may tend to contact the mat more evenly with the palms and fingers of their hands, which may result in relatively lower localized pressures and relatively lower localized deformation of the mat. Advanced users may also tend to have greater flexibility, so that the soles of their feet may contact the mat when in certain yoga poses such as the one commonly known as the downward facing dog pose. This may result in lower localized pressures and lower localized deformation of the mat. In contrast, basic users may tend to have limited flexibility and therefore may tend to contact the mat with only their toes and the balls of their feet when in certain yoga poses such as the one commonly known as the downward facing dog pose. This may result in higher localized pressures and greater localized deformation of the mat. Because advanced users may tend to support their upper body weight with portions of their hands and basic users may tend to support their lower body weight with portions of their feet, and because both may result in relatively greater localized pressures and relatively greater localized deformation of the mat, a grip zone adapted for the hands of advanced users may also be well adapted for the feet of basic users.

A grip zone adapted for the hands of advanced users and for the feet of basic users may include a relatively larger number of grip columns or relatively smaller grip columns to increase the incidence of contact with grip edges, or the grip column surfaces facing the opposite grip zone may be concave to enhance engagement with portions of the hands and feet, or the top layer or the bottom layer or the grip columns may be relatively less compressible to accommodate greater contact pressure, or the top surfaces of the grip columns may be concave to better engage with portions of the hands and feet, or the top surfaces of the grip columns may include larger edge radii to accommodate greater contact pressure, or any combination thereof or any combination of features and characteristics that enable the grip zone to provide a better combination of fraction, cushion, support and stability for the hands of advanced users and the feet of basic users. Furthermore, because basic users may tend to support their upper body weight relatively more evenly with the palms and fingers of their hands, and advanced users may tend to support their lower body weight relatively more evenly with their feet, and because both may result in relatively lower localized contact pressures and relatively lower localized deformation of the mat, a grip zone adapted for the hands of basic users may also be well adapted for the feet of advanced users. A grip zone adapted for the hands of basic users and for the feet of advanced users may include a relatively smaller number of grip columns or relatively larger grip columns, or the top layer or the bottom layer or the grip columns may be relatively more compressible, or the grip column surfaces facing the opposite grip zone may be straight and normal to the direction of the opposite grip zone to enhance resistance to forces in the direction away from the opposite grip zone, or the top surfaces of the grip columns may be flat or convex to better engage with the palms and soles, or the top surfaces of the grip columns may include smaller edge radii to better engage with the surfaces of the palms or the soles, or any combination thereof or any combination of features and characteristics that enable the grip zone to provide a better combination of traction, cushion, support and stability for the hands of basic users and the feet of advanced users. Therefore, a mat with two different uniquely configured grip zones may provide benefits for advanced users when they use the mat oriented in one direction, and may also provide benefits for basic users when they use the mat oriented in the opposite direction.

Figure 20:
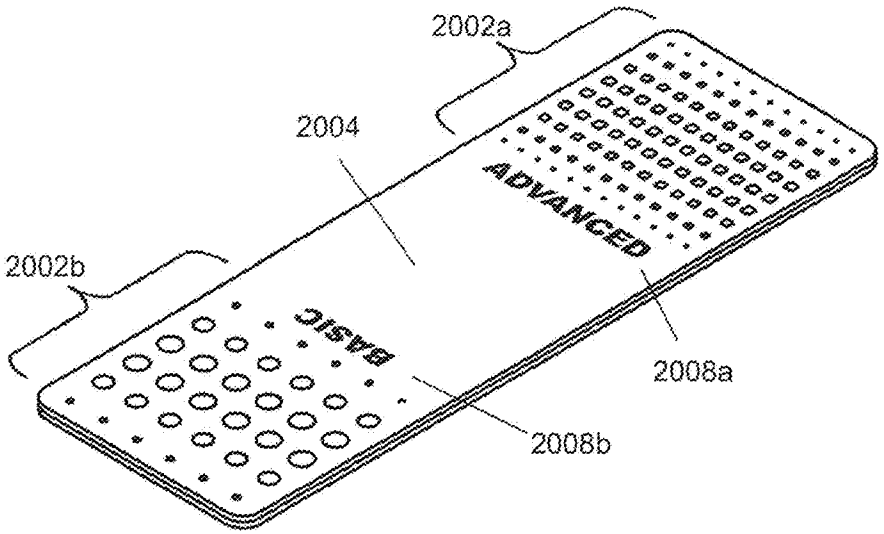
FIG. 20 depicts a perspective view of a mat, in accordance with various embodiments of the present disclosure.
Figure 22:
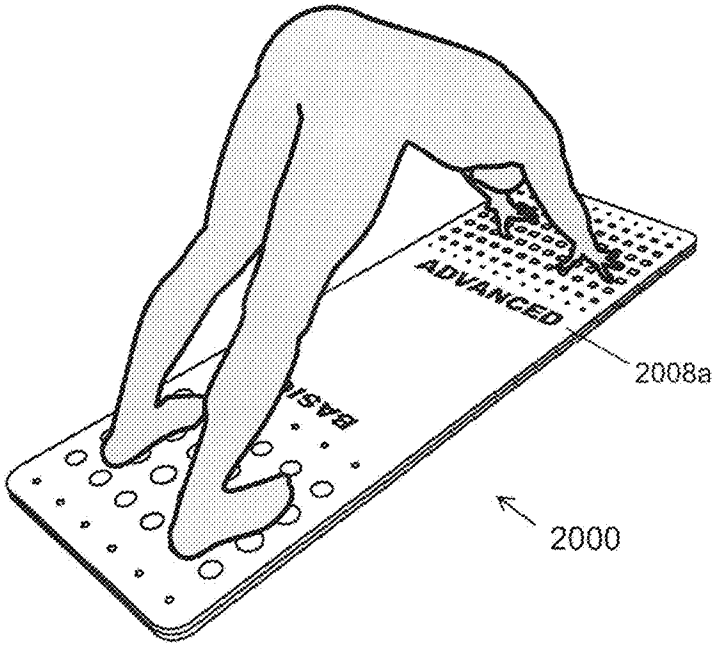
FIG. 22 depicts a perspective view of a mat being used in the proper orientation for advanced users, in accordance with various embodiments of the present disclosure.
Figure 21:
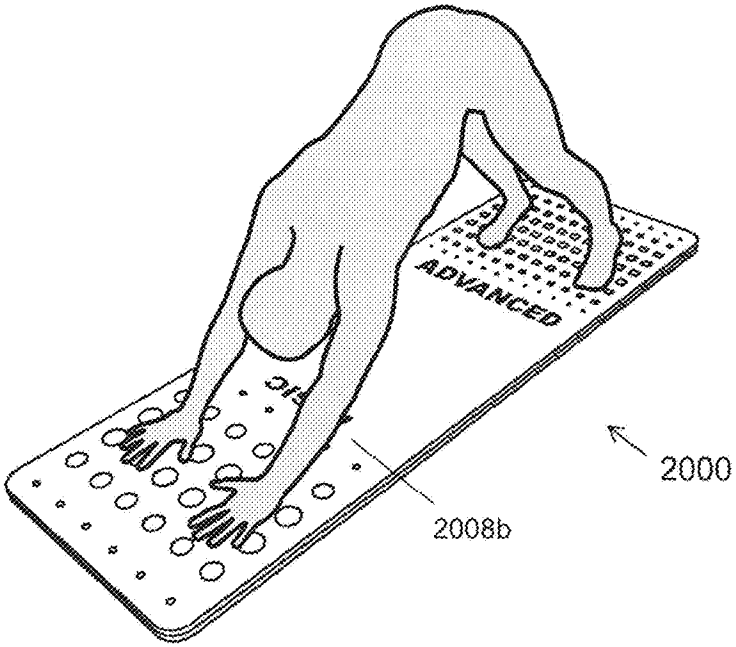
FIG. 21 depicts a perspective view of a mat being used in the proper orientation for basic users, in accordance with various embodiments of the present disclosure.

FIG. 20 depicts a perspective view of a mat 2000, and FIGS. 21 and 22 depict perspective views of the mat 2000 being used in the proper orientation for basic users and for advanced users, respectively, in accordance with various embodiments of the present disclosure. As shown in FIG. 20, the mat 2000 includes grip zones 2002*a* and 2002*b* on its top surface 2004, each grip zone 2002*a* and 2002*b* being configured differently from one another. Grip zone 2002*a* is configured for the hands of advanced users and for the feet of basic users, and grip zone 2002*b* is configured for the hands of basic users and for the feet of advanced users. In an embodiment, grip zone 2002*a* may include from 0.1 to 0.5 grip columns per square centimeter, or may include grip columns with top surfaces of 1 to 400 square millimeters in size, or may include grip columns with a Shore A durometer in the range of 35 to 100, or any combination thereof, and grip zone 2002*b* may include from 0.04 to 0.2 grip columns per square centimeter, or may include grip columns with top surfaces of 10 to 2500 square millimeters in size, or may include grip columns with a Shore A durometer in the range of 10 to 45, or any combination thereof. The top surface 2004 of the mat 2000 includes textual cues 2008*a* and 2008*b* proximate to the grip zones 2002*a* and 2002*b*, respectively, to indicate the proper orientation for use by advanced users and the proper orientation for use by basic users. As shown in FIG. 21, basic users may orient the mat such that they the textual cue for basic users 2008*b* is in the proper orientation for reading, and as shown in FIG. 22, advanced users may orient the mat such that the textual cue for advanced users 2008*a* is in the proper orientation for reading. Alternatively, the top surface 2004 of the mat 2000 may include graphical cues, or may be color coded, or the grip zones 2002*a* and 2002*b* may include shapes or patterns, or any combination thereof, to indicate the proper orientation for use by advanced users and the proper orientation for use by basic users.

Figure 23:
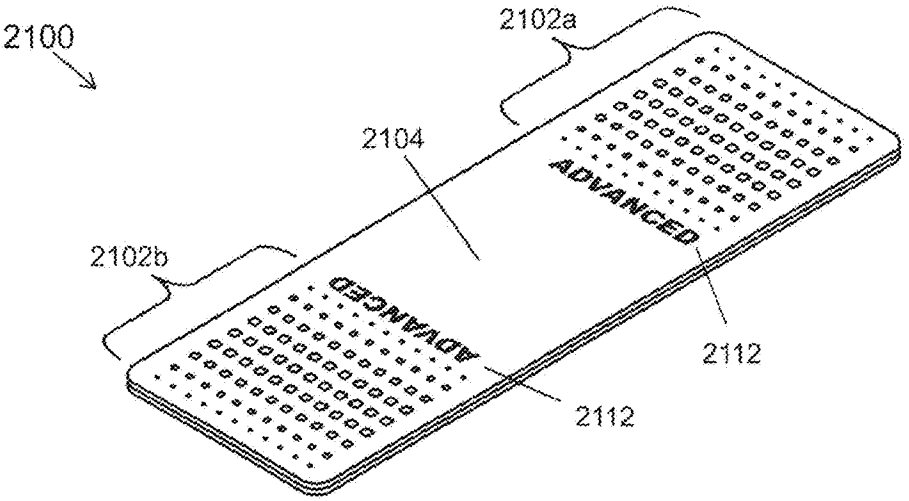
FIG. 23 depicts a top perspective view of a mat, in accordance with various embodiments of the present disclosure.
Figure 24:
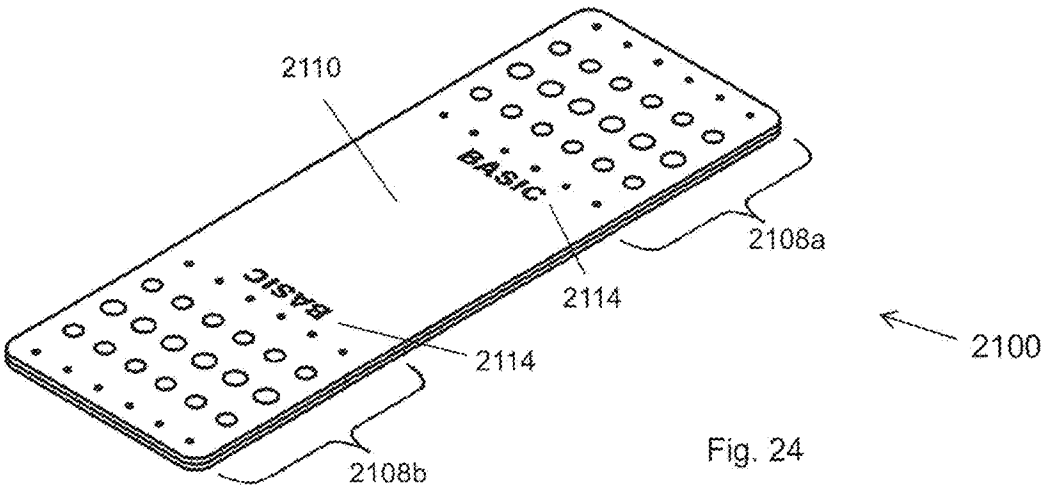
FIG. 24 depicts a bottom perspective view of a mat, in accordance with various embodiments of the present disclosure.

FIGS. 23 and 24 depict top and bottom perspective views, respectively, of an alternative mat 2100 that addresses the particular cushioning, traction and stability needs of two different types of users with a single yoga mat, in accordance with various embodiments of the present disclosure. As shown in FIGS. 23 and 24, the mat 2100 may include grip zones 2102*a* and 2102*b* on its top surface 2104 and grip zones 2108*a* and 2108*b* on its bottom surface 2110. The grip zones 2102*a* and 2102*b* on the top surface 2104 may be configured to provide optimal traction, cushion, support and stability for advanced users, whose hands and feet may experience relatively less discomfort due to extensive practice and who may benefit from greater traction when assuming more challenging yoga poses. Accordingly, grip zones 2102*a* and 2102*b* may include relatively less compressible top layers, bottom layers, or grip columns, or the top surfaces of the grip columns may include smaller edge radii to better engage with the surfaces of the hands and the feet.

In an embodiment, grip zones 2102*a* and 2102*b* may include grip columns with a Shore A durometer in the range of 35 to 100, or may include grips with top surface edge radii in the range of 0.1 mm to 0.75 mm, or a combination thereof, or any combination of features and characteristics, such as grip zone size, shape or location, grip column size or shape, grip column number, grip zone pattern, grip column top surface profile, top layer or bottom layer material or characteristics, or grip column material, construction or compressibility, that enable the grip zone to provide a better combination of traction, cushion, support and stability for advanced users. Grip zones 2108*a* and 2108*b* on the bottom surface 2110 are configured to provide optimal traction, cushion, support and stability for basic users, who may appreciate a relatively greater amount of comfort and cushioning. Accordingly, grip zones 2102*a* and 2102*b* may include relatively more compressible top layers, bottom layers, or grip columns, or the top surfaces of the grip columns may include larger edge radii to provide greater comfort.

In an embodiment, grip zones 2108*a* and 2108*b* may include grip columns with a Shore A durometer in the range of 10 to 45, or may include grips with edge radii in the range of 0.5 mm to 1.5 mm, or a combination thereof, or any combination of features and characteristics, such as grip zone size, shape or location, grip column size or shape, grip column number, grip zone pattern, grip column top surface profile, top layer or bottom layer material or characteristics, or grip column material, construction or compressibility, that enable the grip zone to provide a better combination of traction, cushion, support and stability for basic users.

The top surface 2104 and the bottom surface 2110 may each include one or more textual cues 2112 and 2114, respectively, to indicate the proper surface of the mat 2100 for use by advanced users and basic users, respectively.

In use, the advanced user would orient the mat 2100 such that the top surface 2104, with the one or more textual cues 2112 indicating the proper surface for use by advanced users, is facing upward, and the basic user would orient the mat 2100 such that its bottom surface 2110, with the one or more textual cues 2114, indicating the proper surface for use by basic users, is facing upward. Accordingly, the mat 2100 may provide optimal traction, cushion and stability for advanced users and for basic users. As shown in FIGS. 23 and 24, the grip zones 2102*a* and 2102*b* may be identical to one another and the grip zones 2108*a* and 2108*b* may be identical to one another. Alternatively, the grip zones 2102*a* and 2102*b* may each include different characteristics from one another, and the grip zones 2108*a* and 2108*b* may each include different characteristics from one another, for example to provide an optimal grip zone for the hands of advanced users, for the feet of advanced users, for the hands of basic users and for the feet of basic users, respectively. Alternatively, the mat 2100 could be configured to provide optimal traction, cushion and stability for two other types of users, such as smaller and larger users or lighter and heavier users, for example. It may also be readily understood that a mat with grip zones on both the top and bottom surfaces will include the added benefit of being less prone to slipping on the floor during use, as the grip zones on the side of the mat that is facing downwards may provide improved traction with the floor.

Figure 25:
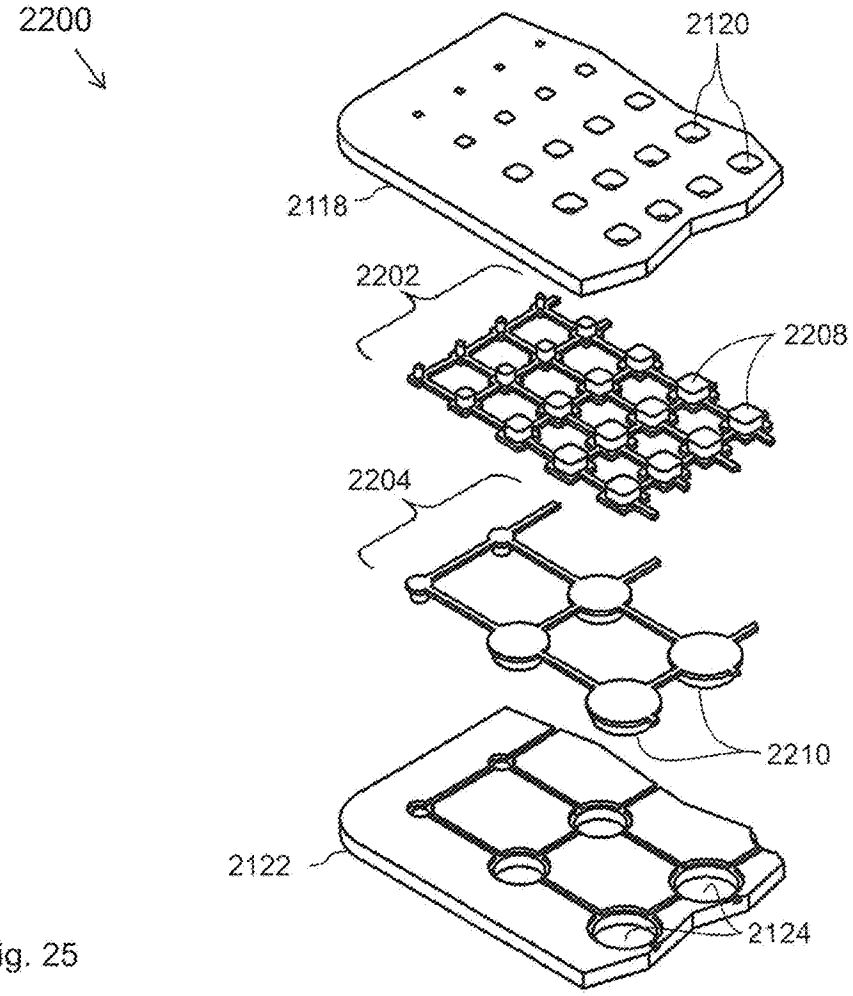
FIG. 25 depicts a perspective view of a layered engagement structure of the grip zones of a mat, in accordance with an embodiment of the present disclosure.

FIG. 25 depicts a perspective view of a layered engagement structure 2200 of a grip zone of a mat 2100, which can also be used in a reversible grip apparatus, in accordance with an embodiment of the present disclosure. As shown in FIG. 25, the structure includes a top layer 2118 with an array of openings 2120', a second layer such as a bottom layer 2122 with an array of openings 2124', a top grip component 2202 and a bottom grip component 2204, both molded or formed of an elastomer or a flexible polymeric material. The top grip component 2202 may include an array of columns 2208', and the bottom grip component 2204 may include an array of columns 2210'. The columns 2208 of the top grip component 2202 and the columns 2210 of the bottom grip component 2204 may include different characteristics, including column size or shape, top surface profile, material, construction or compressibility, or any combination thereof, that may enable the respective grip zones to provide better combinations of traction, cushion, support and stability for advanced users and basic users, respectively.

In an embodiment, grip columns 2208 of the top grip component 2202 may have a Shore A durometer in the range of 35 to 100, or may include top surface edge radii in the range of 0.1 mm to 0.75 mm, or a combination thereof, and grip columns 2210 of the bottom grip component 2204 may include a Shore A durometer in the range of 10 to 45, or may include top surface edge radii in the range of 0.5 mm to 1.5 mm, or a combination thereof. The columns 2208 of the top grip component 2202 and the columns 2210 of the bottom grip element 2204 are in configurations that facilitate in coupling the top grip component 2202 through the openings 2120 of the top layer 2118 and in coupling the bottom grip component 2204 through the openings 2124 of the bottom layer 2122, respectively. This layered mat configuration may provide grip zones with different grip characteristics on both the top surface 2104 and the bottom surface (not shown in this view) of the mat 2100.

Figure 26:
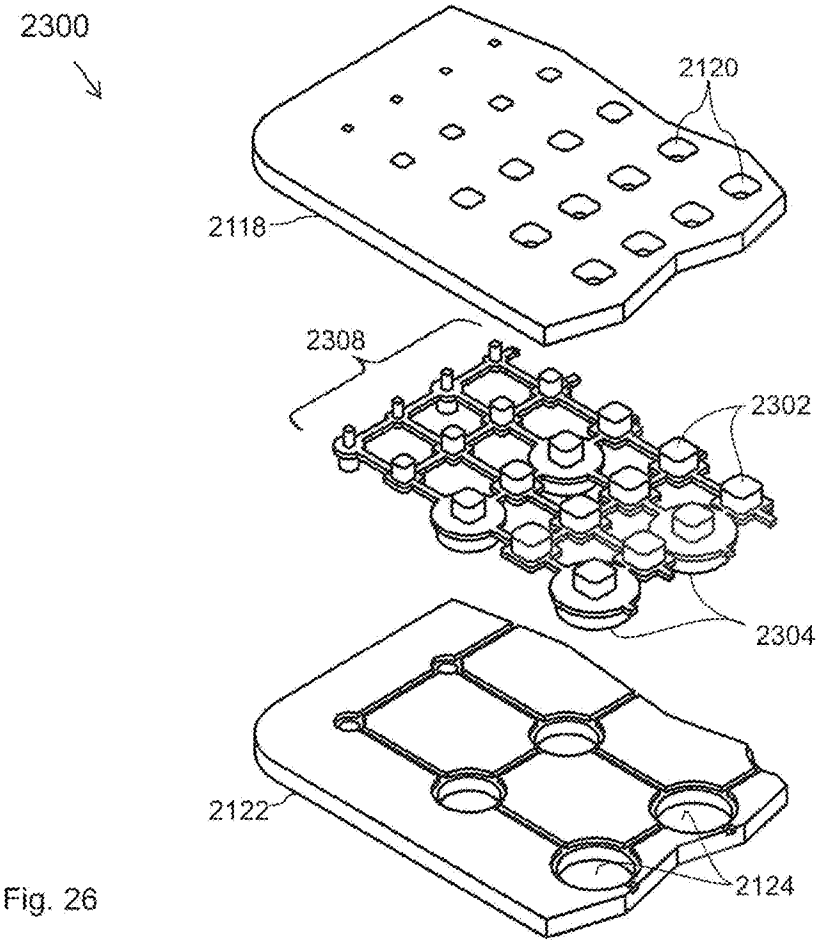
FIG. 26 depicts a perspective view of an alternative layered engagement structure of the grip zones of a mat, in accordance with an embodiment of the present disclosure.

FIG. 26 depicts a perspective view of an alternative layered engagement structure 2300 of a grip zone of a mat 2100, which can also be used in a reversible grip apparatus, in accordance with an embodiment of the present disclosure. As shown in FIG. 26, an array of top columns 2302 that correspond to the openings 2120 in the top layer 2118 and an array of bottom columns 2304 that correspond to the openings 2124 in the bottom layer 2122 are joined together in a combined grip component 2308, thereby reducing the number of components required to assemble the mat 2100 and simplifying its assembly. The top columns 2302 and the bottom columns 2304 of the combined grip component 2308 may include different characteristics, including column size or shape, top surface profile, construction or compressibility, or any combination thereof, that enable the respective grip zones to provide better combinations of traction, cushion, support and stability for advanced users and basic users, respectively. In an embodiment, top columns 2302 of the combined grip component 2308 may include a Shore A durometer in the range of 35 to 100, or may include top surface edge radii in the range of 0.1 mm to 0.75 mm, or a combination thereof, and bottom columns 2304 of the combined grip component 2308 may include a Shore A durometer in the range of 10 to 45, or may include top surface edge radii in the range of 0.5 mm to 1.5 mm, or a combination thereof.

Figure 27:
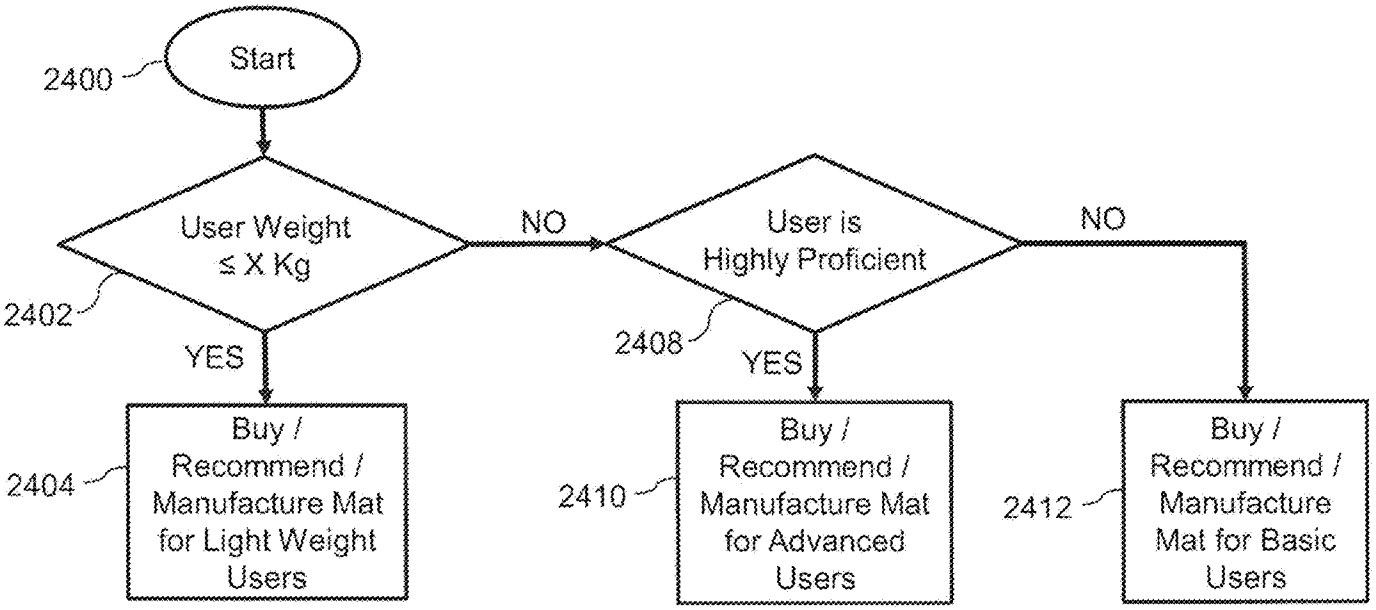
FIG. 27 depicts an exemplary procedure for selecting a yoga mat, in accordance with a seventh embodiment of the present disclosure.

With different yoga mat characteristics to select from, the manufacturer, the retailer and the user may need to identify a mat with the proper characteristics for a particular user. FIG. 27 depicts an exemplary procedure for selecting a yoga mat, in accordance with an embodiment of the present disclosure. As shown in FIG. 27, the outcome of the exemplary procedure is determined based on user weight and either self-reported yoga proficiency or yoga proficiency as determined by assessment, and may be followed by the manufacturer to determine which yoga mat variant to make, by the retailer to recommend to the user which yoga mat variant to buy, or by the user to determine which mat to buy.

In step 2400, the procedure may be initiated, and in step 2402, the users are classified as weighing less than or equal to a threshold weight such as 50 kilograms or weighing greater than a threshold weight such as 50 kilograms. In step 2404, users weighing less than a threshold weight such as 50 kilograms are recommended to purchase a mat configured to provide a better combination of traction, cushion, support and stability for lighter-weight users, as lighter-weight users may use less force to support their weight on the mat and they may need a mat with relatively more compressibility. A mat configured for lighter-weight users may include a relatively more compressible top layer or bottom layer or relatively more compressible grip columns or any combination thereof, or any combination of features and characteristics, such as grip zone size, shape or location, grip column size or shape, grip column number, grip zone pattern, grip column top surface profile, top layer or bottom layer material or characteristics, or grip column material, construction or compressibility, that enable the grip zone to provide a better combination of traction, cushion, support and stability for lighter-weight users.

In step 2408, users weighing more than a threshold weight, for example, 50 kilograms (110 pounds) are classified as highly proficient or not highly proficient. Self-reported proficiency may be assisted by the use of additional criteria such as the number of years that the user has been practicing yoga, the number of times per week the user practices yoga, and whether the user presses on the mat with the fingertips or with the palms and with only the toes or with the soles of the feet when in certain yoga poses such as the downward facing dog pose.

In step 2410, highly proficient users are recommended to purchase a mat configured to provide a better combination of traction, cushion, support and stability for advanced users. In step 2412, users who are not highly proficient are recommended to purchase a mat configured to provide a better combination of traction, cushion, support and stability for basic users. It should be readily understood that additional criteria, such as additional user weight thresholds, additional levels of proficiency, whether the user practices yoga techniques commonly referred to as hot yoga, may be added to the procedure, and that additional yoga mat variants may also be added to the options that the procedure may recommend.

Figure 28:
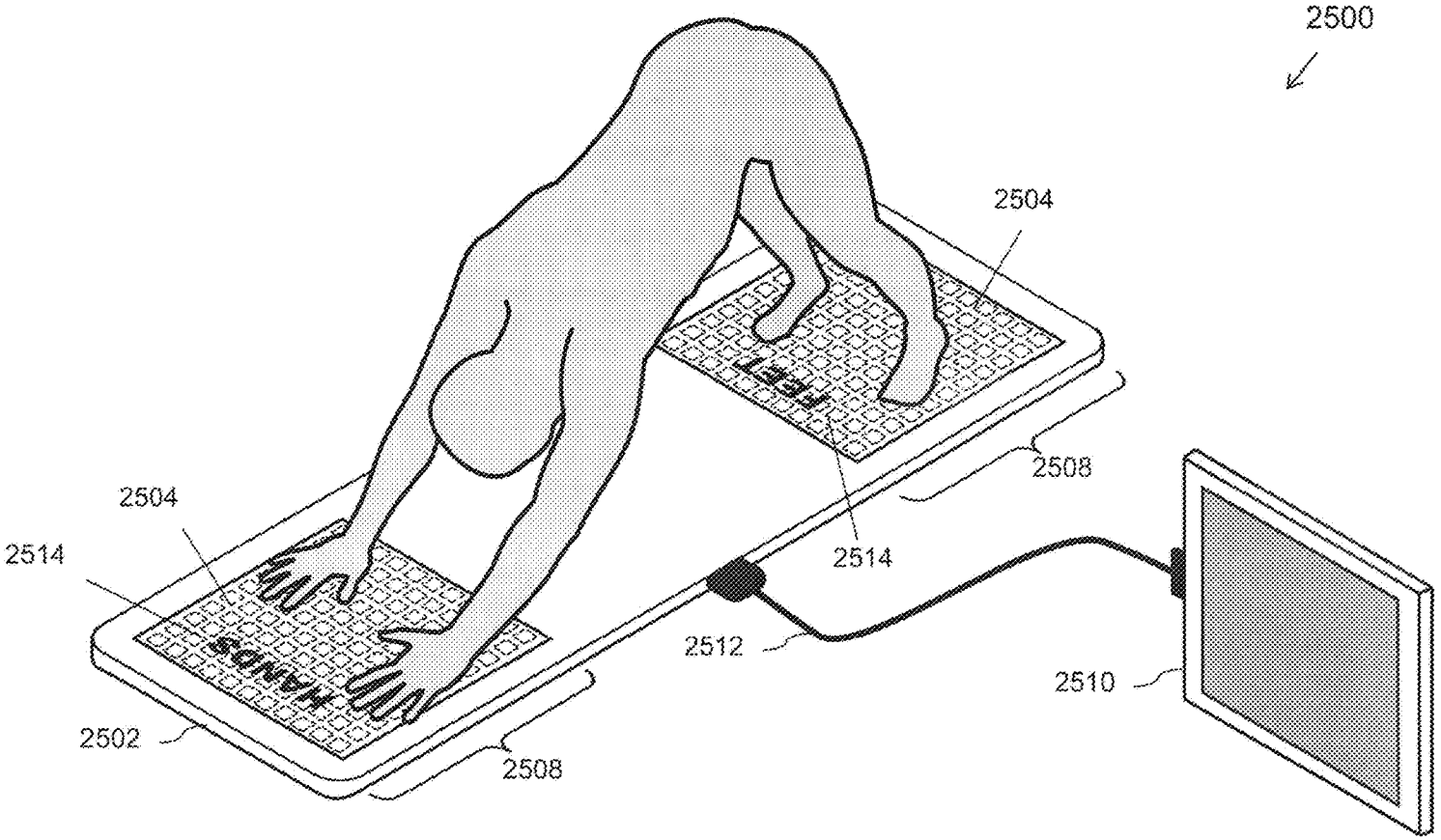
FIG. 28 depicts a perspective view of an apparatus, in accordance with an eighth embodiment of the present disclosure.

User-assessed proficiency may be subjective and may sometimes be inaccurate, and a more objective assessment that does not require the user, the retailer or the manufacturer to include expertise in assessing yoga proficiency may be desired. FIG. 28 depicts a perspective view of an apparatus 2500, in accordance with an embodiment of the present disclosure. As shown in FIG. 28, the apparatus 2500 may include a surface 2502 with at least one array of sensors 2504 within at least one sensor region 2508 with electrical connections to an electronic cable connector, a tablet computer 2510 with specific application software, and an electronic connection such as an electronic cable 2512 or a wireless connection such as a Bluetooth or a WiFi connection, between the at least one array of sensors 2504 and the tablet computer 2510. The surface 2502 may be the top surface of a yoga mat. Alternatively, the surface 2502 may be the top surface of a layer of material that approximates the characteristics of a yoga mat. The sensors may be affixed to the top of the surface 2502, or may be beneath the surface 2502, or may form part of the surface 2502. The sensors in the at least one array of sensors 2504 may detect forces normal to the surface 2502, or they may detect forces in the direction of the length of the surface 2502, or they may detect forces in the direction of the width of the surface 2502, or any combination thereof. Alternatively, the sensors may detect pressure. The at least one sensor region 2508 may include one or more textual or graphical cues 2514 to indicate the appropriate regions for the user's hands and feet.

Although the embodiment as shown in FIG. 28 includes a tablet computer 2510, it may alternatively be substituted with a smartphone, a personal computer, or any device or combination of devices that include at least one input device, at least one output device such as an electronic display device, and at least one electronic computational device with input/output, a processor, and memory or storage. The apparatus 2500 may also include a base and one or more housings or enclosures to contain, stabilize and secure the apparatus, but this is not required.

In operation, the tablet computer 2510 may prompt the user to input information such as their age, experience, gender, frequency of yoga practice and types of yoga practiced, into the tablet computer 2510, and may then prompt the user to assume one or more yoga poses on the surface 2502. The at least one array of sensors 2504 in the surface 2502 may measure both normal and tangential forces and pressures from the user's hands and feet, and communicates this information through the electronic cable 2512 to the tablet computer 2510, which may analyze the data from the at least one array of sensors 2504 and generate a pressure map of the at least one sensor region 2508, and, optionally, display this pressure map to the user. The tablet computer 2510 may alternatively or additionally use the data from the at least one array of sensors 2504 to detect if the user does not have their hands and feet within the at least one sensor region or if the user is wearing shoes, and the tablet computer 2510 may convey a message or messages instructing the user to remove their shoes or move their hands, feet or both hands and feet to within the at least one sensor region 2508. The tablet computer 2510 may then analyze the sensor data to determine the size of the user's palms, the span of the user's hands and feet, the user's overall weight, the relative loads on the user's hands and feet and the relative tangential forces compared to the relative normal forces, to determine if the user presses on the surface 2502 primarily with portions of the hand or with the entire hand when in certain yoga poses, to determine if the user presses on the mat primarily with the toes or with the entire soles of the feet when in certain yoga poses, to determine if the user has relatively well-developed core muscles, to determine if the user is relatively steady or unsteady when assuming the one or more yoga poses on the surface 2502, or to calculate any other measure or measures relevant to identifying the proper mat characteristics for the user.

The tablet computer 2510 may then use the analyzed data from the at least one array of sensors 2504, as well as the user-prompted information, in a decision-making process, such as the exemplary process shown in FIG. 28, to identify the yoga mat with the proper characteristics for the user, and may display this information to inform the user of the results. The apparatus 2500 may facilitate determination of an objective method for identifying a particular yoga mat with the specific proper characteristics for the particular user, and may facilitate purchase the proper yoga mat with confidence.

The principles described in the various embodiments may also be beneficial when applied to footwear such as shoes, socks, slippers, moccasins, slipper boots, dress footwear, casual footwear, tennis footwear, running footwear, work footwear, boots, sandals, thongs, sneakers, etc.

Figure 29A:
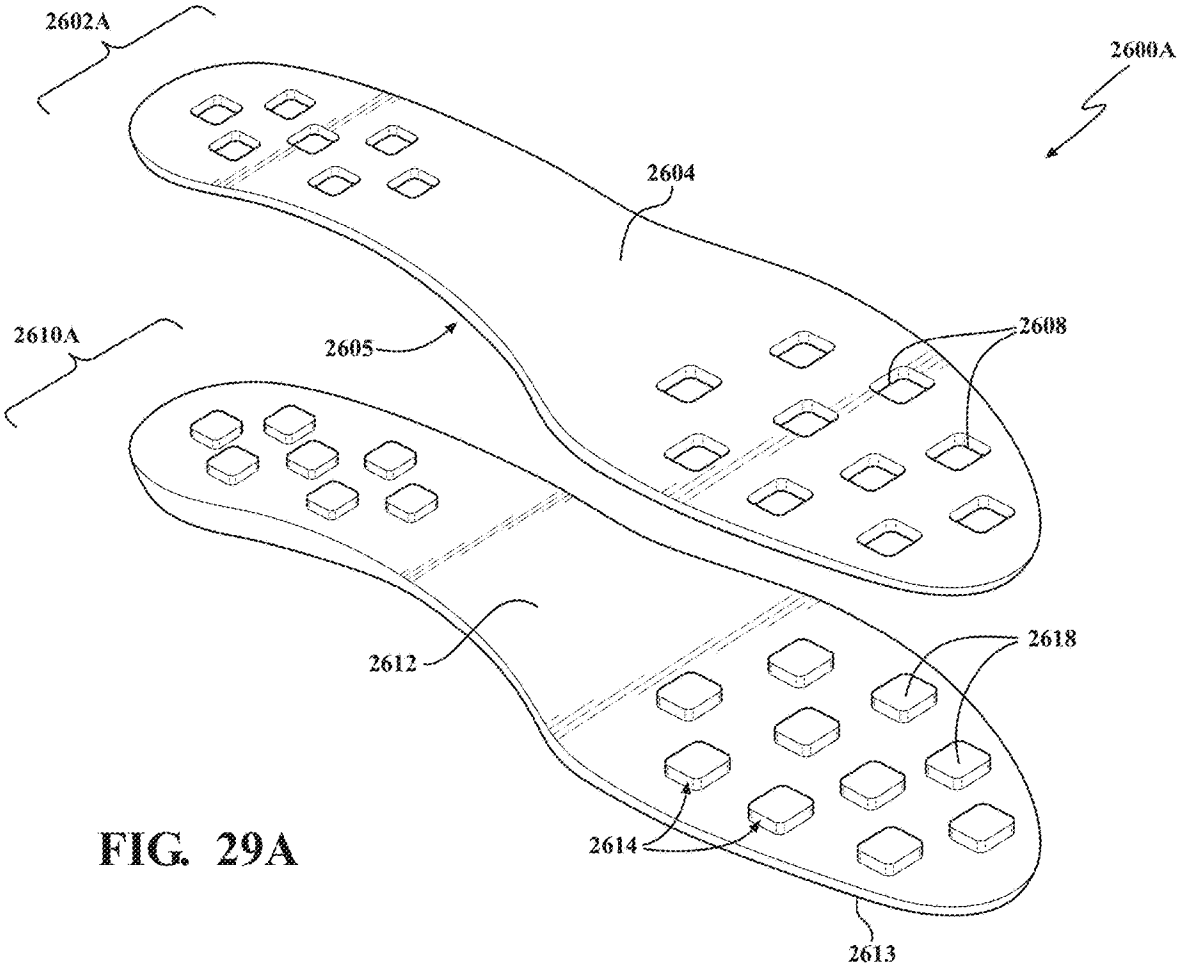
FIG. 29A depicts an exploded view of a layered engagement structure of a footwear insole, in accordance with an embodiment of the present disclosure.

With reference to FIG. 29A, a footwear insole 2600A may include a first layer 2602A and a second layer 2610A. The first layer 2602A may include a top surface 2604, a bottom surface 2605, and one or more arrays of one or more of openings 2608. The second layer 2610A may include a top surface 2612 and one or more arrays of one or more columns 2614 that correspond to the openings 2608 in the first layer 2602A.

In one disclosed non-limiting embodiment, the top surface 2612 of the second layer 2610A may define a relationship of about 0.003 to 25 columns 2614 per square centimeter and each of the columns 2614 may be from about 0.01 to 100 square centimeters in cross-sectional area. The columns 2614 may provide a cross-sectional shape that may be square, circular, trapezoidal, triangular, a shape representative of a logo, or together form a logo etc., as well as various combinations thereof.

Figure 29B:
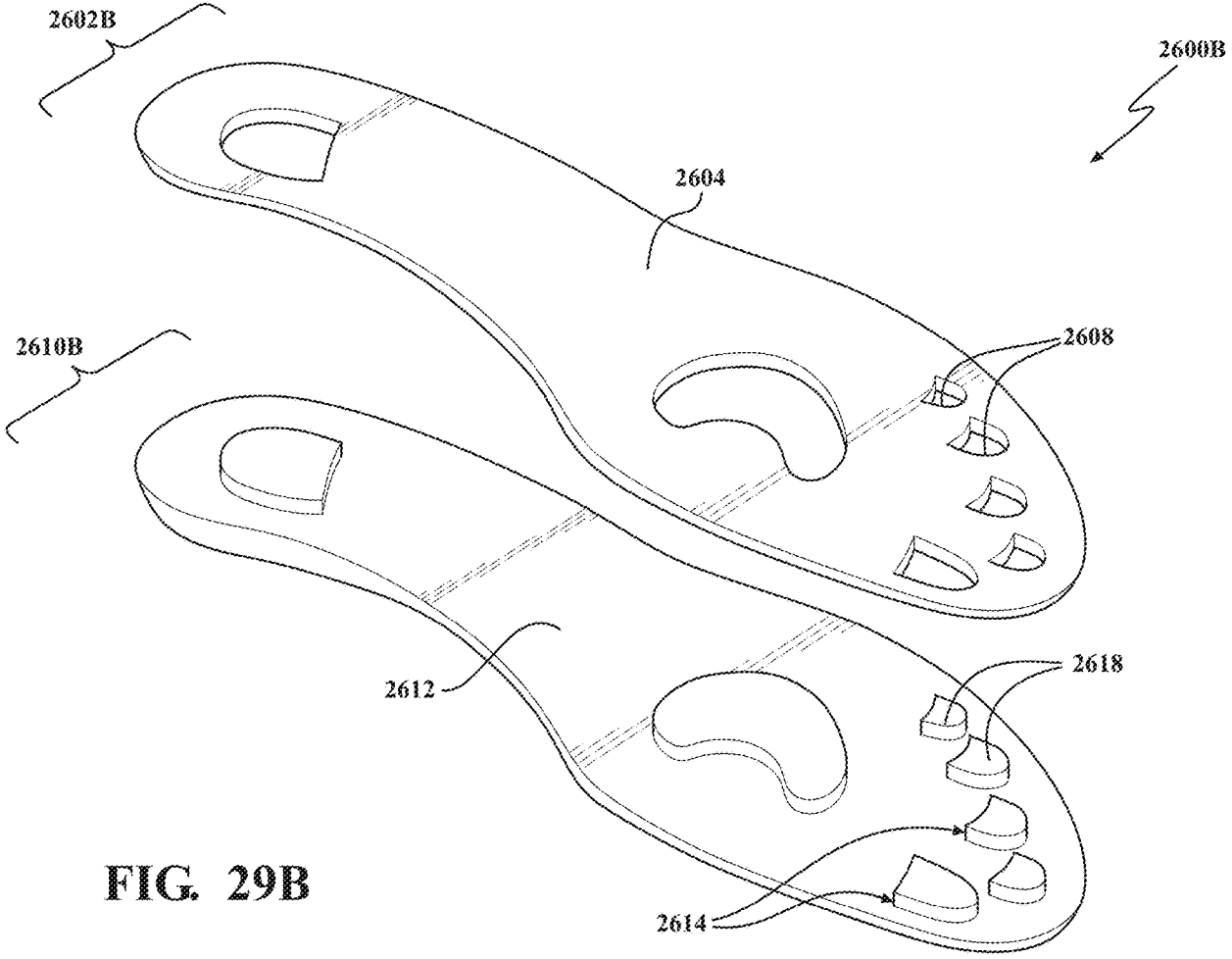
FIG. 29B depicts an exploded view of a layered engagement structure of a footwear insole, in accordance with an organic arrangement.

In another disclosed non-limiting embodiment, the columns 2614 may be of organic shapes and/or arrayed in organic patterns. For example, the organic shape may be that which correspond to various regions of the top surface 2604 of the first layer 2602, various regions of the user's foot (FIG. 29B), or other organic type relationships that may facilitate, for example, running, exercising, foot therapy, etc.

Figure 29C:
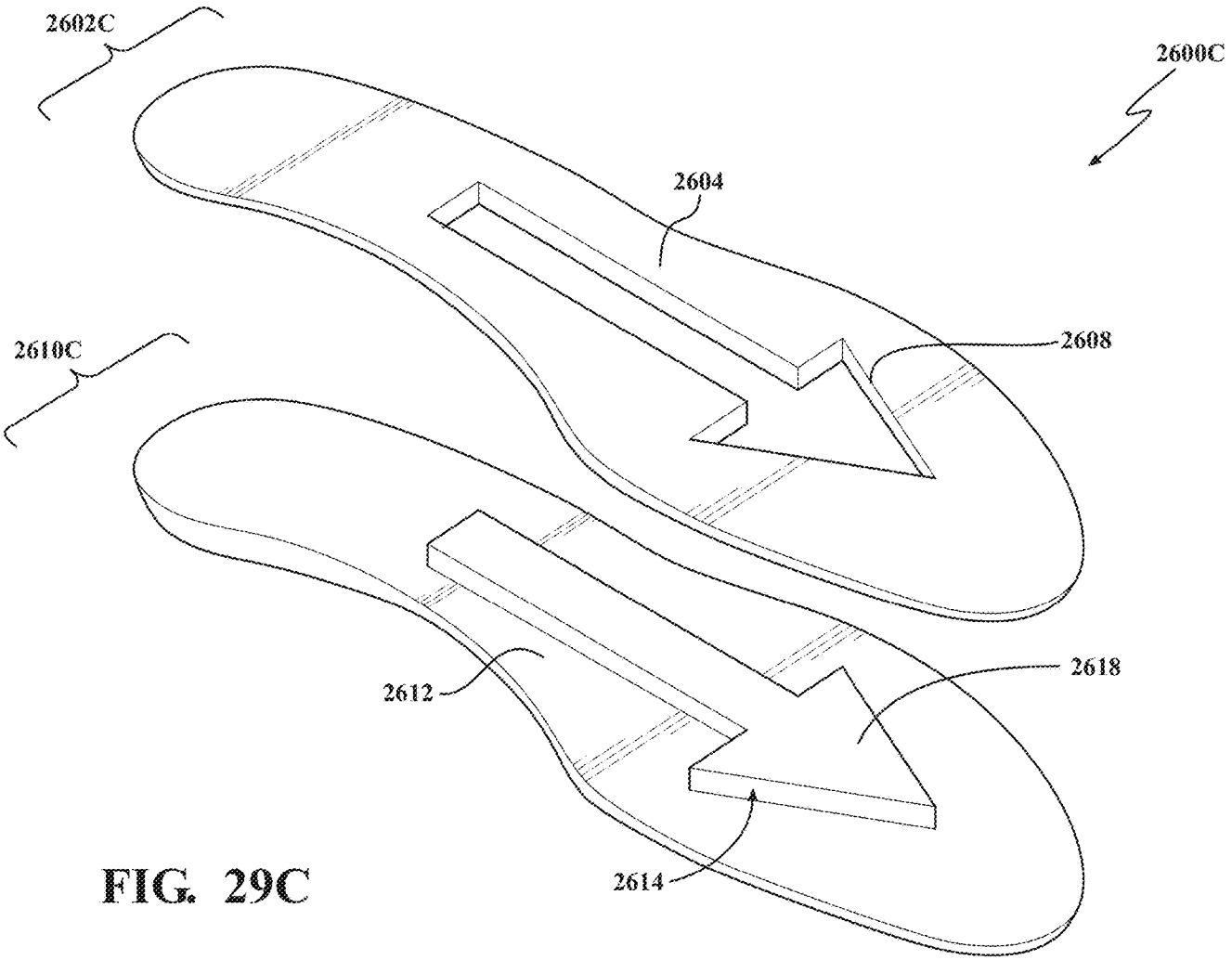
FIG. 29C depicts an exploded view of a layered engagement structure of a footwear insole, in accordance with a logo arrangement.

In another disclosed non-limiting embodiment, the columns 2614 may be shaped or arrayed to form a graphic such as a brand logo, image, or other shape (FIG. 29C). That is, the columns 2614 may be, for example, be individually square, circular, trapezoidal, triangular, but together in total, form a particular logo. It should be appreciated that any combination of geometric patterns, organic patterns, logos, and other arrangements may benefit herefrom. For example, each column 2614 may be a logo.

The first layer 2602A may be manufactured of a relatively compressible material such as Ethyl Vinyl Acetate ('EVA') or other elastomeric, or polymeric materials. The second layer 2610A may also be manufactured of a relatively compressible material such as EVA or other elastomeric or polymeric material. In contrast, the second layer 2610 may also be manufactured of relatively flexible, but relatively uncompressible material. For example, the columns 2614 may be manufactured of elastomer or other relatively compressible polymeric material, or may be manufactured of a natural flexible material such as leather or other flexible fiber, such as the flexible fibers 2912. In a particular example, the columns 2614 may have a Shore A durometer in the range of 10 to 100.

The columns 2614 may be attached to the second layer 2610 by adhesive, stitching, or other such attachment process. Alternatively, the second layer 2610 and the columns 2614 may be integrally formed from one piece by a process such as injection molding, stamping, or by any suitable forming process. Alternatively, the columns 2614 may be interconnected with a web (FIGS. 2 and 25) that may be mounted between the first layer 2602 and the second layer 2610. The web may be structural or non-structural in that the web serves only to arrange the columns 2614.

Figure 29D:
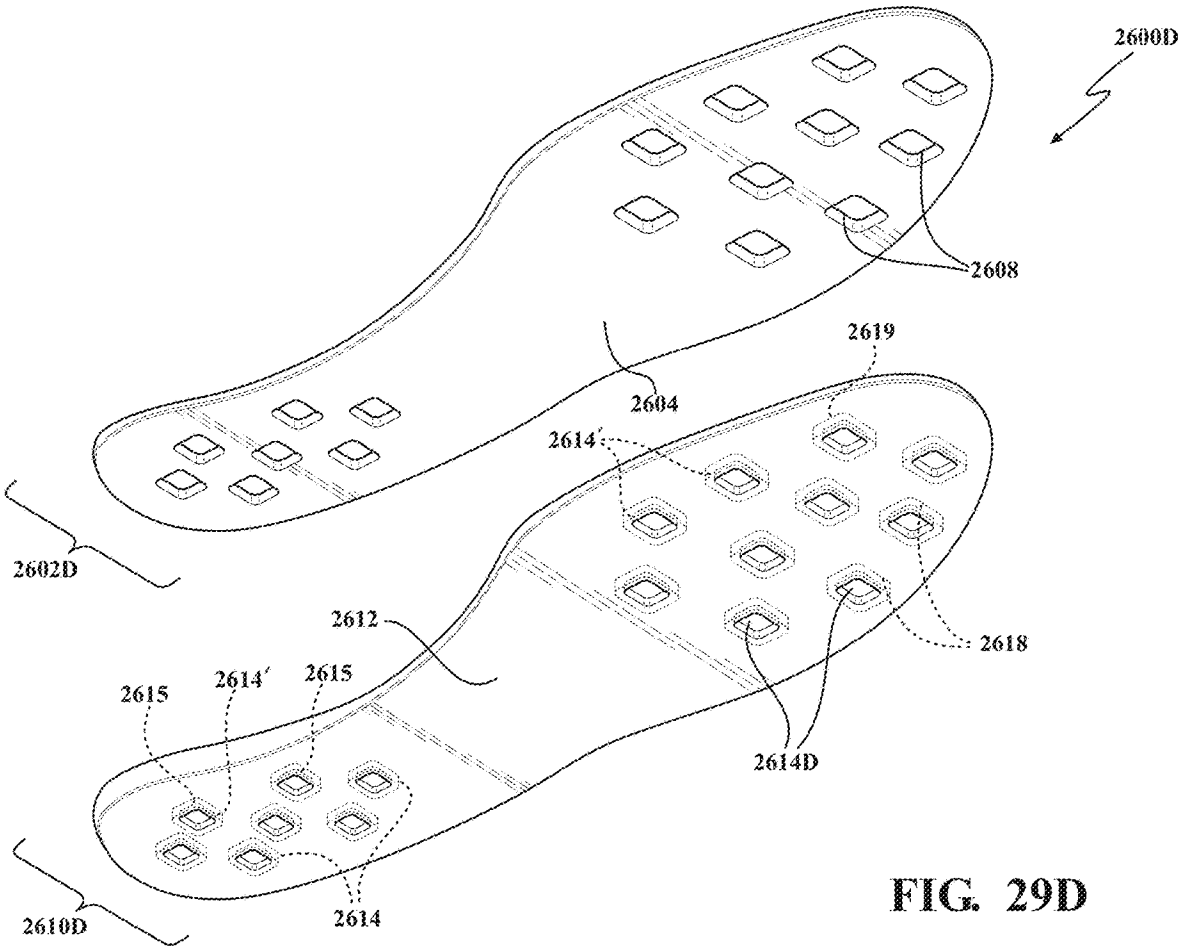
FIG. 29D depicts an exploded view of a layered engagement structure of a footwear insole, in accordance with another disclosed non-limiting embodiment of the present disclosure.

In another disclosed non-limiting embodiment, one or more of the columns 2614A may include one or more hollow regions 2615 (FIG. 29D). The one or more of the columns 2614D may, for example, enhance compressibility and or receive an insert to provide a more rigid support. That is, the hollow regions 2615 may be empty or serve to receive another material or element.

When the first layer 2602 is mounted on the second layer 2610, the top surfaces 2618 of the columns 2614 may include edge radii in the range of 0.1 mm to 1.5 mm and be arranged to align with the top surface 2604 of the first layer 2602. The second layer 2610 arranges the columns 2614 in a configuration that facilitates coupling the columns 2614 through the bottom surface 2605 of the first layer 2602 such that the columns 2614 are received for independent movement within the corresponding openings 2608 of the first layer 2602. The columns 2614 may be located on specific regions of the footwear insole 2600 to optimize impact reduction, stability, comfort, gripping action, massaging action, pressure point stimulation, propriocentric feedback, or any combination thereof, on the related specific regions of the user's foot. To further facilitate engagement with the sole of the user's foot, the top surfaces 2618 of the columns 2614 may be convex, concave and/or may include additional features such as dimples, ribs, protuberances, or any combination thereof, to, for example, facilitate engagement with the sole of the user's foot.

Figure 29E:
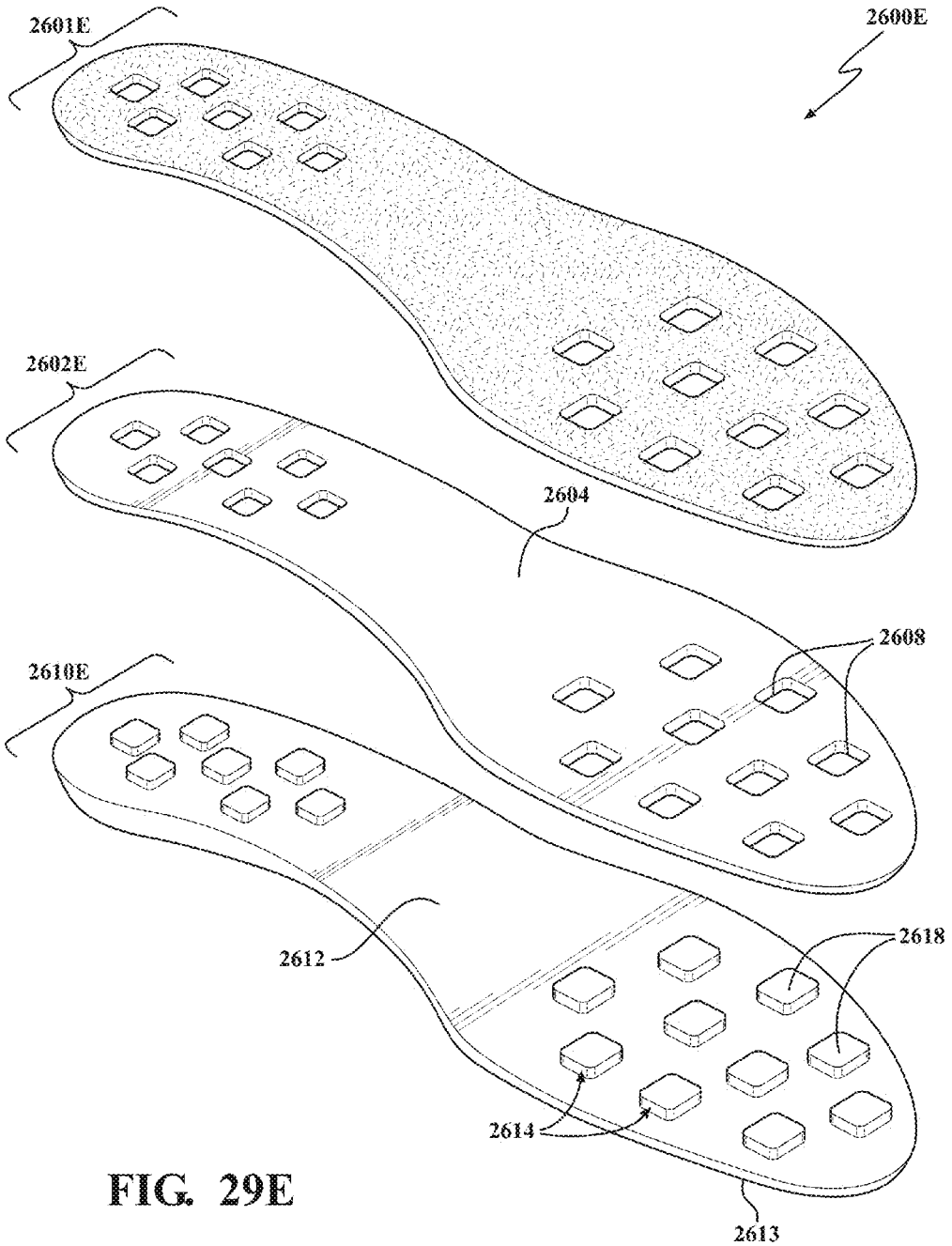
FIG. 29E depicts a an exploded view of a layered engagement structure of a footwear insole, in accordance with another disclosed non-limiting embodiment of the present disclosure.

In another disclosed non-limiting embodiment, a third layer 2601E (FIG. 29E) of wear-resistant material, with openings that corresponding to the openings 2608 in the first layer 2602, may overlay and be attached to the top surface 2604 of the first layer 2602, to, for example, provide improved durability to the footwear insole 2600. The third layer 2601E may be more compressible than the columns 2614.

In another disclosed non-limiting embodiment, the bottom surface 2605 of the first layer 2602, and the top surface 2612 of the second layer 2610, may be secured together in areas of direct contact, via, for example, an adhesive, a bonding process involving heat or solvents, or with any other feature or process that can secure the first layer 2602 and the second layer 2610. Alternatively, the first layer 2602 and the second layer 2610 may be formed together in a two-material molding process, an insert molding process, or a casting process wherein the first layer 2602 may be molded or cast directly onto the top surface 2612 of the second layer 2610, or the first layer 2602. The first layer 2602, the second layer 2610, and the columns 2614 may alternatively be formed together in a three-material molding or casting process, or by any other process that may form columns 2614 directly onto the second layer 2610, and the first layer 2602 directly onto the second layer 2610, or by any other process that may securely join the first layer 2602, the second layer 2610, and the columns 2614.

The footwear insole 2600 may be permanently attached to the footwear midsole, the footwear outsole, or the footwear upper via, for example, an adhesive, a bonding process involving heat or solvents, stitching, a two-material, a three-material molding process, an insert molding process, a casting process, or with any other feature or process that may securely join the footwear insole 2600 to the midsole, outsole, or upper, of the footwear.

Alternatively, the footwear insole 2600 may be removably attached to the midsole, outsole, or upper of the footwear by friction fit, gravity, or by any other feature that may removably attach the footwear insole 2600 to the footwear. The bottom surface 2613 of the second layer 2610 of the footwear insole 2600 may form the ultimate bottom surface of the footwear that contacts the ground.

In operation of the footwear insole 2600, the sole of the user's foot may interface with the top surface 2604 of the first layer 2602, and with the top surfaces 2618 of the columns 2614, either through direct contact or, if the user is wearing socks, through indirect contact. The interface applies pressure on the top surface 2604 of the first layer 2602 such that the pressure may vary locally by region of the foot and also may vary based on the user's movement, e.g., walks, runs, jumps, exercises, etc. In embodiments, the first layer 2602 and/or one or more of the multiple of columns 2614 may have a tailored compressibility appropriate for the associated region of the foot. That is, the columns 2614 may not all have the same compressibility.

In response to localized pressure on the footwear insole 2600 exceeding a threshold value, such as that which may be caused by a particular user motion, e.g., walk, run, jump, etc., the first layer 2602 may compress more than the columns 2614, which relatively increases the engagement of the columns 2614 with the sole of the user's foot. This may result in a relative decrease in slippage between the user's foot and the footwear. Alternatively, the increased engagement of the columns 2614 with the sole of the user's foot may provide impact reduction, increased stability, increased comfort, a massaging action, may stimulate specific beneficial pressure points on the sole of the foot, and/or may provide propriocentric cues through engagement with the sole of the foot. The propriocentric cues may, for example, remind the user to apply less force or impact on the heel, to avoid over-pronation, to discourage excessive force, impact and/or other motion on any other region of the foot in response to the particular user motion, e.g., walk, run, jump, etc.

Figure 29F:
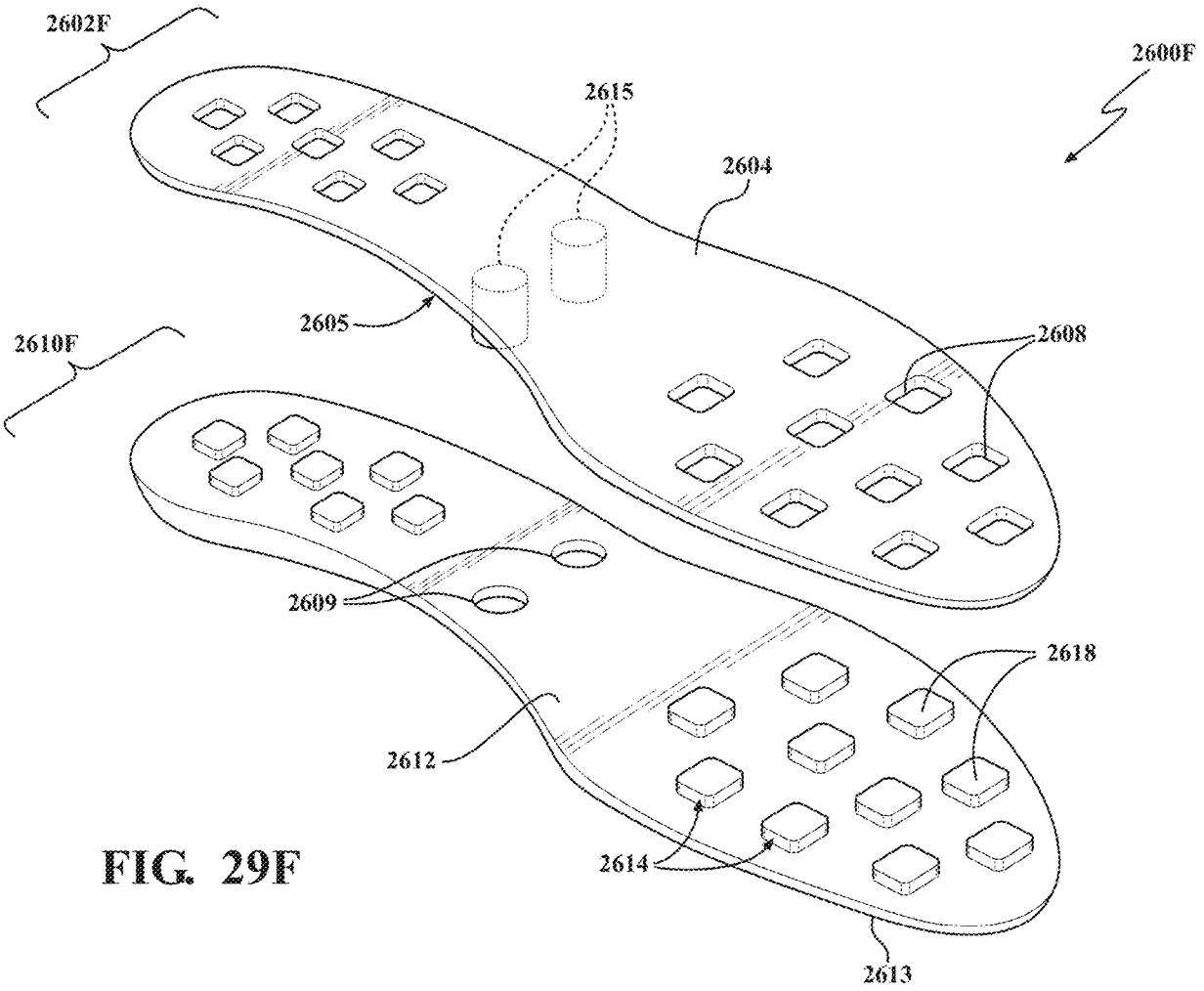
FIG. 29F depicts an exploded view of a layered engagement structure of a footwear insole, in accordance with another disclosed non-limiting embodiment of the present disclosure.

With reference to FIG. 29F, in another disclosed non-limiting embodiment, while the footwear insole 2600 is described as having columns 2614 protruding from the top surface 2612 of the second layer 2610 and engaging with the sole of the user's foot, configurations may alternatively or additionally locate columns 2615 to protrude from the bottom surface 2605 of the first layer 2602, and to engage corresponding openings 2609 through the second layer. Such a configuration may provide improved engagement and reduced slipping between the footwear insole and the midsole.

Figure 29G:
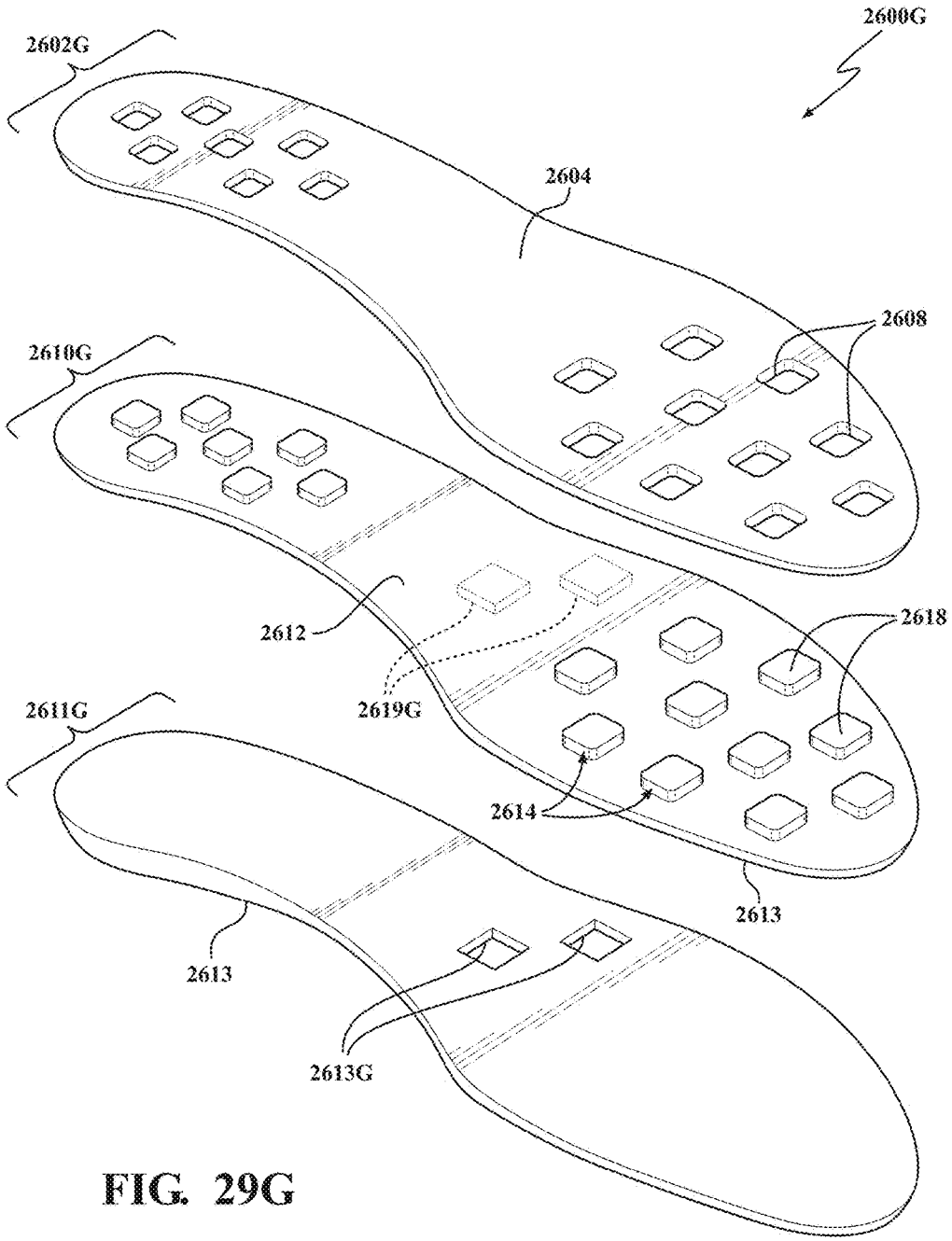
FIG. 29G depicts an exploded view of a layered engagement structure of a footwear insole, in accordance with another disclosed non-limiting embodiment of the present disclosure.

With reference to FIG. 29G, in another disclosed non-limiting embodiment, the footwear insole 2600G may include columns 2618 protruding upwardly from the top surface 2612 of a center layer 2610G through openings 2608 in a top layer to engage with the user's foot, and columns 2619G that extend downwardly from the bottom surface of the center layer 2610 G through openings 2613G in a bottom layer 2611 to engage the footwear midsole. The bottom surface of the second layer 2611G of this configuration may also form the bottom surface 2613 of the footwear, wherein the columns protruding both upwardly and downwardly from the center layer may engage with both the user's foot and the ground.

Figure 29H:
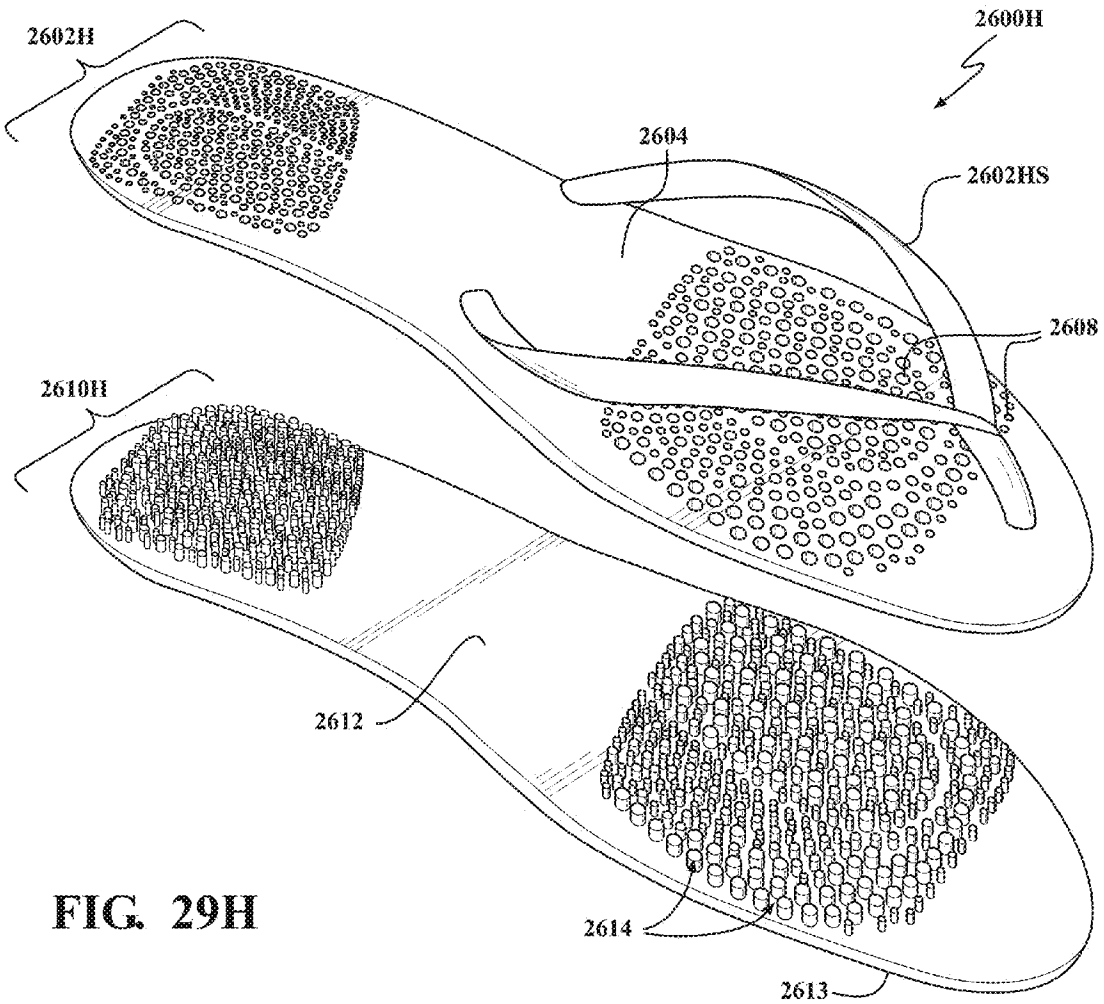
FIG. 29H depicts an exploded view of a layered engagement structure of a flip-flop type sandal, in accordance with another disclosed non-limiting embodiment of the present disclosure.

With reference to FIG. 29H, in another disclosed non-limiting embodiment, the footwear insole 2600H may form a flip-flop type sandal. A multiple of columns 2618 that together form a graphic that protrudes upwardly from the first layer 2610H through respective openings 2608 in a top layer 2602H to engage with the user's foot. Straps 2602HS, or other thong type engagement structure that are engaged by a user's foot and or toes extend from the top layer 2602H. The straps 2602HS may also engage the first layer 2610H, or be otherwise secured thereto or between the top layer 1602H and the first layer 2610H. The bottom surface of the first layer 2610H of this configuration may also form the bottom surface 2613 of the footwear. The bottom surface 2613 may be smooth or otherwise include various traction features. Further, the columns may protrude both upwardly and downwardly to engage with both the user's foot and the ground as illustrated, for example, in FIG. 29G.

In embodiments, the insole 2600 may function as, or be modified to become, a removable orthotic insert that covers the entire footwear insole, or only a select portion or portions of the insole. Such a removable orthotic insert may be readily received into different brands and types of footwear to provide benefits as described for the insole 2600.

Figure 30:
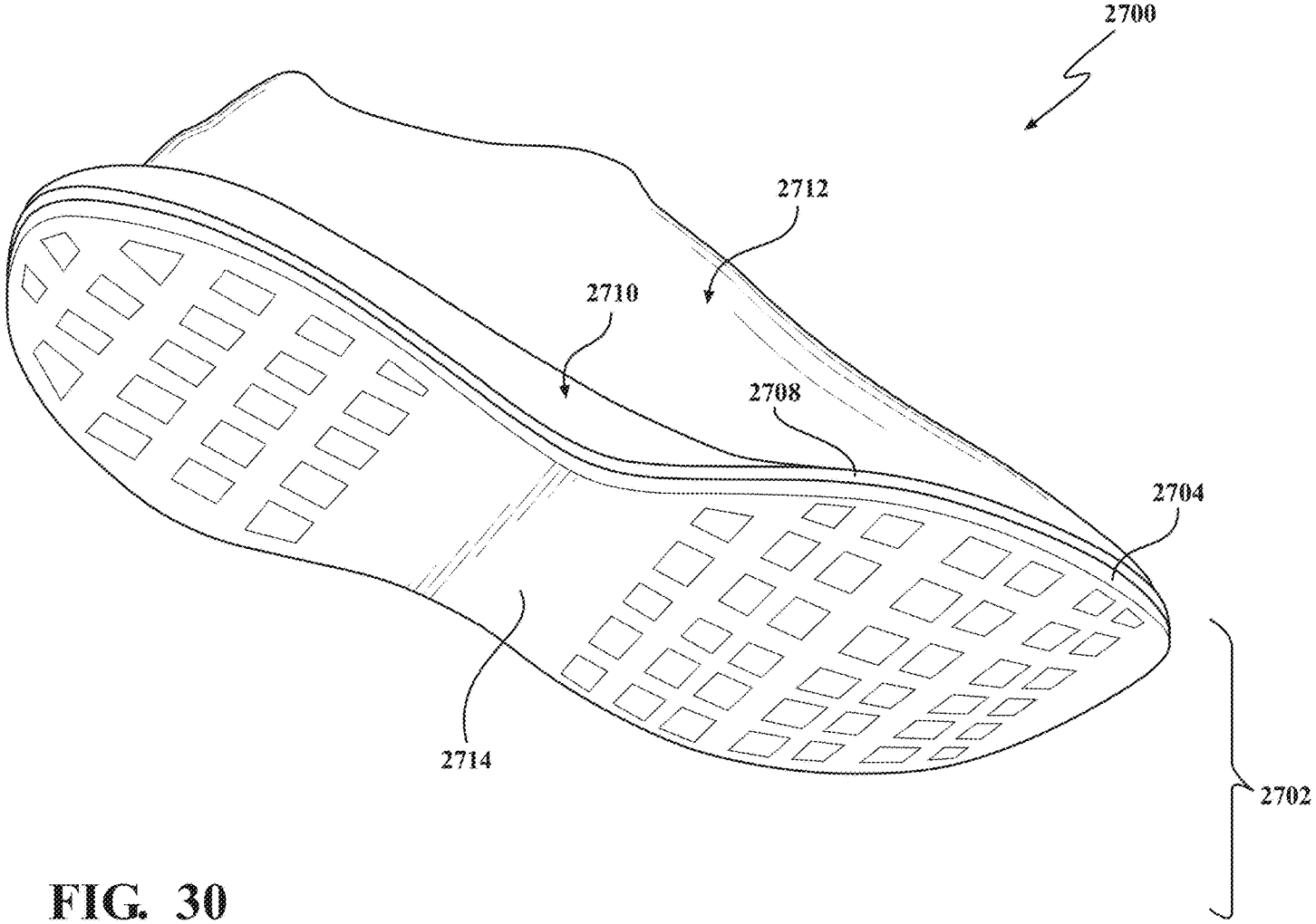
FIG. 30 depicts a perspective view of the underside of a shoe, in accordance with an embodiment of the present disclosure.

With reference to FIG. 30, a perspective view of a sole of a shoe 2700, in accordance with another disclosed non-limiting embodiment of the present disclosure may include an outsole 2702 with a first layer 2704, and a second layer 2708. It should be appreciated that the shoe 2700 is merely an illustrated example, and various, shoes, boots, slippers, sandals, and other footwear will also benefit herefrom. In embodiments, the outsole 2702 may be attached to a midsole 2710 that may be attached to an upper 2712. Alternatively, the shoe 2700 may not include a midsole, such that the second layer 2708 may be attached to the upper 2712. In other embodiments, the outsole may attach to the exterior of a shoe such as with an adhesive or other bonding mechanism, a friction fit, an elastic, a material that enables removable placement of the outsole over a shoe such as in a galosh or overshoe arrangement, or the like. It should be appreciated, however, that various footwear constructions will benefit herefrom.

Figure 31A:
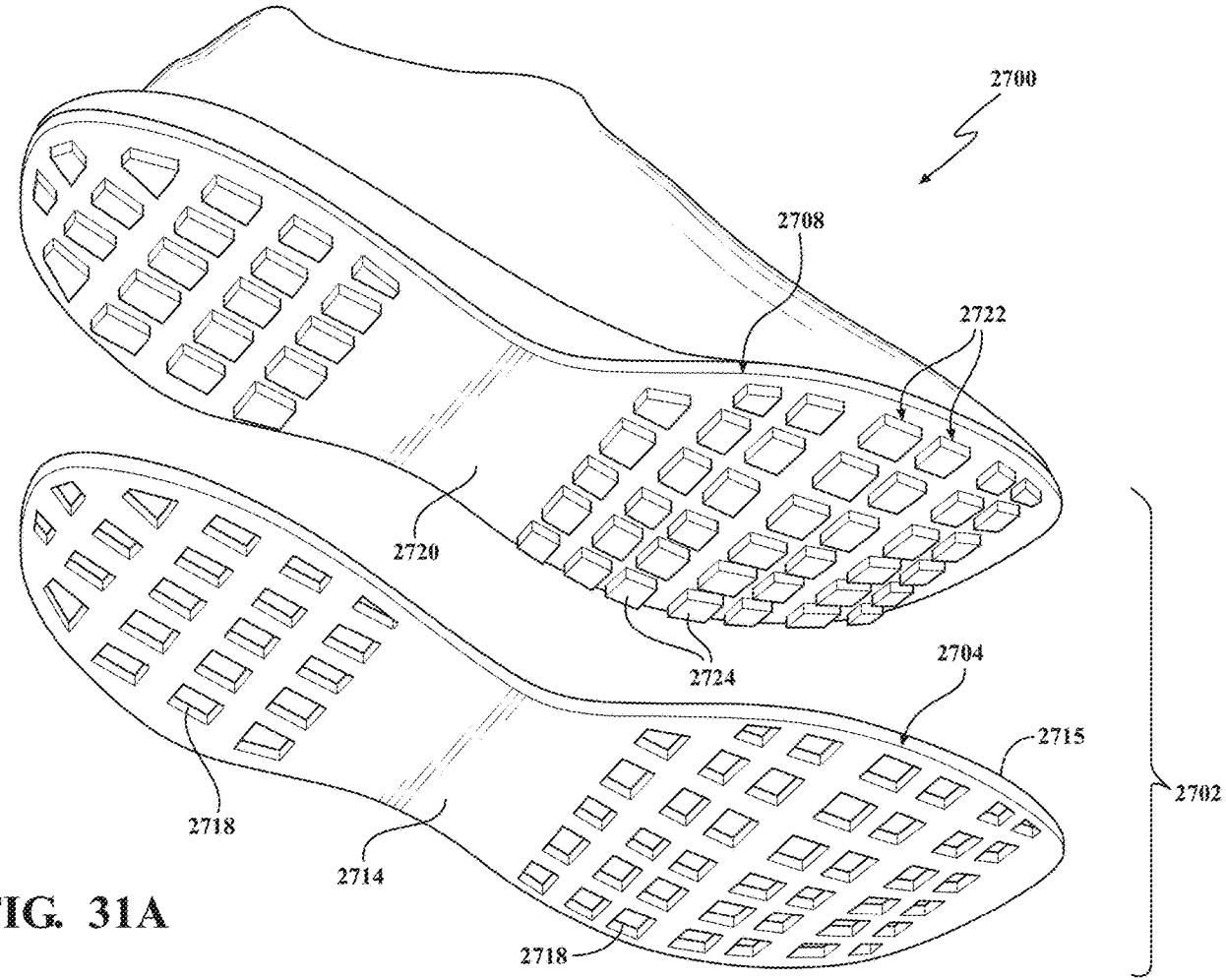
FIG. 31A depicts a perspective view of the underside of the shoe, in accordance with an embodiment of the present disclosure.

With reference to FIG. 31A, an exploded view of the sole 2702 with the first layer 2704 of the outsole 2702 schematically illustrated as separated from the second layer 2708 is illustrated. The first layer 2704, in this disclosed non-limiting embodiment, may include a bottom surface 2714, a top surface 2715, and one or more arrays of one or more openings 2718. The bottom surface 2714 is the ultimate bottom surface that is in contact the ground.

The second layer 2708 may include a bottom surface 2720 and one or more arrays of one or more columns 2722 that correspond to the openings 2718 in the first layer 2704 and protrude from the bottom surface 2720 of the second layer 2708. In one example, the bottom surface 2720 of the second layer 2708 may define a relationship of about 0.003 to 25 columns 2722 per square centimeter and each of the columns 2722 may be about 0.01 to 100 square centimeters in area.

As described above with regard to the embodiments represented by FIGS. 29A-29G, the sole 2702 may be may be manufactured of materials of particular types and in particular configurations such as those described above, and the columns 2722 may be of various cross-sectional shapes, may be organically arranged with respect to the shape of the user, and/or arrayed to form a brand logo, graphic, image, etc. The sole 2702, as described above, may also include a third, or greater number, of layers as well as, or alternatively include a web (FIGS. 2 and 25) as a separate component from the second layer 2708, that may be mounted between the first layer 2704 and the second layer 2708. Although the different non-limiting embodiments include specific illustrated components, the embodiments are not limited to those particular combinations and it is possible to use some of the components or features from any of the non-limiting embodiments in combination with features or components from any of the other non-limiting embodiments, e.g., those from the insole 2600 may be utilized with the sole 2702, and vice-versa.

In operation, the bottom surface 2714 of the first layer 2704 and the bottom surfaces 2724 of the columns 2722 engage with the ground. The term "ground" as utilized herein includes any affected surfaces such as a deck, floor, turf, cement, etc. Pressure from the user's foot may transmit through the second layer 2708 and the first layer 2704 to the ground in a localized manner by region of the foot and also may vary as the user moves, e.g., walks, runs, jumps, etc. When the pressure on a region of the first layer 2704 exceeds a threshold value, the first layer 2704 in that region may compress more than the columns 2722 in that region, thereby increasing the engagement of the columns 2722 in that region with the ground, to, for example, increase the amount of grip between the outsole 2702 and the ground, increase stability, reduce impact, increase comfort, or any combination thereof.

Alternatively, the first layer 2704 of the outsole 2702 may include low friction properties, such that the outsole 2702 may provide a combination of relatively higher traction when pressure is applied locally, for example in the toe or heel areas, and relatively lower traction, or sliding, when pressure is applied evenly. This combination may be beneficial for certain activities such as dancing, indoor racquet sports, bowling, etc.

Figure 31B:
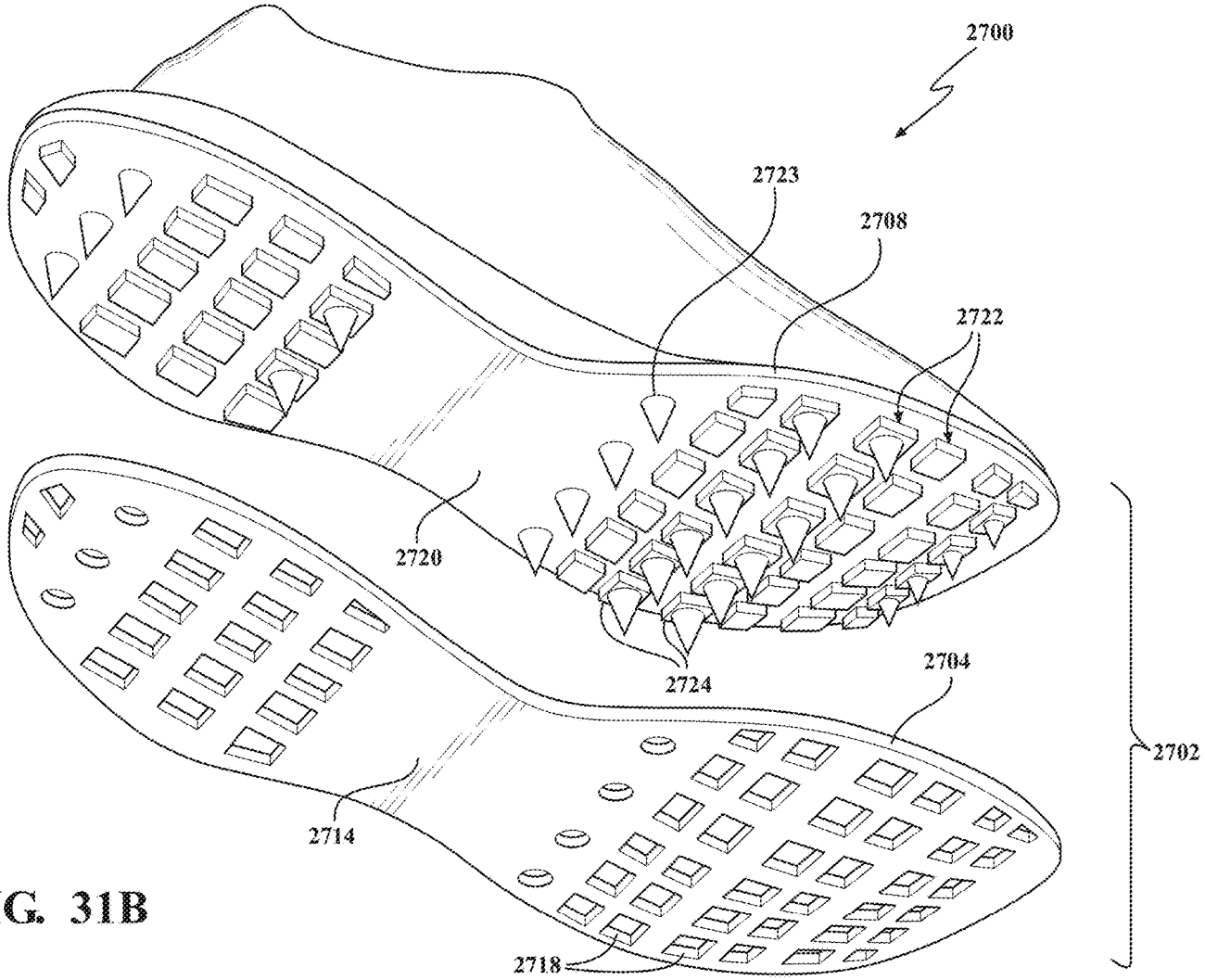
FIG. 31B depicts a perspective view of the underside of the shoe with cleats, in accordance with an embodiment of the present disclosure.

With reference to FIG. 31B, in another disclosed non-limiting embodiment, relatively rigid cleats 2723 may be arranged to protrude through the openings 2718 when a predetermined relative pressure is applied, then retract when the predetermined relative pressure is removed to, for example, provide a self-cleaning capability that may be particularly beneficial when used in certain turf sports such as golf, football, soccer, rugby, etc. The cleats 2723 may be pins, spikes, blades, or other protrusions that extend from the bottom surface 2720 and/or the bottom surfaces 2724 of the columns 2722. Further, the first layer 2704 may be configured to include a hardness and/or surface area that facilitates the extension of the cleats 2723 when a user traverses a relatively soft ground surface such as turf or sand, yet, retract when the user traverses a hard surface such as concrete.

Figure 32:
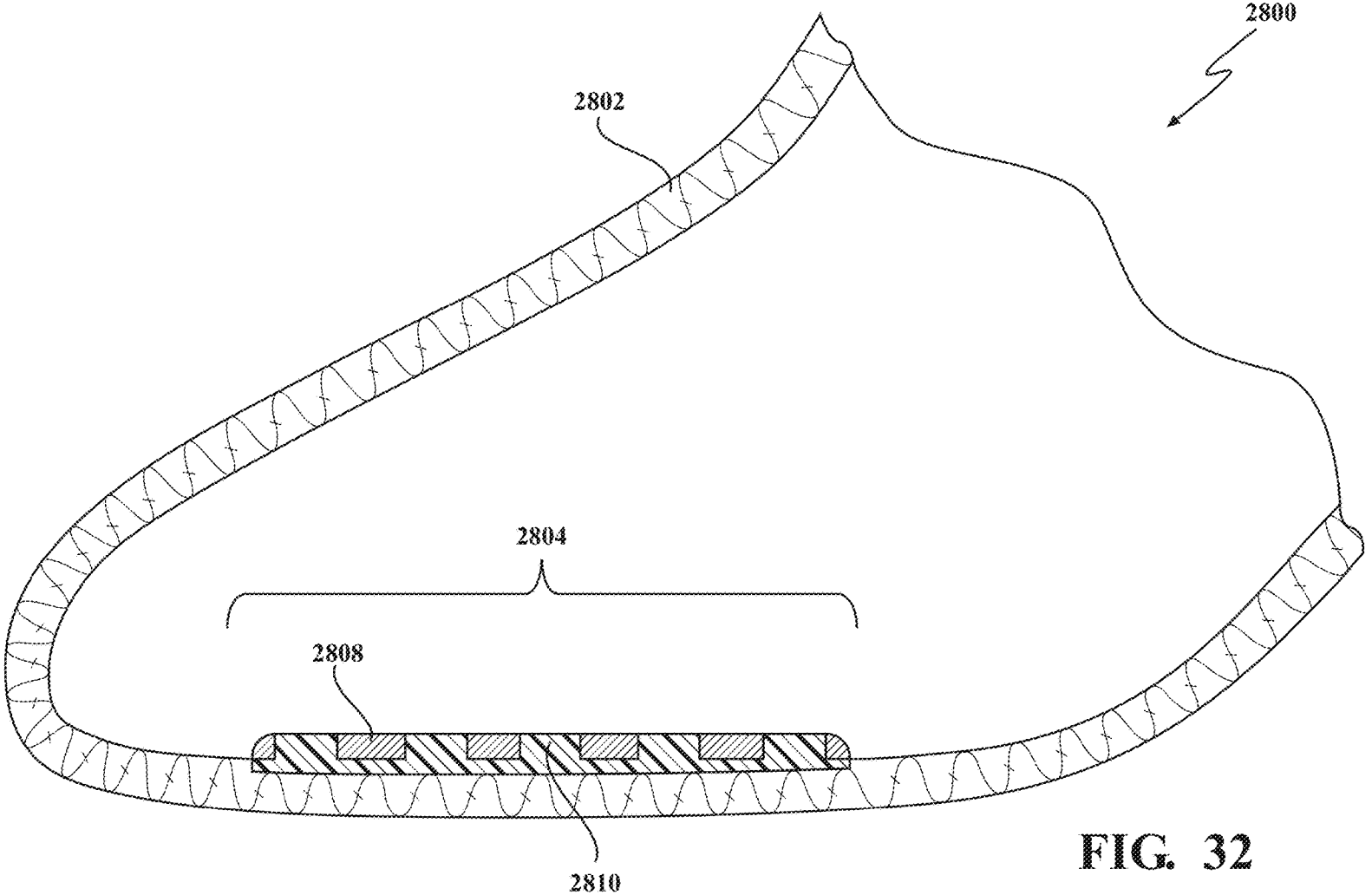
FIG. 32 depicts a cross-sectional view of a toe portion of a sock, in accordance with an embodiment of the present disclosure.

With reference to FIG. 32, a cross-sectional view of an example toe portion of a sock 2800, in accordance with an embodiment of the present disclosure, may include a woven body 2802 and at least one layered engagement structure 2804. The woven body 2802 may be manufactured of flexible, absorbent, material to, for example, facilitate the absorption of moisture from the foot, and cushion the foot from rough edges and surfaces within the shoe or boot. It should be appreciated that although schematically illustrated as separate elements, the woven body 2802 and the layered engagement structure 2804 may be integrated or otherwise formed in a relatively unitary manner.

Figure 33:
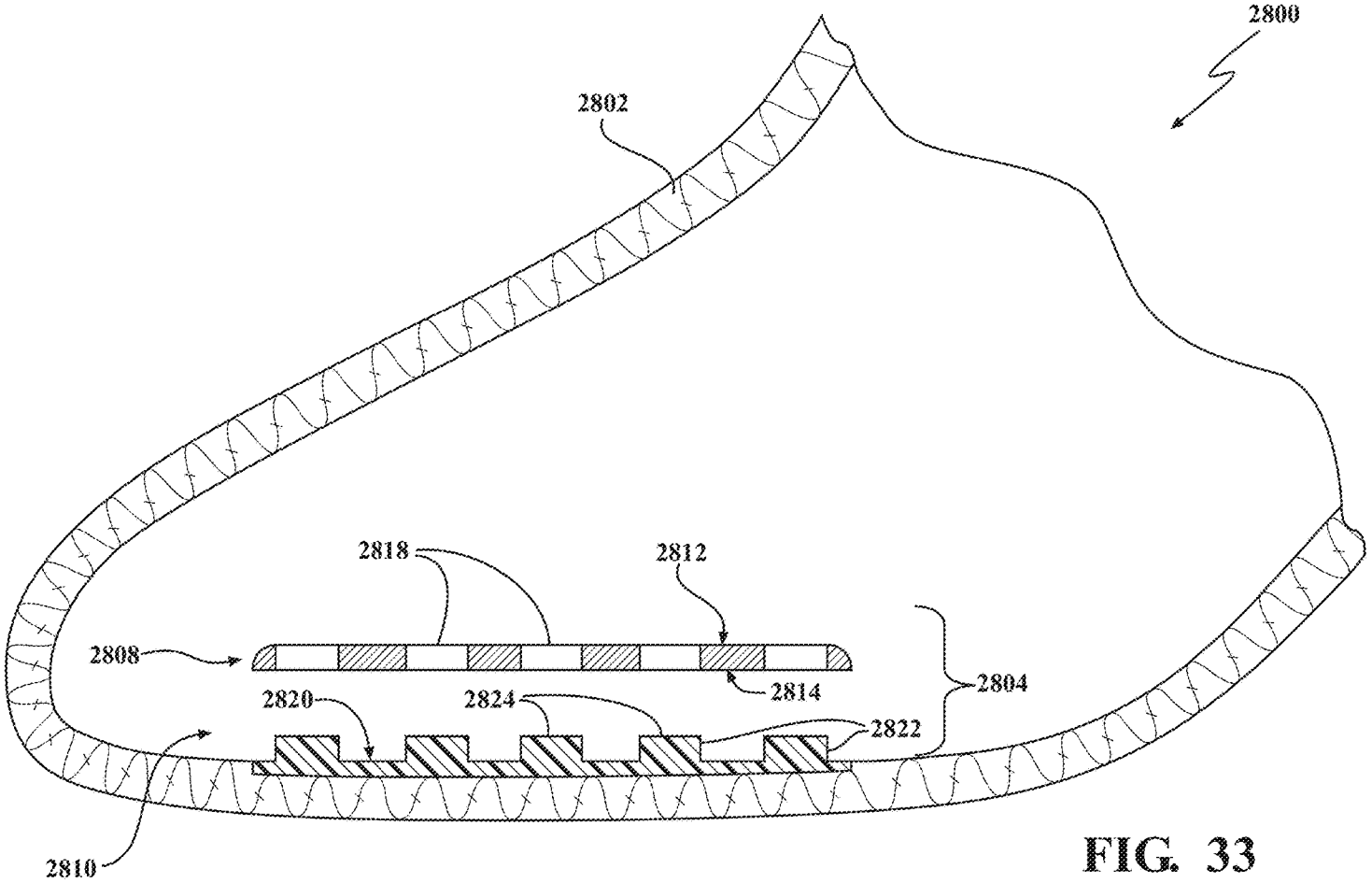
FIG. 33 depicts a cross-sectional view of the toe portion of the sock, in accordance with an embodiment of the present disclosure.

With reference to FIG. 33, the layered engagement structure 2804 may include a first layer 2808 and a second layer 2810. The first layer 2808 may include a top surface 2812 and one or more arrays of one or more openings 2818. The second layer 2810 may include a top surface 2820 and one or more arrays of one or more columns 2822 that correspond to the openings 2818 in the first layer 2808 and protrude from the top surface 2820. It should be appreciated that the locations of each of the columns 2822 may also be associated with particular shoes, or boots to provide a synergistic effect.

In embodiments, the second layer 2810 is engaged with the woven body 2802. That is, the second layer 2810 may be weaved, sewed, bonded or otherwise partially embedded into the woven body 2802. Alternatively, the columns 2822 may be individually attached to the woven body 2802 of the sock 2800, and the remainder of the second layer 2810 may be eliminated. In one example, the top surface 2820 of the second layer 2810 may define a relationship of about 0.04 to 0.5 columns 2822 per square centimeter.

As described above with regard to the embodiments represented by FIGS. 29A-29G, the layered engagement structure 2804 may be manufactured of materials of particular types and in particular configurations such as those described above, and the columns 2822 may be of various cross-sectional shapes, may be organically arranged with respect to the shape of the user, and/or arrayed to form a brand logo, graphic, image, etc., and. The layered engagement structure 2804, as described above, may also include a third, or greater number, of layers as well as, or alternatively include a web (FIGS. 2 and 25) as a separate component. Although the different non-limiting embodiments include specific illustrated components, the embodiments are not limited to those particular combinations and it is possible to use some of the components or features from any of the non-limiting embodiments in combination with features or components from any of the other non-limiting embodiments, e.g., those from the layered engagement structure 2804 may be utilized with the sole 2702 and/or the insole 2600, and vice-versa.

Figure 34:
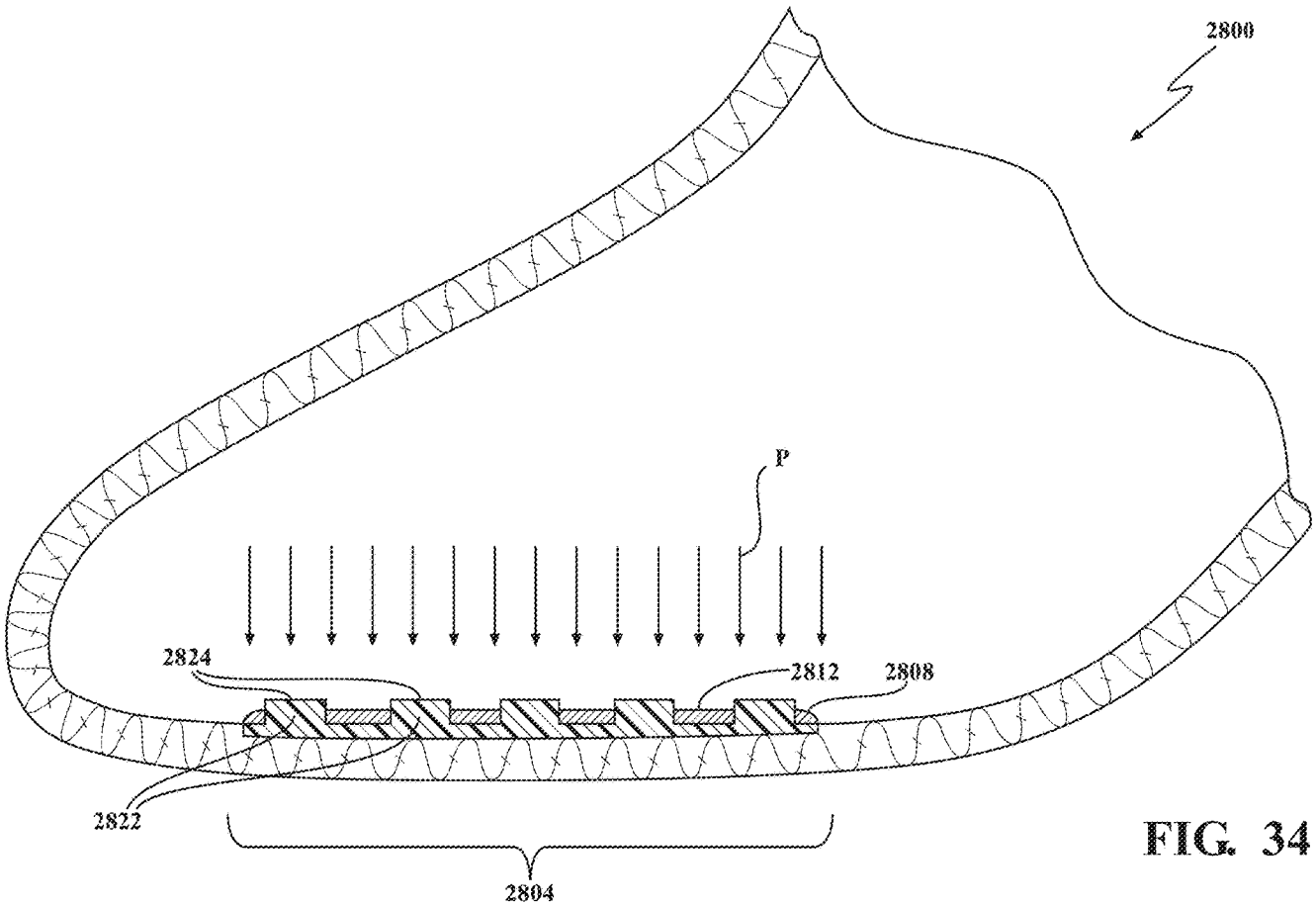
FIG. 34 depicts a cross-sectional view of the toe portion of the sock, in accordance with an embodiment of the present disclosure.

With reference to FIG. 34, in operation, the sole of the user's foot may engage with the top surface 2812 of the first layer 2808 of the layered engagement structure 2804, and with the top surfaces 2824 of the columns 2822. The user's foot thereby applies pressure, represented by arrows "P," which may vary as the user walks, runs or jumps, on the top surface 2812 of the first layer 2808 and on the top surfaces 2824 of the columns 2822. When the pressure on the layered engagement structure 2804 exceeds a threshold value, the first layer 2808 may compress more than the columns 2822, thereby increasing the engagement of the columns 2822 with the sole of the user's foot to, for example, decrease the amount of slipping between the user's foot and the sock 2800. Alternatively, the increased engagement of the columns 2822 with the sole of the user's foot may provide a massaging action, may stimulate specific beneficial pressure points on the sole of the foot, may provide propriocentric cues through engagement with the sole of the foot to remind the user to apply less force, impact, or motion in the region where the layered engagement structure 2804 is located.

Figure 35:
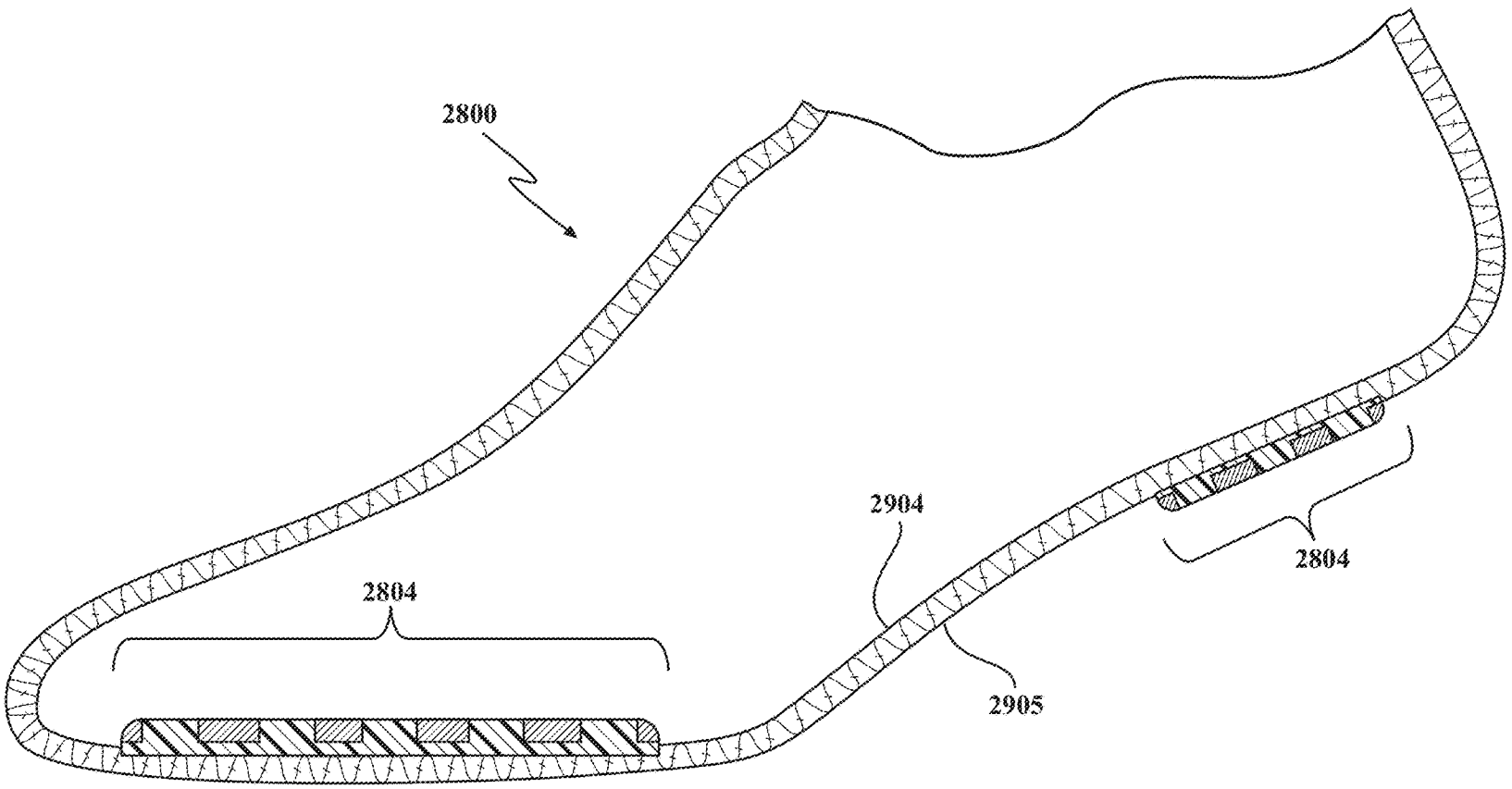
FIG. 35 depicts a cross-sectional view of the bottom portion of the sock, in accordance with an embodiment of the present disclosure.

With reference to FIG. 35, the layered engagement structures 2804 may be located in one or more regions on the inside 2904 of the sock 2800 to optimize the gripping action, the massaging action, the pressure point stimulation, or the propriocentric feedback, or any combination thereof, on specific regions of the user's foot, and may also be located in one or more regions of the outside 2905 of the sock 2800 to optimize the gripping action between the sock 2800 and the shoe or boot.

Figure 36A:
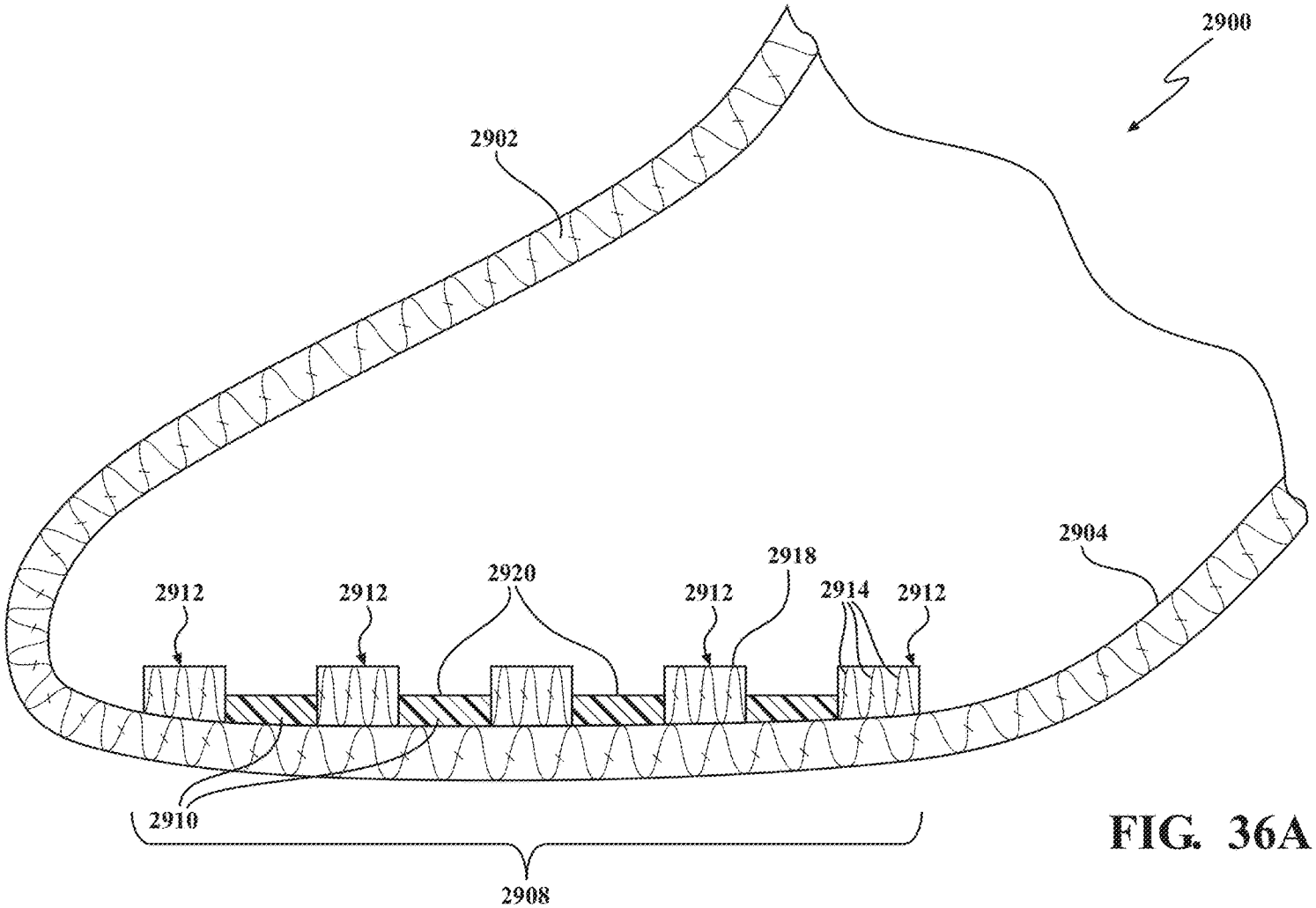
FIG. 36A depicts a cross-sectional view of a toe portion of a sock, in accordance with an embodiment of the present disclosure.

With reference to FIG. 36A, a cross-sectional view of a toe portion of a sock 2900 with a woven body 2902 and at least one engagement structure 2908 in accordance with another disclosed non-limiting embodiment of the present disclosure. The engagement structure 2908 may include one or more arrays of one or more columns 2910 that protrude from the woven body 2902. As described above with regard to the embodiments represented by FIGS. 29A-29G, the engagement structure 2908 may be manufactured of materials of particular types and in particular configurations such as those described above, and the columns 2910 may be of various cross-sectional shapes, may be organically arranged with respect to the shape of the user, and/or arrayed to form a brand logo, graphic, image, etc. The engagement structure 2908, as described above, may also include a third, or greater number, of layers as well as, or alternatively include a web (FIGS. 2 and 25) as a separate component. Although the different non-limiting embodiments include specific illustrated components, the embodiments are not limited to those particular combinations and it is possible to use some of the components or features from any of the non-limiting embodiments in combination with features or components from any of the other non-limiting embodiments, e.g., those from the sock 2900 may be utilized with the sole 2702 and/or the insole 2600, the sock 2900, and vice-versa.

In embodiments, the columns 2910 may be manufactured of an at least partially compressible material such as an elastomer or other polymeric material of, for example, a Shore A durometer in the range of 10 to 100. The columns 2910 may be attached to the woven body 2902 by adhesive, by stitching, or by any suitable bonding process such that the columns 2910 extend therefrom. The columns 2910 may be solid, may include one or more hollow regions, or be otherwise configured and/or shaped as described above. Alternatively, the columns 2910 may be formed of materials equivalent to that of the woven body 2902 but at a significantly more dense arrangement. That is, the columns 2910 may differ from the woven body 2902 only by the density of the fabric. Alternatively still, the columns 2910 may be formed of a fabric different than that of the woven body 2902.

In embodiments, a web 2909 (FIG. 36B) may be utilized to connect the columns 2918. The web 2909 may be manufactured of relatively loosely-woven fibers such as that which are used to manufacture the woven body 2902. The columns 2918 may be molded or formed directly to the web 2909, or may be bonded to the web 2909 with adhesive or by a bonding process. Alternatively, the columns 2918 may be directly woven into the connecting web 2909 or the woven body 2902 during the manufacturing process. In an embodiment, the engagement structure 2908 may define a relationship of about 0.04 to 0.5 columns 2910 per square centimeter.

Figure 36B:
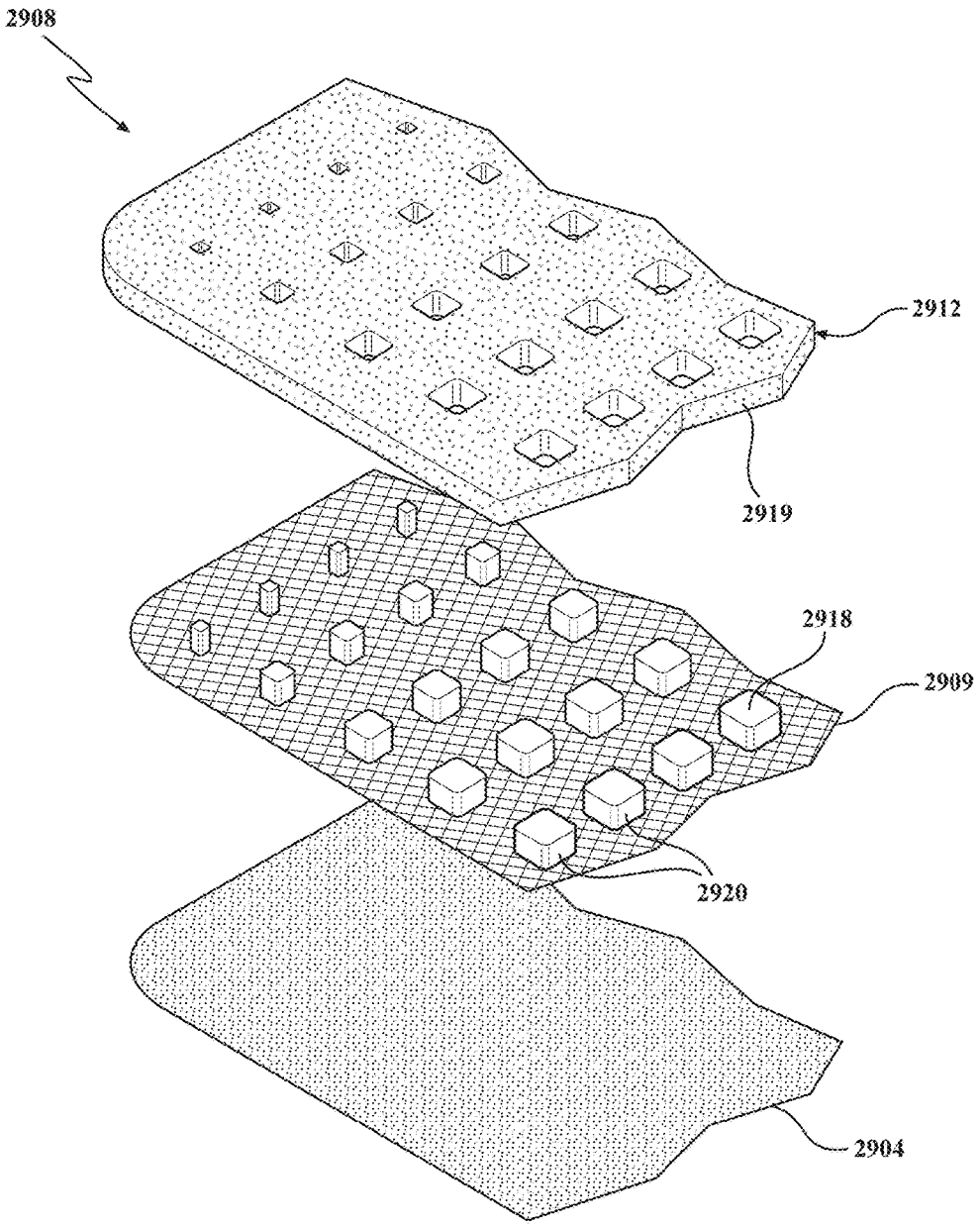
FIG. 36B depicts an exploded view of the toe portion of the sock of FIG. 36A.

In embodiments, the compressible regions 2912 may be formed by flexible fibers 2914 (illustrated schematically as wavy lines; FIG. 36B) that at least partially surround the columns 2910. The flexible fibers 2914 may be manufactured of any of a number of natural and/or synthetic materials commonly used in woven or non-woven fabrics that may be of loop weaves, fiber pile, flocking, or the like. The flexible fibers 2914 may be manufactured of the same material as the woven body 2902 to provide integration therewith and facilitate, for example, the absorption of moisture. That is, the compressible regions 2912 of flexible fibers 2914 may be a thicker region of the woven body 2902 and/or be formed as a layer (FIG. 36B) integrated with the woven body 2902. It should be appreciated that the flexible fibers 2914 may be of various shapes such as straight, circular, semi-circular, etc.

The compressible regions 2912 form a top surface 2918 defined by the tops of the flexible fibers 2914. In one embodiment, the columns 2910 may have top surfaces 2920 that may be disposed below, above, or be aligned with the top surfaces 2918 of the compressible regions 2912. As the compressible regions 2912 may be, for example, tufts of fibers, it should be appreciated that the top surfaces 2918 may be somewhat uneven. The compressible regions 2912 may be relatively more compressible than the columns 2910 as the compressible regions 2912 and the columns 2910 may be manufactured of different materials, and/or the same material that is weaved, sewn or otherwise manufactured to achieve the desired different compressibility.

Figure 37:
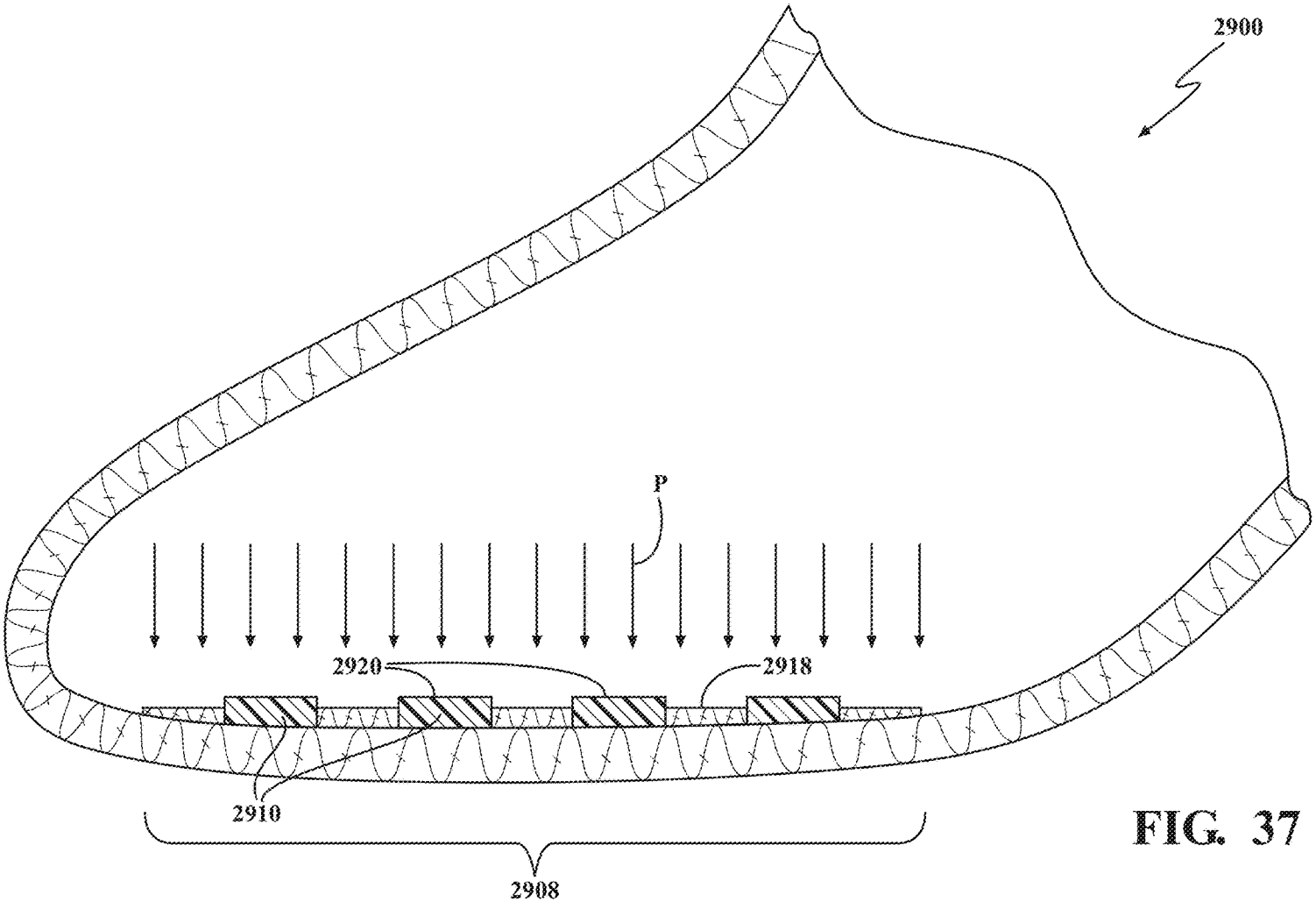
FIG. 37 depicts a cross-sectional view of the toe portion of the sock, in accordance with an embodiment of the present disclosure.

With reference to FIG. 37, in operation, the sole of the user's foot may engage with the top surfaces 2918 of the compressible regions 2912 and with the top surfaces 2920 of the columns 2910 of the engagement structure 2908. The user's foot may apply pressure, represented by arrows "P", which may vary as the user walks, runs, jumps, or otherwise changes position on the top surfaces 2918 of the compressible regions 2912 and on the top surfaces 2920 of the columns 2910. When the pressure on the engagement structure 2908 exceeds a threshold value, the compressible regions 2912 may compress more than the columns 2910, thereby increasing the engagement of the columns 2910 with the sole of the user's foot, to, for example, decrease slippage between the user's foot and the sock 2900. Alternatively, the increased engagement of the columns 2910 with the sole of the user's foot may, for example, provide a massaging action, may stimulate specific beneficial pressure points on the sole of the foot, may provide propriocentric cues through engagement with the sole of the foot to, for example, remind the user to apply less force, impact, or motion in the region where the engagement structure 2908 is located to facilitate, for example, healing, or effect a manner of walking.

Figure 38:
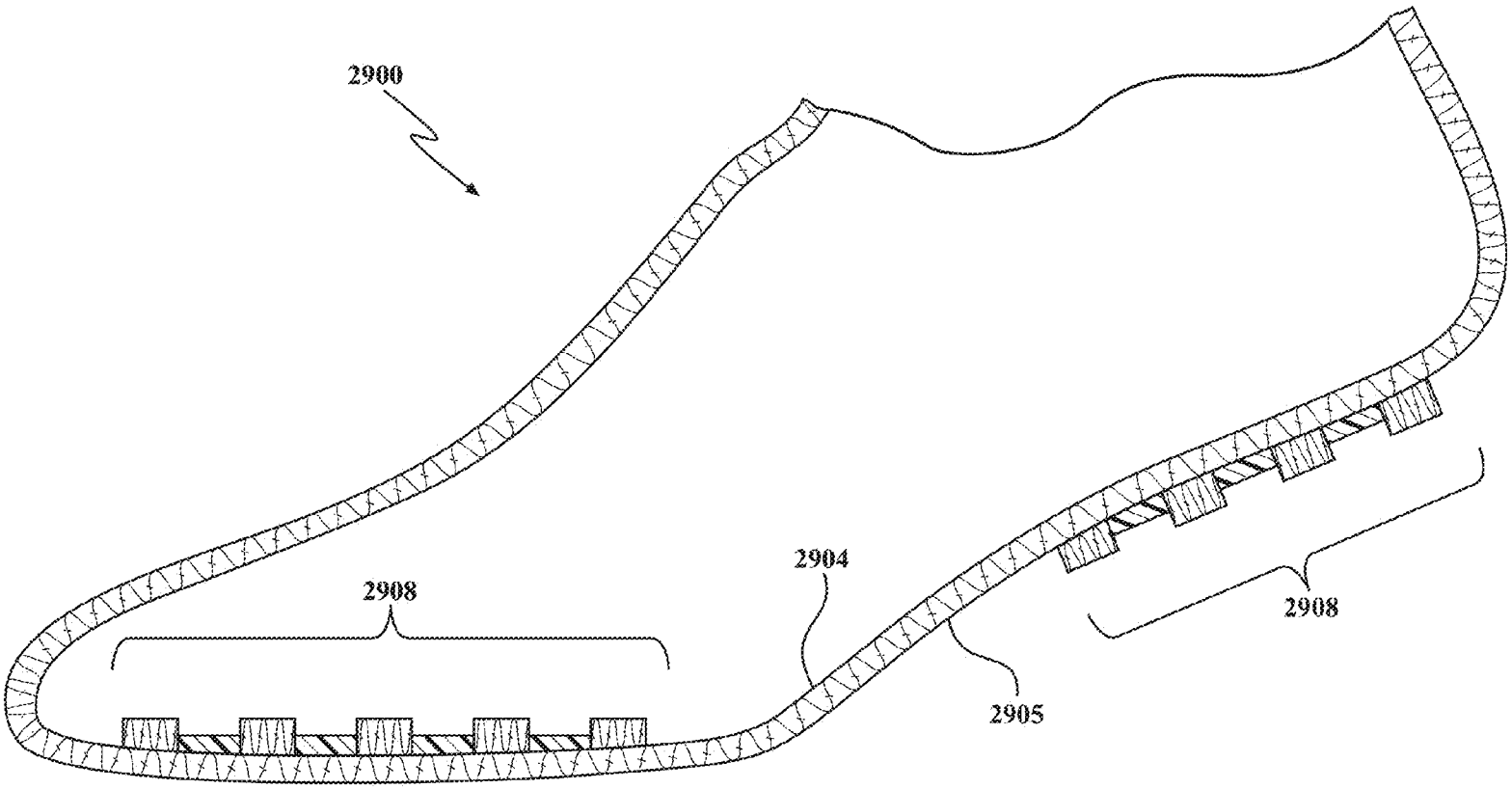
FIG. 38 depicts a cross-sectional view of the bottom portion of the sock, in accordance with an embodiment of the present disclosure.

With reference to FIG. 38, the engagement structures 2908 may be located in one or more regions on an inside surface 2904 of the sock 2900 to optimize the gripping action, the massaging action, the pressure point stimulation, the propriocentric feedback, or any combination thereof, on specific regions of the user's foot. Alternatively, or in addition, the engagement structures 2908 may be located on an outside surface 2905 of the sock 2900 to optimize the gripping action between the sock 2900 and the shoe or boot.

Illustrative Insoles, Outsoles, Layered Structures, Socks, and Footwear Items

In some implementations, a footwear item may be described in the following clauses or otherwise described herein and as illustrated in at least FIGS. 29A-H.

Clause 27. A footwear item, comprising: a first layer that at least partially corresponds to a shape of a foot sole and forms a top surface of the footwear item, the first layer including a multiple of openings; and a second layer with a multiple of columns, each of the multiple of columns correspond with one of the multiple of openings in the first layer to extend at least partially therein.

Clause 28. The footwear item as recited in clause 27, wherein each of the columns range in size from 0.01 to 100 square centimeters in area.

Clause 29. The footwear item as recited in clause 27, wherein at least one of the multiple of columns forms a graphic in cross-sectional shape.

Clause 30. The footwear item as recited in clause 27, wherein the multiple of columns form a graphic.

Clause 31. The footwear item as recited in clause 27, wherein the multiple of columns form an organic pattern, the organic pattern correspond to a region of the user's foot.

Clause 32. The footwear item as recited in clause 27, wherein a bottom surface of the second layer forms a bottom surface of a footwear item.

Clause 33. The footwear item as recited in clause 27, further comprising a third layer with a multiple of openings that corresponds to the multiple of openings in the first layer, the third layer attached to the first layer such that at least a portion of a top surface of the third layer forms a surface closest a user's foot.

Clause 34. The footwear item as recited in clause 27, wherein the first layer is formed of a first material and the second layer is formed of a second material different than the first material, the first material is relatively softer than the second material.

Clause 35. The footwear item as recited in clause 27, wherein the multiple of columns are arranged to provide propriocentric cues.

Clause 36. The footwear item as recited in clause 27, wherein at least one of the multiple of columns includes a hollow region.

Clause 37. The footwear item as recited in clause 27, wherein a top surface of at least one of the multiple of columns are generally flush with a top surface of the first layer while the first layer is in an uncompressed state.

Clause 38. The footwear item as recited in clause 27, wherein at least one of the multiple of openings extends completely through the first layer.

Clause 39. The footwear item as recited in clause 27, wherein a top surface of at least one of the multiple of columns is covered by the first layer.

Clause 40. The footwear item as recited in clause 27, wherein a top surface of the multiple of columns are generally flush with a top surface of the first layer while the first layer is in an uncompressed state.

In some implementations, footwear insoles may be described in the following clauses or otherwise described herein and as illustrated in at least FIGS. 29A-H.

Clause 1. A footwear insole, comprising: a first layer with a multiple of openings, the first layer forms a top surface of the footwear insole; and a second layer with a multiple of columns, each of the multiple of columns correspond with one of the multiple of openings in the first layer to extend at least partially therein.

Clause 2. The insole as recited in clause 1, wherein each of the columns range in size from 0.01 to 100 square centimeters in area.

Clause 3. The insole as recited in clause 1, wherein at least one of the multiple of columns is at least one of square, circular, trapezoidal, or triangular in cross-sectional shape.

Clause 4. The insole as recited in clause 1, wherein at least one of the multiple of columns include an organic shape.

Clause 5. The insole as recited in clause 1, wherein at least one of the multiple of columns form a graphic in cross-sectional shape.

Clause 6. The insole as recited in clause 1, wherein at least two of the multiple of columns are arranged in an organic pattern.

Clause 7. The insole as recited in clause 6, wherein the organic patterns correspond to various regions of the user's foot.

Clause 8. The insole as recited in clause 4, wherein at least two of the multiple of columns are arranged to form a graphic.

Clause 9. The insole as recited in clause 1, further comprising a web that joins each of the multiple of columns, the web located between the first layer and the second layer.

Clause 10. The insole as recited in clause 1, wherein the first layer and the second layer are manufactured together by at least one of a two-material molding process, a three-material molding process, an insert molding process, or casting process.

Clause 11. The insole as recited in clause 10, wherein the first layer is molded directly onto the top surface of the second layer.

Clause 12. The insole as recited in clause 1, wherein the first layer, the second layer, and the multiple of columns are formed together in a three-material molding process.

Clause 13. The insole as recited in clause 1, wherein the multiple of columns are formed directly onto the second layer.

Clause 14. The insole as recited in clause 1, wherein a bottom surface of the second layer forms a bottom surface of the footwear insole.

Clause 15. The insole as recited in clause 1, wherein the footwear insole is attached to at least one of a footwear midsole, a footwear outsole, or a footwear upper.

Clause 16. The insole as recited in clause 1, wherein the footwear insole is receivable within footwear such that at least a portion of the top surface of the first layer is located closest to a user's foot.

Clause 17. The insole as recited in clause 1, further comprising a third layer with a multiple of openings that corresponds to the multiple of openings in the first layer, the third layer attached to the first layer such that at least a portion of a top surface of the third layer forms a surface closest a user's foot.

Clause 18. The insole as recited in clause 17, wherein the third layer is manufactured of a wear-resistant material.

Clause 19. The insole as recited in clause 1, wherein the multiple of columns are arranged to provide propriocentric cues.

Clause 20. The insole as recited in clause 1, wherein the first layer is formed of a first material and the second layer is formed of a second material different than the first material.

Clause 21. The insole as recited in clause 20, wherein the first material is relatively softer than the second material.

Clause 22. The insole as recited in clause 21, wherein the first material includes an ethyl vinyl acetate.

Clause 23. The insole as recited in clause 1, wherein at least one of the multiple of columns includes a hollow region.

Clause 24. The insole as recited in clause 1, wherein a top surface of at least one of the multiple of columns are generally flush with a top surface of the first layer while the first layer is in an uncompressed state.

Clause 25. The insole as recited in clause 24, wherein at least one of the multiple of openings extends completely through the first layer.

Clause 26. The insole as recited in clause 1, wherein a top surface of at least one of the multiple of columns are covered by the first layer.

Clause 27. The insole as recited in clause 1, wherein a top surface of the multiple of columns are generally flush with a top surface of the first layer while the first layer is in an uncompressed state.

Clause 28. The insole as recited in clause 1, further comprising a third layer with a second multiple of openings therethrough, the second layer between the first layer and the third layer.

Clause 29. The insole as recited in clause 28, wherein the second layer includes a second multiple of columns, each of the second multiple of columns correspond with one of the second multiple of openings in the third layer to extend at least partially therein.

In some implementations, footwear outsoles may be described in the following clauses or otherwise described herein and as illustrated in at least FIGS. 30, 31A, and 31B.

Clause 30. A footwear outsole, comprising: a first layer with a multiple of openings, the first layer forms a bottom of the footwear outsole; and a second layer with a multiple of columns, each of the multiple of columns correspond with one of the multiple of openings in the first layer to extend at least partially therein.

Clause 31. The outsole as recited in clause 30, wherein each of the columns range in size from 0.003 to 100 square centimeters in area.

Clause 32. The outsole as recited in clause 30, wherein at least one of the multiple of columns is at least one of square, circular, trapezoidal, or triangular in cross-sectional shape.

Clause 33. The outsole as recited in clause 30, wherein at least one of the multiple of columns include an organic shape.

Clause 34. The outsole as recited in clause 30, wherein at least one of the multiple of columns form a graphic in cross-sectional shape.

Clause 35. The outsole as recited in clause 30, wherein at least two of the multiple of columns are arranged in an organic pattern.

Clause 36. The outsole as recited in clause 35, wherein the organic pattern corresponds to a region of the user's foot.

Clause 37. The outsole as recited in clause 36, wherein the patterns correspond to various regions of the top surface of the first layer.

Clause 38. The outsole as recited in clause 36, wherein the patterns correspond to a region of the user's foot that engage a top insole.

Clause 39. The outsole as recited in clause 30, wherein the footwear outsole is attached to a footwear midsole.

Clause 40. The outsole as recited in clause 39, wherein the footwear midsole is attached to an upper.

Clause 41. The outsole as recited in clause 30, wherein the outsole forms a portion of a sandal.

Clause 42. The outsole as recited in clause 30, wherein the footwear lacks a midsole, and the second layer is attached to a footwear upper.

Clause 43. The outsole as recited in clause 30, further comprising a cleat that extends from at least one of the multiple of columns.

Clause 44. The outsole as recited in clause 30, wherein at least one of the multiple of columns is a cleat as recited in clause 43, wherein the cleat extends through a respective one of the multiple of openings in response to application of a pressure to the second layer and retracts when the pressure is removed.

Clause 45. The outsole as recited in clause 44, wherein the application of the pressure is generated in response to a differential pressure between a user and a relative soft surface on the cleat.

Clause 46. The outsole as recited in clause 44, wherein the removal of the pressure is generated in response to a relative pressure between a user and a relative hard surface on the cleat.

Clause 47. The outsole as recited in clause 30, further comprising a third layer with a second multiple of openings therethrough, the second layer between the first layer and the third layer.

Clause 48. The outsole as recited in clause 30, wherein the second layer includes a second multiple of columns, each of the second multiple of columns correspond with one of the second multiple of openings in the third layer to extend at least partially therein.

Clause 49. The outsole as recited in clause 48, wherein a top surface of at least one of the multiple of columns are covered by the third layer.

Clause 50. The outsole as recited in clause 48, wherein the top surface of the third layer is located closest to a user's foot.

Clause 51. The outsole as recited in clause 30, wherein the multiple of columns are integral to the second layer.

Clause 52. The outsole as recited in clause 30, further comprising a web that joins each of the multiple of columns, the web located between the first layer and the second layer.

In some implementations, footwear outsoles may be described in the following clauses or otherwise described herein and as illustrated in at least FIGS. 29A-H, 30, 31A, and 31B.

Clause 53. A layered engagement structure, comprising: a first layer with a multiple of openings, the first layer sole shaped; and a multiple of columns, each of the multiple of columns correspond with one of the multiple of openings in the first layer to extend at least partially therein.

Clause 54. The layered engagement structure as recited in clause 53, further comprising a second layer to at least partially entrap the multiple of columns with respect to the first layer, the multiple of columns extend from the second layer.

Clause 55. The layered engagement structure as recited in clause 53, further comprising a web that joins each of the multiple of columns, the web located between the first layer and the second layer.

Clause 56. The layered engagement structure as recited in clause 53, wherein the sole is an insole, a top surface of the first layer of the footwear insole forms the bottom surface of the footwear.

Clause 57. The layered engagement structure as recited in clause 53, wherein the sole is an outsole, a bottom surface of the first layer of the footwear outsole forms the bottom surface of the footwear.

In some implementations, footwear outsoles may be described in the following clauses or otherwise described herein and as illustrated in at least FIGS. 32-35, 36A, 36B, 37, and 38.

Clause 1. A sock, comprising: a woven body; a multiple of columns that extend relative to the woven body; and a compressible region that surrounds each of the multiple of columns.

Clause 2. The sock as recited in clause 1, further comprising a web that joins each of the multiple of columns.

Clause 3. The sock as recited in clause 2, wherein the web is integrated with the woven body.

Clause 4. The sock as recited in clause 2, wherein the web is sewn into the woven body.

Clause 5. The sock as recited in clause 1, wherein the compressible regions are formed from flexible fibers.

Clause 6. The sock as recited in clause 1, wherein the compressible regions are formed from a material that forms the woven body.

Clause 7. The sock as recited in clause 1, wherein the compressible regions are formed by a relatively thicker region of the woven body.

Clause 8. The sock as recited in clause 1, wherein the compressible regions are formed by a layer of material with a multiple of openings, each of the multiple of columns correspond with one of the multiple of openings to extend at least partially therein.

Clause 9. The sock as recited in clause 8, wherein the layer of material is formed from flexible fibers.

Clause 10. The sock as recited in clause 8, wherein the layer of material is formed from a material that forms the woven body.

Clause 11. The sock as recited in clause 1, wherein the multiple of columns extend toward an interior of the woven body.

Clause 12. The sock as recited in clause 1, wherein the multiple of columns extend toward an exterior of the woven body.

Clause 13. The sock as recited in clause 1, wherein at least one of the multiple of columns includes a top surface aligned with a top surface of the compressible region.

Clause 14. The sock as recited in clause 1, wherein the multiple of columns are formed of a first material and the compressible region is formed of a second material different than the first material.

Clause 15. The sock as recited in clause 14, wherein the first material is relatively softer than the second material.

Clause 16. The sock as recited in clause 15, wherein the first material includes ethyl vinyl acetate.

Clause 17. The sock as recited in clause 1, wherein at least one of the multiple of columns includes a hollow region.

Clause 18. A sock, comprising: a woven body; a first layer with a multiple of openings; and a second layer with a multiple of columns, each of the multiple of columns correspond with one of the multiple of openings in the first layer to extend at least partially therein, the second layer attached to the woven body.

Clause 19. The sock as recited in clause 18, wherein the second layer is sewn to the woven body.

Clause 20. The sock as recited in clause 18, wherein the second layer is bonded to the woven body.

Clause 21. The sock as recited in clause 18, wherein the second layer is integrated into the woven body.

Clause 22. The sock as recited in clause 18, wherein the first layer is formed from a material that forms the woven body.

Clause 23. The sock as recited in clause 18, wherein the first layer is formed from flexible fibers.

Clause 24. The sock as recited in clause 18, wherein at least one of the multiple of columns includes a top surface aligned with at top surface of the first layer.

Clause 25. The sock as recited in clause 18, wherein the multiple of columns are formed of a first material and the second layer is formed of a second material different than the first material.

In some implementations, footwear outsoles may be described in the following clauses or otherwise described herein and as illustrated in FIGS. 30, 31A, and 31B.

Clause 1. A footwear item, comprising: an insole, comprising: a first layer with a multiple of openings, the first layer forms a top surface of the footwear insole; and a second layer with a multiple of columns, each of the multiple of columns correspond with one of the multiple of openings in the first layer to extend at least partially therein.

Clause 2. A footwear item, comprising: an outsole, comprising: a first layer with a multiple of openings, the first layer forms a bottom of the footwear outsole; and a second layer with a multiple of columns, each of the multiple of columns correspond with one of the multiple of openings in the first layer to extend at least partially therein.

Clause 3. A footwear item, comprising: an insole, comprising: a first layer with a multiple of openings, the first layer forms a top surface of the footwear insole; and a second layer with a multiple of columns, each of the multiple of columns correspond with one of the multiple of openings in the first layer to extend at least partially therein; and an outsole, comprising: a first layer with a multiple of openings, the first layer forms a bottom of the footwear outsole; and a second layer with a multiple of columns, each of the multiple of columns correspond with one of the multiple of openings in the first layer to extend at least partially therein.

The elements disclosed and depicted herein, including in flow charts and block diagrams throughout the figures, imply logical boundaries between the elements. However, according to software or hardware engineering practices, the depicted elements and the functions thereof may be implemented on machines through computer executable media having a processor capable of executing program instructions stored thereon as a monolithic software structure, as standalone software modules, or as modules that employ external routines, code, services, and so forth, dynamically loaded or updated modules, or any combination of these, and all such implementations may be within the scope of the present disclosure.

It should be appreciated that like reference numerals identify corresponding or similar elements throughout the several drawings. It should also be appreciated that although a particular component arrangement is disclosed in the illustrated embodiment, other arrangements will benefit herefrom.

Although the different non-limiting embodiments include specific illustrated components, the embodiments are not limited to those particular combinations. It is possible to use some of the components or features from any of the non-limiting embodiments in combination with features or components from any of the other non-limiting embodiments.

Although particular step sequences are shown, disclosed, and claimed, it should be appreciated that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically disclosed. For that reason the appended claims should be studied to determine true scope and content.

All documents referenced herein are hereby incorporated by reference.

What is claimed is:

1. An apparatus including a portion of a footwear item, comprising:

a first layer with a multiple of openings;

a second layer with a multiple of columns, wherein each of the multiple of columns correspond with one of the multiple of openings in the first layer;

a web that joins each of the multiple of columns, the web located between the first layer and the second layer;

wherein the first layer comprises a first surface facing away from the second layer and a second surface facing toward the second layer;

wherein in a first position, each of the multiple of columns extend into a corresponding one of the multiple of openings through the second surface but not through the first surface;

wherein in a second position, at least one of the multiple of columns extend through the corresponding one of the multiple of openings and through both of the second surface and the first surface;

wherein the first layer comprises a first material, wherein at least a portion of the second layer comprises a second material, and wherein the first material has a greater compressibility than the second material; and wherein the first layer engaged with the second layer comprises the portion of the footwear item.

2. The apparatus as recited in claim 1, wherein the first surface of the first layer forms a top surface of an insole.

3. The apparatus as recited in claim 1, wherein the first surface of the first layer forms a bottom surface of an outsole.

4. The apparatus as recited in claim 1, wherein each of the columns range in size from 0.01 to 100 square centimeters in area.

5. The apparatus as recited in claim 1, wherein at least one of the multiple of columns forms a graphic in cross-sectional shape.

6. The apparatus as recited in claim 1, wherein the multiple of columns form a graphic.

7. The apparatus as recited in claim 1, wherein the first position comprises an uncompressed state.

8. The apparatus as recited in claim 1, further comprising a third layer with a multiple of openings that corresponds to the multiple of openings in the first layer, the third layer attached to the first layer such that at least a portion of a top surface of the third layer forms a surface closest to a user's foot.

9. The apparatus as recited in claim 1, wherein at least one of the multiple of columns includes a hollow region.

10. The apparatus as recited in claim 1, further comprising:

a third layer that at least partially corresponds to the shape of first layer, the third layer including a second multiple of openings therethrough, the second layer between the first layer and the third layer.

11. The apparatus as recited in claim 10, wherein the second layer includes a second multiple of columns, wherein each of the second multiple of columns correspond with one of the second multiple of openings in the third layer to extend at least partially therein.

12. An apparatus including a portion of a footwear item, comprising:

a first layer with a multiple of openings;

a second layer, and a multiple of columns positioned between the first layer and the second layer, wherein each of the multiple of columns correspond with one of the multiple of openings in the first layer;

a web that joins each of the multiple of columns, the web located between the first layer and the second layer;

wherein the first layer comprises a first surface facing away from the second layer and a second surface facing toward the second layer;

wherein in a first position, each of the multiple of columns extend into a corresponding one of the multiple of openings through the second surface but not through the first surface;

wherein in a second position, at least one of the multiple of columns extend through the corresponding one of the multiple of openings and through both of the second surface and the first surface;

wherein the first layer comprises a first material, wherein at least a portion of the second layer comprises a second material, and wherein the first material has a greater compressibility than the second material; and wherein the first layer engaged with the second layer comprises the portion of the footwear item.

13. The apparatus as recited in claim 12, wherein each of the columns range in size from 0.01 to 100 square centimeters in area.

14. The apparatus as recited in claim 12, wherein at least one of the multiple of columns forms a graphic in cross-sectional shape.

15. The apparatus as recited in claim 12, wherein the multiple of columns form a graphic.

16. The apparatus as recited in claim 12, wherein at least one of the multiple of columns includes a hollow region.

17. The apparatus as recited in claim 12, wherein the first surface of the first layer forms a top surface of an insole.

18. The apparatus as recited in claim 12, wherein the first surface of the first layer forms a bottom surface of an outsole.

* * * * *